US011793374B2

(12) United States Patent
Conrad

(10) Patent No.: US 11,793,374 B2
(45) Date of Patent: Oct. 24, 2023

(54) SURFACE CLEANING APPARATUS WITH A VARIABLE INLET FLOW AREA

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 313 days.

(21) Appl. No.: 16/283,209

(22) Filed: Feb. 22, 2019

(65) Prior Publication Data

US 2019/0254491 A1 Aug. 22, 2019

Related U.S. Application Data

(63) Continuation-in-part of application No. 16/106,229, filed on Aug. 21, 2018, now Pat. No. 11,076,729, (Continued)

(51) Int. Cl.
*A47L 5/22* (2006.01)
*A47L 9/16* (2006.01)
(Continued)

(52) U.S. Cl.
CPC ..... *A47L 5/225* (2013.01); *A47L 5/32* (2013.01); *A47L 5/365* (2013.01); *A47L 5/28* (2013.01); *A47L 9/165* (2013.01); *A47L 9/1608* (2013.01)

(58) Field of Classification Search
CPC ... A47L 5/225; A47L 5/24; A47L 5/26; A47L 5/28; A47L 5/32; A47L 5/36;
(Continued)

(56) References Cited

U.S. PATENT DOCUMENTS 3,667,084 A * 6/1972 Valbona ..... A47L 5/24 15/323
4,747,179 A * 5/1988 Berfield ..... A47L 9/02 15/415.1
(Continued)

FOREIGN PATENT DOCUMENTS

CA 2881824 A1 9/2013
DE 0666051 A1 * 1/1995
(Continued)

OTHER PUBLICATIONS

Combined Original copy and Machine translation of Arnold et al. (EP 0666051) (Year: 1995).*
(Continued)

*Primary Examiner* — Don M Anderson
*Assistant Examiner* — Jonathan R Zaworski
(74) *Attorney, Agent, or Firm* — Philip C. Mendes da Costa; BERESKIN & PARR LLP/S.E.N.C.R.L., s.r.l.

(57) ABSTRACT

A reconfigurable surface cleaning apparatus includes a floor cleaning unit comprising a surface cleaning head, and a hand vacuum cleaner. The reconfigurable surface cleaning apparatus is operable in a floor cleaning mode in which the hand vacuum cleaner is mounted to a rigid wand of the floor cleaning unit and operated using an energy storage member of the hand vacuum cleaner, and also operable in an above floor cleaning mode in which the hand vacuum cleaner is disconnected from air flow with the floor cleaning unit and operated using the energy storage member. A cross-sectional area through the rigid wand is less than a cross-sectional area through an upstream portion of an airflow path of the hand vacuum cleaner. A velocity of air travelling through the wand in the floor cleaning mode is greater than a velocity of air flow through the upstream portion in the above floor cleaning mode.

7 Claims, 44 Drawing Sheets

Related U.S. Application Data which is a continuation of application No. 15/046,895, filed on Feb. 18, 2016, now Pat. No. 10,076,217, which is a continuation of application No. 14/036,818, filed on Sep. 25, 2013, now Pat. No. 9,301,662, which is a continuation of application No. 13/396,918, filed on Feb. 15, 2012, now Pat. No. 8,567,006, which is a continuation of application No. 11/954,310, filed on Dec. 12, 2007, now Pat. No. 8,166,607.

(60) Provisional application No. 60/869,586, filed on Dec. 12, 2006.

(51) Int. Cl.
*A47L 5/32* (2006.01)
*A47L 5/36* (2006.01)
*A47L 5/28* (2006.01)

(58) Field of Classification Search
CPC ..... A47L 9/165; A47L 9/0072; A47L 9/2878; A47L 9/24; A47L 9/242; A47L 9/248; A47L 9/2884
USPC ..... 15/328, 329, 344, 4, 331, 334
See application file for complete search history.

(56) References Cited

U.S. PATENT DOCUMENTS

| | | | | |
|---|---|---|---|---|
| 5,309,600 | A | 5/1994 | Weaver et al. | |
| 5,771,529 | A * | 6/1998 | Brule | A47L 9/242 15/339 |
| 6,141,826 | A | 11/2000 | Conrad et al. | |
| 6,378,166 | B1 * | 4/2002 | Bruno | A47L 9/244 285/12 |
| 6,391,095 | B1 | 5/2002 | Conrad et al. | |
| 6,599,340 | B2 | 7/2003 | Conrad et al. | |
| 7,455,708 | B2 | 11/2008 | Conrad et al. | |
| 7,882,593 | B2 | 2/2011 | Beskow et al. | |
| 8,032,981 | B2 | 10/2011 | Yoo | |
| 8,117,712 | B2 | 2/2012 | Dyson et al. | |
| 8,127,398 | B2 | 3/2012 | Conrad | |
| 8,156,609 | B2 | 4/2012 | Milne et al. | |
| 8,240,003 | B2 | 8/2012 | Gammack et al. | |
| 8,438,693 | B2 | 5/2013 | Fujiwara | |
| 9,138,114 | B2 | 9/2015 | Conrad | |
| 9,259,127 | B2 * | 2/2016 | Cagner | F16L 21/03 |
| 9,392,916 | B2 | 7/2016 | Conrad et al. | |
| 9,516,979 | B2 | 12/2016 | Gidwell | |
| 9,795,261 | B2 | 10/2017 | Krebs | |
| 9,801,511 | B2 | 10/2017 | Conrad | |
| 9,888,817 | B2 | 2/2018 | Conrad | |
| 10,517,449 | B2 | 12/2019 | Han et al. | |
| 10,531,772 | B2 * | 1/2020 | Warren | B01D 46/0089 |
| 10,765,276 | B2 * | 9/2020 | Shinagawa | A47L 9/08 |
| 11,039,721 | B2 * | 6/2021 | Tahara | A47L 9/1608 |
| 2008/0040883 | A1 * | 2/2008 | Beskow | A47L 9/165 15/329 |
| 2009/0282639 | A1 | 11/2009 | Dyson et al. | |
| 2010/0140917 | A1 | 6/2010 | Sheremeta et al. | |
| 2011/0219567 | A1 | 9/2011 | Conrad | |
| 2015/0135474 | A1 * | 5/2015 | Gidwell | A47L 5/26 15/323 |
| 2015/0297045 | A1 | 10/2015 | Marsh et al. | |
| 2015/0297050 | A1 * | 10/2015 | Marsh | A47L 9/242 15/347 |
| 2016/0000285 | A1 | 1/2016 | Liu et al. | |
| 2016/0174785 | A1 * | 6/2016 | Conrad | A47L 5/30 15/329 |
| 2017/0071426 | A1 * | 3/2017 | Krebs | A47L 9/127 |
| 2017/0196420 | A1 * | 7/2017 | Brown | A47L 5/24 |
| 2017/0258282 | A1 * | 9/2017 | Shinagawa | A47L 9/12 |
| 2017/0303754 | A1 | 10/2017 | Conrad et al. | |
| 2019/0357740 | A1 | 11/2019 | Thorne et al. | |

FOREIGN PATENT DOCUMENTS

| | | | | |
|---|---|---|---|---|
| EP | 666051 | A1 | 8/1995 | |
| JP | 2004089241 | A * | 3/2004 | |
| JP | 2014124443 | A * | 7/2014 | |
| JP | 2015097637 | A * | 5/2015 | |
| JP | 2015097641 | A * | 5/2015 | |
| JP | 2016120167 | A * | 7/2016 | |
| WO | 2014131106 | A1 | 9/2014 | |
| WO | WO-2018036459 | A1 * | 3/2018 | A47L 9/24 |

OTHER PUBLICATIONS

International Search Report and Written Opinion, received in connection to International Patent Application No. PCT/CA2020/050162, dated Apr. 15, 2020.

English machine translation of EP666051, published on Aug. 9, 1995.

* cited by examiner

SURFACE CLEANING APPARATUS WITH A VARIABLE INLET FLOW AREA

CROSS REFERENCE TO RELATED APPLICATIONS

This application is a continuation-in-part of U.S. patent application Ser. No. 16/106,229 filed on Aug. 21, 2018, which is pending, which itself is a continuation of U.S. patent application Ser. No. 15/046,895, filed on Feb. 18, 2016, which issued as U.S. Pat. No. 10,076,217 on Sep. 18, 2018, which itself is a continuation of U.S. patent application Ser. No. 14/036,818, which issued as U.S. Pat. No. 9,301,662 on Apr. 5, 2016, which itself is a continuation of U.S. patent application Ser. No. 13/396,918 filed on Feb. 15, 2012, which issued as U.S. Pat. No. 8,567,006 on Oct. 29, 2013, which is itself a continuation of U.S. patent application Ser. No. 11/954,310 filed on Dec. 12, 2007, which issued as U.S. Pat. No. 8,166,607 on May 1, 2012, which claims priority from U.S. Provisional Patent Application No. 60/869,586, filed on Dec. 12, 2006, each of which is incorporated herein by reference in its entirety.

FIELD

This disclosure relates generally to reconfigurable surface cleaning apparatus, and more specifically to surface cleaning apparatus that can be reconfigured to operate in a floor cleaning mode and in an above floor cleaning mode.

INTRODUCTION

Various types of surface cleaning apparatus are known, including upright surface cleaning apparatus, canister surface cleaning apparatus, stick surface cleaning apparatus, and hand carriable surface cleaning apparatus. Surface cleaning apparatus include vacuum cleaners.

Surface cleaning apparatus designed to clean floor surfaces often include a surface cleaning head configured to be rolled (or otherwise translated) across the floor surface. Such surface cleaning heads may include one or more mechanical agitators (e.g. brush bars) to assist in dislodging dirt and debris from the floor surface. Such surface cleaning heads are often located at least three feet from a control handle of the surface cleaning apparatus, to allow a user to direct the cleaning head across the floor surface while in an upright standing position.

Surface cleaning apparatus designed for cleaning surfaces other than floor surfaces (e.g. tabletops, furniture, shelves, wall surfaces) include hand carriable surface cleaning apparatus, which may be referred to as "hand vacuum cleaners" or "handvacs". A hand carriable surface cleaning apparatus or handvac is a vacuum cleaner that can be operated generally one-handedly to clean a surface while its weight is supported by the same one hand. Often, the dirty air inlet of a hand vac is located within about a foot or two from the control handle of the hand vac, e.g. to allow a user to direct the dirty air inlet across raised surfaces while in an upright standing position.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

The performance of a surface cleaning apparatus or vacuum cleaner may be characterized in a number of ways. For example, a typical performance measure is the quantity of airflow through the surface cleaning apparatus per unit time, e.g. cubic feet per minute (CFM). A rotating brush may lift dirt and debris above a surface to be cleaner. However, it is the airflow that entrains and transports dirt and other debris from a surface being cleaned to the air treatment member of the surface cleaning apparatus (e.g. one or more cyclonic cleaning stages, a filter bag, a porous filter media, and the like). A vacuum cleaner with a higher airflow rating (e.g. a higher CFM) may have a greater cleaning ability than a vacuum cleaner with a lower airflow rating since the higher air flow enables more dirt and debris to be entrained and transported.

While a high air flow rating enables a lot of dirt and debris to be entrained and transported, the velocity of the air stream will affect the type of dirt and debris that may be entrained and transported. Generally, heavier or denser dirt and debris requires a higher air flow than lighter or less dense dirt and debris.

Another typical performance measure of a surface cleaning apparatus is its 'lifting power'. A vacuum cleaner with a higher velocity may be able to lift larger and/or heavier debris (such as dimes or other coins) and transport this debris from the surface being cleaned to the air treatment member.

Providing a surface cleaning apparatus with both high airflow (CFM) performance and high lifting power may be considered desirable. However, where the suction motor of a hand vacuum cleaner is powered by an onboard energy storage member (e.g. one or more rechargeable batteries), the weight and/or power output of the suction motor may be limited, e.g. due to the weight, cost, and/or other concerns of, e.g., the on board energy storage members (e.g., a battery pack).

In some cases, a preferred trade-off between airflow performance and lifting power may depend on the intended use of the surface cleaning apparatus. For example, when cleaning a floor surface by translating a surface cleaning head across the floor surface, it may be considered desirable to provide a relatively high lifting power, as this may allow relatively heavy and/or large debris to be transported to the air treatment member. For example, this may increase the number of types of debris that the surface cleaning apparatus can 'pick-up' from the floor surface. As another example, when cleaning surfaces other than floor surfaces (e.g. tabletops, furniture, shelves, wall surfaces) it may be considered desirable to provide a relatively high airflow (which may be characterized as a relatively high mass transport rate), as this may allow the surface cleaning apparatus to transport a larger quantity of dust and debris to the air treatment member per unit time.

Without intending to be bound by theory, the 'lifting power' of a surface cleaning apparatus may be considered generally proportional to the velocity of air flowing from the dirty air inlet to the inlet of an air treatment member. Accordingly, where a suction motor and/or fan assembly is operated at a constant rate (e.g. at a constant power level), the 'lifting power' may be considered proportional to the cross-sectional area of the air flow path between the dirty air inlet and the inlet of the air treatment member. Accordingly, all else being substantially equal, the 'lifting power' of a surface cleaning apparatus may be increased by reducing the cross-sectional area of the air flow path to the air treatment member, and the airflow throughput of the surface cleaning apparatus may be increased by increasing the cross-sectional area of the air flow path to the air treatment member (e.g. by reducing the 'drag' or other aerodynamic inefficiencies of a narrower air flow path).

The power utilized to produce a particular velocity of air flow will depend, inter alia, on the cross-sectional area of the air flow path. A smaller cross-sectional area (e.g., a smaller pipe diameter) will produce more back pressure. Therefore, more power will be required to produce a higher velocity. When a surface cleaning apparatus is operated in a cordless mode, the on board energy storage members have a finite amount of power. Therefore, the greater the velocity of the air flow, the lower the run time of the surface the cleaning apparatus. Conversely, by increasing the cross-sectional area, a lower velocity is achieved, but a higher air flow (CFM) may be obtained with a lower back pressure. The lower back pressure may result in a lower power utilization rate and therefore a longer run time from the on board energy storage members.

In accordance with one aspect of this disclosure, a surface cleaning apparatus may utilize different sized inlet flow paths for different cleaning operations. For example, a reconfigurable surface cleaning apparatus includes a floor cleaning unit with a surface cleaning head and an upper section that includes a rigid wand, and a portable or hand vacuum cleaner that can be removably mounted to the floor cleaning unit. In a floor cleaning mode, the hand vacuum cleaner is mounted to the floor cleaning unit, and in operation a suction motor of the hand vacuum induces an air flow through an air flow path extending from a dirty air inlet of the surface cleaning head to an air outlet of the floor cleaning unit, through an air treatment member of the hand vacuum cleaner, and to a clean air outlet of the hand vacuum cleaner. In an above floor cleaning mode, the hand vacuum cleaner is disconnected from air flow communication with the rigid wand, and in operation the suction motor of the hand vacuum induces an air flow through an air flow path extending from a dirty air inlet of the hand vacuum cleaner, through the air treatment member, and to the clean air outlet of the hand vacuum cleaner.

Preferably, the cross-sectional area of the air flow path through the rigid wand (in a plane transverse to the direction of air flow through the wand) is less than the cross-sectional area of the air flow path between the hand vacuum cleaner dirty air inlet to the air treatment member. An advantage of such a configuration is that the velocity of air travelling through the rigid wand in the floor cleaning mode may be greater than the velocity of air travelling through the upstream portion in the above floor cleaning mode.

Providing a reconfigurable surface cleaning apparatus in which a velocity of air through the rigid wand (in a floor cleaning mode) is greater than a velocity of air to the air treatment member (in an above floor cleaning mode) may have one or more advantages. For example, the surface cleaning apparatus may have a greater 'lifting power' in the floor cleaning mode (when this performance characteristic may be considered particularly desirable), and a greater airflow performance in the above floor cleaning mode (when this performance characteristic may be considered particularly desirable). A further advantage is that by using a lower velocity or a larger cross-sectional flow are in the above floor cleaning mode, a longer run time may be obtained on a single change of the on board energy storage members.

In accordance with this broad aspect, there is provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the upper section comprising a rigid wand, the floor cleaning unit air flow path including the rigid wand, the rigid wand having an air outlet; and, (b) a hand vacuum cleaner comprising an energy storage member and a hand vacuum cleaner air flow path extending from a hand vacuum cleaner dirty air inlet to a hand vacuum cleaner air outlet, the hand vacuum cleaner air flow path including an air treatment member, a suction motor, an upstream portion extending from the hand vacuum cleaner dirty air inlet to the air treatment member and a downstream portion extending from the air treatment member to the hand vacuum cleaner air outlet, the hand vacuum cleaner is removably mountable to the rigid wand, wherein the reconfigurable surface cleaning apparatus is operable in a floor cleaning mode in which the hand vacuum cleaner is mounted to the rigid wand and operated using the energy storage member, and an above floor cleaning mode in which the hand vacuum cleaner is disconnected from air flow with the rigid wand and operated using the energy storage member, wherein a cross-sectional area of a flow area of the rigid wand in a plane transverse to a direction of air flow through the rigid wand is less than a cross-sectional area of a flow area of the upstream portion in a plane transverse to a direction of air through the upstream portion, and wherein a velocity of air travelling through the rigid wand in the floor cleaning mode is greater than a velocity of air flow through the upstream portion in the above floor cleaning mode.

In some embodiments, the dirty air inlet of the hand vacuum cleaner may be removably mountable to the air outlet of the rigid wand.

In some embodiments, the hand vacuum cleaner may further comprise a handle and, in the floor cleaning mode, the handle may be drivingly connected to the surface cleaning head whereby the handle is useable to steer the surface cleaning head.

In some embodiments, the suction motor may be operated at the same power level by the energy storage member in the floor cleaning mode and in the above floor cleaning mode.

In some embodiments, the suction motor may be operated at a first power level by the energy storage member in the floor cleaning mode and at a second, higher power level in the above floor cleaning mode.

In some embodiments, the cross-sectional area of the upstream portion may be at least 15%, 20%, or 25% greater than the cross-sectional area of the rigid wand.

In some embodiments, the downstream portion may have a cross sectional area in a plane transverse to a direction of flow through the downstream portion that is at least as large as the cross sectional area of the upstream portion.

In accordance with this aspect, there is also provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the floor cleaning unit air flow path including an upflow portion extending to the floor cleaning unit air outlet; and (b) a portable cleaning unit removably mountable to the floor cleaning unit, the portable cleaning unit comprising a portable cleaning unit air flow path extending from a portable cleaning unit dirty air inlet to a portable cleaning unit air outlet, the portable cleaning unit air flow path including an air treatment member, a suction motor, an upstream portion extending from the portable cleaning unit dirty air inlet to the air treatment member and a downstream portion extending from the air treatment member to the portable cleaning unit air outlet, wherein the reconfigurable surface cleaning apparatus is operable in a floor cleaning mode in which the portable cleaning unit is mounted to the floor cleaning unit and an above floor cleaning mode in which the portable cleaning unit is disconnected from air flow with the floor cleaning unit, and wherein a cross-sectional area of the upflow portion in a plane transverse to a direction of air flow through the upflow portion is less than a cross sectional area of the upstream portion in a plane transverse to a direction of air flow through the upstream portion.

In some embodiments, the suction motor may be operated at the same power level in the floor cleaning mode and in the above floor cleaning mode.

In some embodiments, the suction motor may be operated at a first power level in the floor cleaning mode and at a second, higher power level in the above floor cleaning mode.

In some embodiments, the cross-sectional area of the upstream portion may be at least 15%, 20%, or 25% greater than the cross-sectional area of the upflow portion.

In some embodiments, the downstream portion may have a cross sectional area in a plane transverse to a direction of flow through the downstream portion that is at least as large as the cross sectional area of the upstream portion.

In some embodiments, the portable cleaning unit may further comprise an energy storage member and the hand vacuum cleaner may be operated using the energy storage member in the portable cleaning mode.

In accordance with this aspect, there is also provided a reconfigurable surface cleaning apparatus comprising:

a portable cleaning unit; and a floor cleaning unit having a surface cleaning head;

the reconfigurable surface cleaning apparatus being operable in a floor cleaning mode and an above floor cleaning mode, wherein:

(a) in the floor cleaning mode, the portable cleaning unit is in air flow communication with a dirty air inlet of the surface cleaning head via a first conduit, the first conduit having a downstream portion that has a first cross-sectional area in a plane transverse to the direction of air flow through the downstream portion; and, (b) in the above floor cleaning mode, the portable cleaning unit is in air flow communication with a second dirty air inlet via a second conduit, the second conduit having a second cross-sectional area in a plane transverse to the direction of air flow through the second conduit, wherein the second cross-sectional area is greater than the first cross-sectional area.

In some embodiments, the second conduit may be a portable cleaning unit air inlet conduit.

In some embodiments, the downstream portion may comprise an up flow duct.

In some embodiments, the downstream portion may extend to an outlet of an air flow path extending through the floor cleaning unit.

In some embodiments, the first and second conduits may comprise first and second configurations of an expandable conduit that is adjustable from the first configuration, which has the first cross-sectional area, to the second configuration, which has the second cross-sectional area.

In some embodiments, the first conduit may be removably receivable in the second conduit.

In some embodiments, the cross-sectional area of the second conduit may be at least 15%, 20%, or 25% greater than the cross-sectional area of the first conduit.

In accordance with another aspect of this disclosure, a reconfigurable surface cleaning apparatus includes a floor cleaning unit comprising a surface cleaning head, and a portable cleaning unit removably mountable to the floor cleaning unit. A higher velocity of air flow in a floor cleaning mode is achieved by using a narrower upflow duct, which is removably receivable in the inlet conduit of the portable cleaning unit. The inlet conduit of the portable cleaning unit may comprise part or all of the inlet air flow path when the portable cleaning unit is disconnected from air flow with the floor cleaning unit such that the upflow conduit is removed from the inlet conduit. The inlet air flow path of the portable cleaning unit in an above floor cleaning mode has a larger diameter than the upflow duct (e.g., the cross sectional flow area of the air inlet flow path may be 10%, 15%, 20%, 25%, 30% or more larger than that of the upflow conduit).

An advantage of this design is that the reconfigurable surface cleaning apparatus may have a greater 'lifting power' in the floor cleaning mode, and a greater airflow performance in the above floor cleaning mode.

In accordance with this broad aspect, there is provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the floor cleaning unit air flow path including an upflow conduit extending to the floor cleaning unit air outlet; and (b) a portable cleaning unit removably mountable to the floor cleaning unit, the portable cleaning unit comprising a portable cleaning unit air flow path extending from a portable cleaning unit dirty air inlet to a portable cleaning unit air outlet, the portable cleaning unit air flow path including a cyclone having a cyclone axis of rotation, a suction motor and an upstream portion extending from the portable cleaning unit dirty air inlet to the cyclone, the upstream portion comprising an inlet conduit having an inlet conduit axis that is generally parallel to the cyclone axis of rotation, the cyclone axis of rotation extending generally vertically when the portable cleaning unit is mounted to the floor cleaning unit and the upper section is in the upright storage position, wherein the reconfigurable surface cleaning apparatus is operable in a floor cleaning mode in which the portable cleaning unit is mounted to the floor cleaning unit and the upflow conduit is seated in the inlet conduit, and wherein the reconfigurable surface cleaning apparatus is also operable in an above floor cleaning mode in which the portable cleaning unit is disconnected from air flow with the floor cleaning unit.

In some embodiments, the reconfigurable surface cleaning apparatus may further comprise a cyclone bin assembly and the cyclone bin assembly may comprise a one piece assembly that includes the cyclone and the inlet conduit.

In some embodiments, the cyclone bin assembly may be removable from the portable cleaning unit.

In some embodiments, the inlet conduit may be integrally formed with the cyclone bin assembly.

In some embodiments, the upflow conduit may be slideably receivable in the inlet conduit whereby the upflow conduit may be seated in the inlet conduit as the portable cleaning unit is mounted to the floor cleaning unit.

In some embodiments, the inlet conduit may have an outlet end and the outlet end may be openable.

In some embodiments, the inlet conduit may be positioned adjacent an exterior of the cyclone.

In some embodiments, the inlet conduit may be positioned interior to the cyclone.

In some embodiments, when the portable cleaning unit is mounted to the floor cleaning unit and the upper section is in the upright storage position, the cyclone may have an air inlet located at an upper end of the cyclone.

In some embodiments, when the portable cleaning unit is mounted to the floor cleaning unit and the upper section is in the upright storage position, the cyclone may have an air inlet located at a lower end of the cyclone.

In accordance with this aspect, there is also provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the floor cleaning unit air flow path including an upflow conduit extending to the floor cleaning unit air outlet;

(b) a portable cleaning unit removably mountable to the floor cleaning unit, the portable cleaning unit comprising a portable cleaning unit air flow path extending from a portable cleaning unit dirty air inlet to a portable cleaning unit air outlet, the portable cleaning unit air flow path including an air treatment member, a suction motor and an upstream portion extending from the portable cleaning unit dirty air inlet to the air treatment member, the upstream portion comprising an inlet conduit having an inlet conduit axis that extends generally vertically when the portable cleaning unit is mounted to the floor cleaning unit and the upper section is in the upright storage position, wherein the reconfigurable surface cleaning apparatus is operable in a floor cleaning mode in which the portable cleaning unit is mounted to the floor cleaning unit and the upflow conduit is seated in the inlet conduit, and wherein the reconfigurable surface cleaning apparatus is also operable in an above floor cleaning mode in which the portable cleaning unit is disconnected from air flow with the floor cleaning unit.

In some embodiments, the inlet conduit may comprise a one piece assembly with the air treatment member whereby the inlet conduit may be removable from the portable cleaning unit with the air treatment member.

In some embodiments, the upflow conduit may be slideably receivable in the inlet conduit whereby the upflow conduit may be seated in the inlet conduit as the portable cleaning unit is mounted to the floor cleaning unit.

In some embodiments, the inlet conduit may have an outlet end and the outlet end may be openable.

In accordance with this aspect, there is also provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the upper section comprising a rigid wand, the floor cleaning unit air flow path including the rigid wand;

(b) a hand vacuum cleaner comprising a hand vacuum cleaner air flow path extending from a hand vacuum cleaner dirty air inlet to a hand vacuum cleaner air outlet, the hand vacuum cleaner air flow path including air treatment member, a suction motor, a hand vacuum cleaner dirty air inlet conduit and a downstream portion extending from the air treatment member to the hand vacuum cleaner air outlet, wherein the rigid wand is removably slideably receivable in the hand vacuum cleaner dirty air inlet conduit, and wherein the reconfigurable surface cleaning apparatus is operable in a floor cleaning mode in which the hand vacuum cleaner is mounted to the rigid wand and an above floor cleaning mode in which the hand vacuum cleaner is disconnected from air flow with the rigid wand.

In some embodiments, a cross-sectional area of a flow area of the hand vacuum cleaner dirty air inlet conduit in a plane transverse to a direction of air flow through the hand vacuum cleaner dirty air inlet conduit may be at least 25% greater than a cross-sectional area of a flow area of the rigid wand in a plane transverse to a direction of air flow through the rigid wand.

In some embodiments, a flow area of the downstream portion may have a cross-sectional area in a plane transverse to a direction of flow through the downstream portion that is at least as large as the cross sectional area of the flow area of the hand vacuum cleaner dirty air inlet conduit.

In some embodiments, the hand vacuum cleaner may further comprise a handle and, in the floor cleaning mode, the handle may be drivingly connected to the surface cleaning head whereby the handle is useable to steer the surface cleaning head.

In some embodiments, the suction motor may be operated at the same power level in the floor cleaning mode and in the above floor cleaning mode.

In some embodiments, the suction motor may be operated at a first power level in the floor cleaning mode and at a second, higher power level in the above floor cleaning mode.

In accordance with another aspect of this disclosure, a reconfigurable surface cleaning apparatus includes a floor cleaning unit and a portable cleaning unit removably mountable to the floor cleaning unit. The portable cleaning unit uses an inverted air treatment is located no more than 20, 24, or 30 inches above the floor. The dirt outlet of the air treatment member may be at an upper end of the air treatment member when the floor cleaning unit is in an upright storage mode.

Providing the cyclone air inlet no more than, e.g., 20 inches above the floor may have one or more advantages. For example, this height to which dirt and debris must be lifted to enter, e.g., a cyclone chamber, is reduced. Accordingly, the power needed to lift the dirt and debris for treatment in the air treatment member may be reduced. It will be appreciated that it need not be necessary for the heavier or denser dirt and debris to exit the cyclone chamber and enter a dirt collection chamber. The heavier or denser dirt and debris may remain in the cyclone chamber. In such a case, the cyclone chamber is preferably openable, optionally concurrently with the dirt collection chamber.

In accordance with this broad aspect, there is provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the floor cleaning unit air flow path including an upflow conduit extending to the floor cleaning unit air outlet; and (b) a portable cleaning unit removably mountable to the floor cleaning unit, the portable cleaning unit comprising an energy storage member, a cyclone and a suction motor, the cyclone having a cyclone axis of rotation, a cyclone inlet and a cyclone outlet, and, when the portable cleaning unit is mounted to the floor cleaning unit and the upper section is in the upright storage position, the cyclone has an upper end and a lower end and the cyclone axis extends generally vertically, wherein the reconfigurable surface cleaning apparatus is operable in a floor cleaning mode in which the portable cleaning unit is mounted to the floor cleaning unit and the energy storage member is operated to power the suction motor, wherein, when the reconfigurable surface cleaning apparatus is in the floor cleaning mode, the floor cleaning unit is positioned on a floor and the upper section is in the upright storage position, the cyclone air inlet is located no more than 20 inches above the floor, and wherein the reconfigurable surface cleaning apparatus is also operable in an above floor cleaning mode in which the portable cleaning unit is disconnected from air flow with the floor cleaning unit and operated using the energy storage member.

In some embodiments, the portable cleaning unit may further comprise an inlet conduit and the upflow conduit may be slideably receivable in the inlet conduit.

In some embodiments, the inlet conduit may extend generally vertically when the portable cleaning unit is mounted to the floor cleaning unit and the upper section is in the upright storage position, whereby the upflow conduit may be seated in the inlet conduit as the portable cleaning unit is mounted to the floor cleaning unit.

In some embodiments, the portable cleaning unit may further comprise a dirt collection chamber in communication with the cyclone via a cyclone dirt outlet and the inlet conduit may extend through the dirt collection chamber.

In some embodiments, the cyclone air inlet may be provided at the upper end of the cyclone.

In some embodiments, the cyclone air inlet may be provided at the lower end of the cyclone.

In some embodiments, the portable cleaning unit may further comprise a dirt collection chamber in communication with the cyclone via a cyclone dirt outlet and the inlet conduit may extend through the dirt collection chamber.

In some embodiments, the suction motor may be operated at the same power level in the floor cleaning mode and in the above floor cleaning mode.

In some embodiments, the suction motor may be operated at a first power level in the floor cleaning mode and at a second, higher power level in the above floor cleaning mode.

In accordance with this aspect, there is also provided a reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the floor cleaning unit air flow path including an upflow conduit extending to the floor cleaning unit air outlet; and (b) a portable cleaning unit removably mountable to the floor cleaning unit, the portable cleaning unit comprising an energy storage member, an air treatment member and a suction motor, the air treatment member having an air treatment member inlet and an air treatment member outlet, and, when the portable cleaning unit is mounted to the floor cleaning unit and the upper section is in the upright storage position, the air treatment member has an upper end and a lower end, wherein the reconfigurable surface cleaning apparatus is operable in a floor cleaning mode in which the portable cleaning unit is mounted to the floor cleaning unit and the energy storage member is operated to power the suction motor, wherein, when the reconfigurable surface cleaning apparatus is in the floor cleaning mode, the surface cleaning unit is positioned on a floor and the upper section is in the upright storage position, the air treatment member air inlet is located no more than 20 inches above the floor, and wherein the reconfigurable surface cleaning apparatus is also operable in an above floor cleaning mode in which the portable cleaning unit is disconnected from air flow with the floor cleaning unit and operated using the energy storage member.

In some embodiments, the portable cleaning unit may further comprise an inlet conduit and the upflow conduit may be slideably receivable in the inlet conduit.

In some embodiments, the inlet conduit may extend generally vertically when the portable cleaning unit is mounted to the floor cleaning unit and the upper section is in the upright storage position, whereby the upflow conduit may be seated in the inlet conduit as the portable cleaning unit is mounted to the floor cleaning unit.

In some embodiments, the portable cleaning unit may further comprise a dirt collection chamber in communication with the air treatment member via an air treatment member dirt outlet, and the inlet conduit may extend through the dirt collection chamber.

In some embodiments, the air treatment member air inlet may be provided in the upper end of the air treatment member.

In some embodiments, the air treatment member air inlet may be provided in the lower end of the air treatment member.

In some embodiments, the portable cleaning unit may further comprise a dirt collection chamber in communication with the air treatment member via an air treatment member dirt outlet, and the inlet conduit may extend through the dirt collection chamber.

In some embodiments, the suction motor may be operated at the same power level in the floor cleaning mode and in the above floor cleaning mode.

In some embodiments, the suction motor may be operated at a first power level in the floor cleaning mode and at a second, higher power level in the above floor cleaning mode.

In some embodiments, the suction motor may be operated at the same power level provided by the energy storage member in the floor cleaning mode and in the above floor cleaning mode.

In some embodiments, the suction motor may be operated at a first power level provided by the energy storage member in the floor cleaning mode and at a second, higher power level in the above floor cleaning mode.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
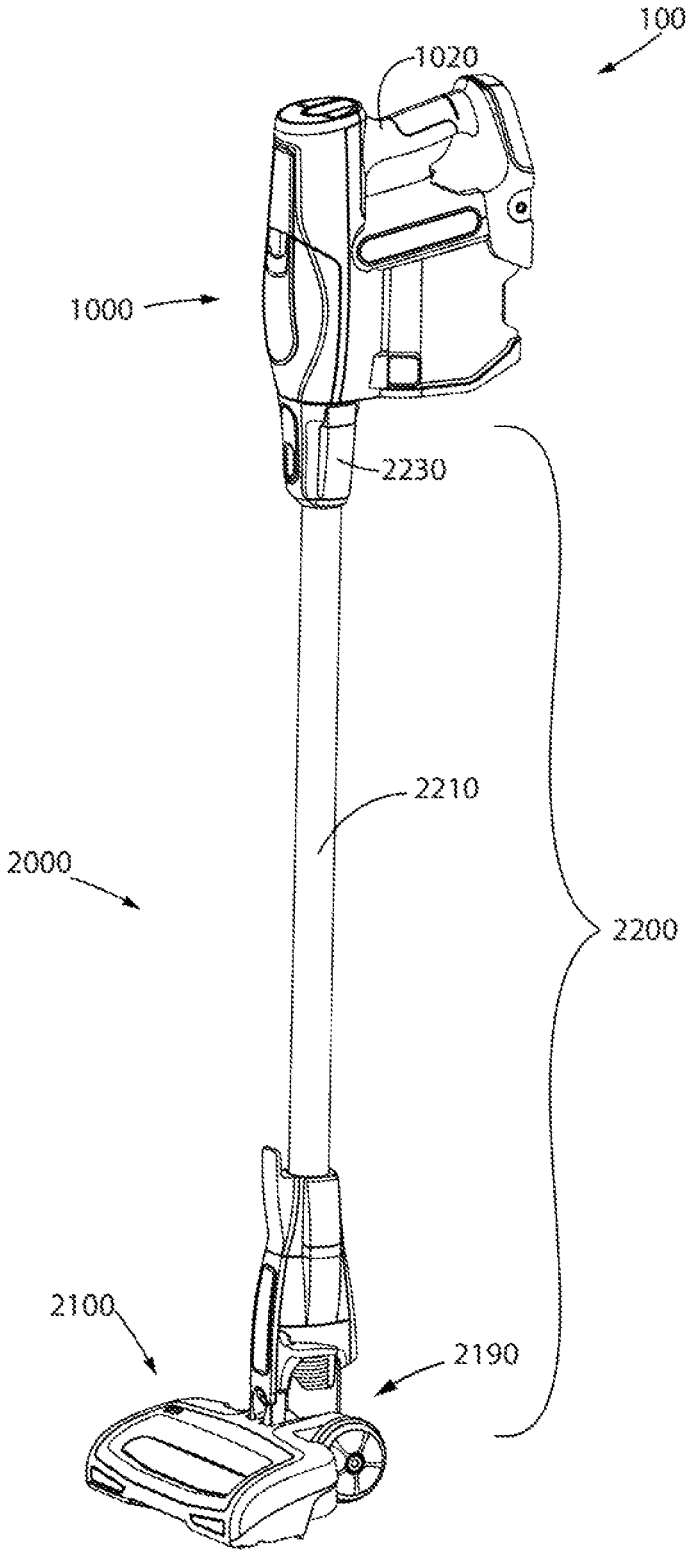
FIG. 1 is a perspective view of a reconfigurable surface cleaning apparatus in accordance with one embodiment, with a hand vacuum cleaner mounted to a floor cleaning unit, and with the floor cleaning unit positioned in an upright storage position.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Reconfigurable Surface Cleaning Apparatus

Referring to FIGS. 1 to 9, an example embodiment of a reconfigurable surface cleaning apparatus is shown generally as 100. In the illustrated embodiment, in a floor cleaning mode the reconfigurable surface cleaning apparatus 100 may be characterized as a type of upright vacuum cleaner referred to as a stick vacuum cleaner. Reconfigurable surface cleaning apparatus 100 includes a floor cleaning unit 2000, which comprises a surface cleaning head 2100 and an upper section 2200, and a portable cleaning unit, which may be a hand vacuum cleaner 1000 (also referred to as handvac or hand-carriable vacuum cleaner 1000) as exemplified in FIG. 6 or a lift away style unit as exemplified in FIG. 21.

Figure 2:
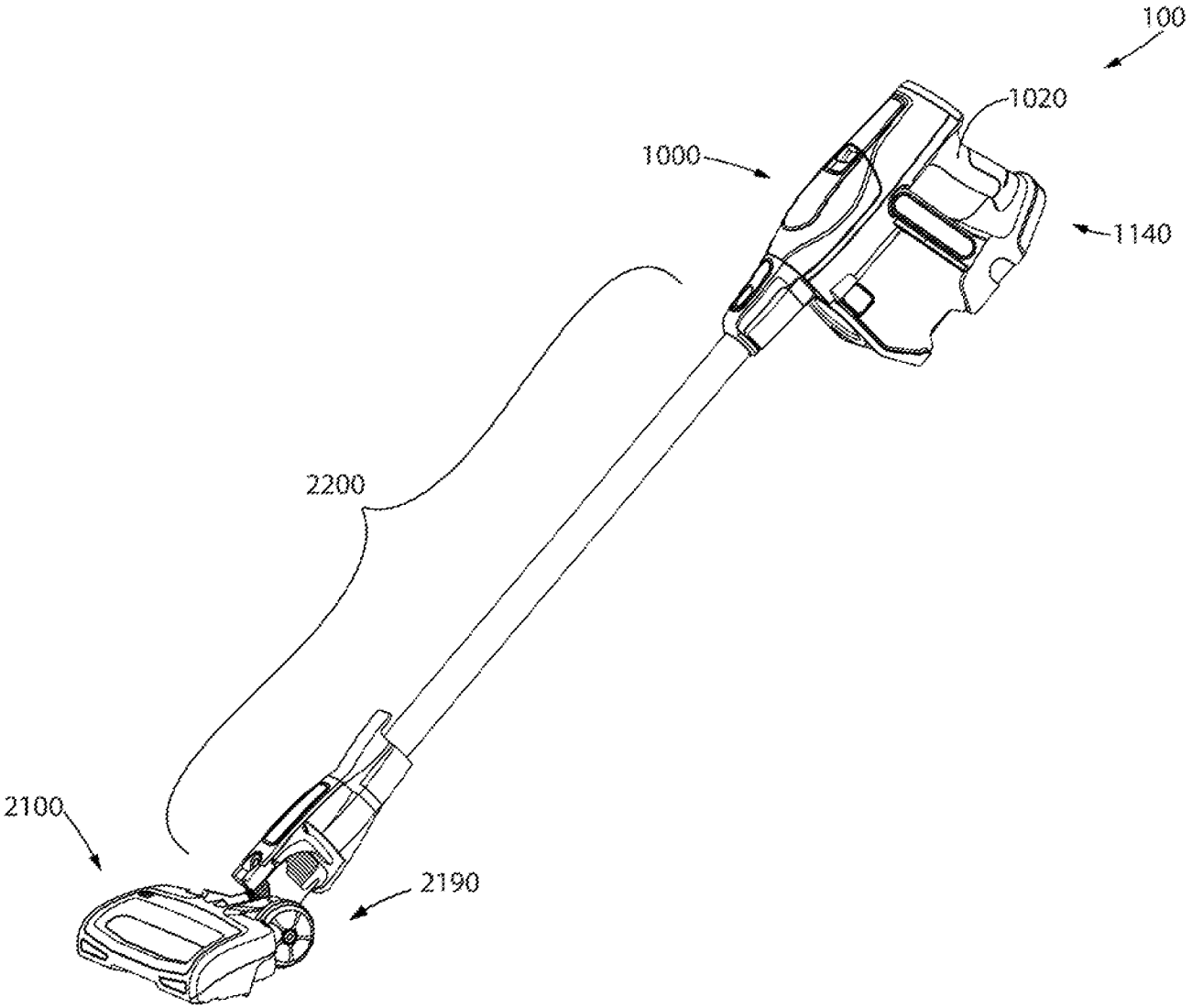
FIG. 2 is a perspective view of the reconfigurable surface cleaning apparatus of FIG. 1, with the floor cleaning unit positioned in an inclined floor cleaning position.

Upper section 2200 may be movably and drivingly connected to surface cleaning head 2100. For example, upper section 2200 may be permanently or removably connected to surface cleaning head 2100 and moveably mounted thereto for movement between a storage position (e.g. as shown in FIG. 1) and an inclined floor cleaning position (e.g. as shown in FIG. 2), such as by a pivotable joint 2190. Joint 2190 may permit upper section 2200 to pivot (i.e. rotate) at least rearwardly with respect to surface cleaning head 2100 about a horizontal axis. Upper section 2200 may also be steeringly connected to surface cleaning head 2100 for maneuvering surface cleaning head 2100. For example, joint 2190 may be a swivel joint.

Hand vacuum cleaner 1000 is removably connected to upper section 2200. When mounted to upper section 2200, a user may grasp the handle 1020 of hand vacuum cleaner 1000 to manipulate upper section 2200 to steer surface cleaning head 2100 across a surface to be cleaned. Accordingly, when hand vacuum cleaner 1000 is mounted to upper section 2200, handle 1020 is the drive handle of reconfigurable surface cleaning apparatus 100.

As exemplified, at least one suction motor, and preferably the only suction motor, and at least one air treatment member, which may be the only air treatment member, is provided in the hand vacuum cleaner to permit hand vacuum cleaner 1000 to operate independently when disconnected from the floor cleaning unit 2000. As exemplified, hand vacuum cleaner 1000 may be powered by an onboard energy source, such as a battery pack or other energy storage member such as a capacitor, such as an ultracapacitor.

The air treatment member may be any suitable air treatment member, including, for example, one or more cyclones, filters, and/or bags. Preferably, at least one air treatment member is provided upstream of the suction motor to clean the dirty air before the air passes through the suction motor. In the illustrated embodiment, hand vacuum cleaner 1000 includes a cyclone assembly including a cyclone chamber and a dirt collection region. In some embodiments, the dirt collection region may be a portion (e.g., a lower portion) of the cyclone chamber. In other embodiments, the dirt collection region may be a dirt collection chamber that is separated from the cyclone chamber by a dirt outlet of the cyclone chamber.

Figure 4:
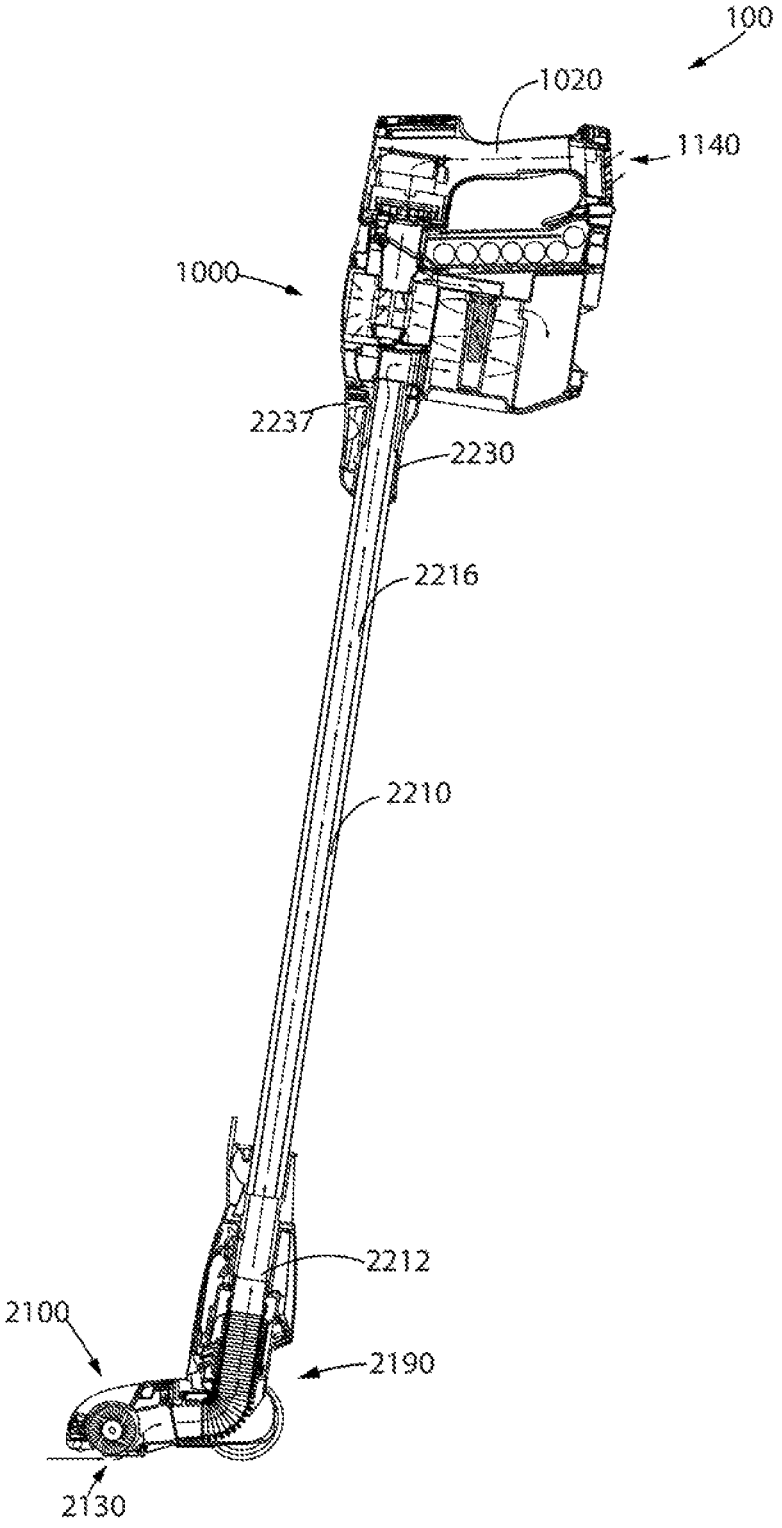
FIG. 4 is a cross-section view of the reconfigurable surface cleaning apparatus of FIG. 1.
Figure 6:
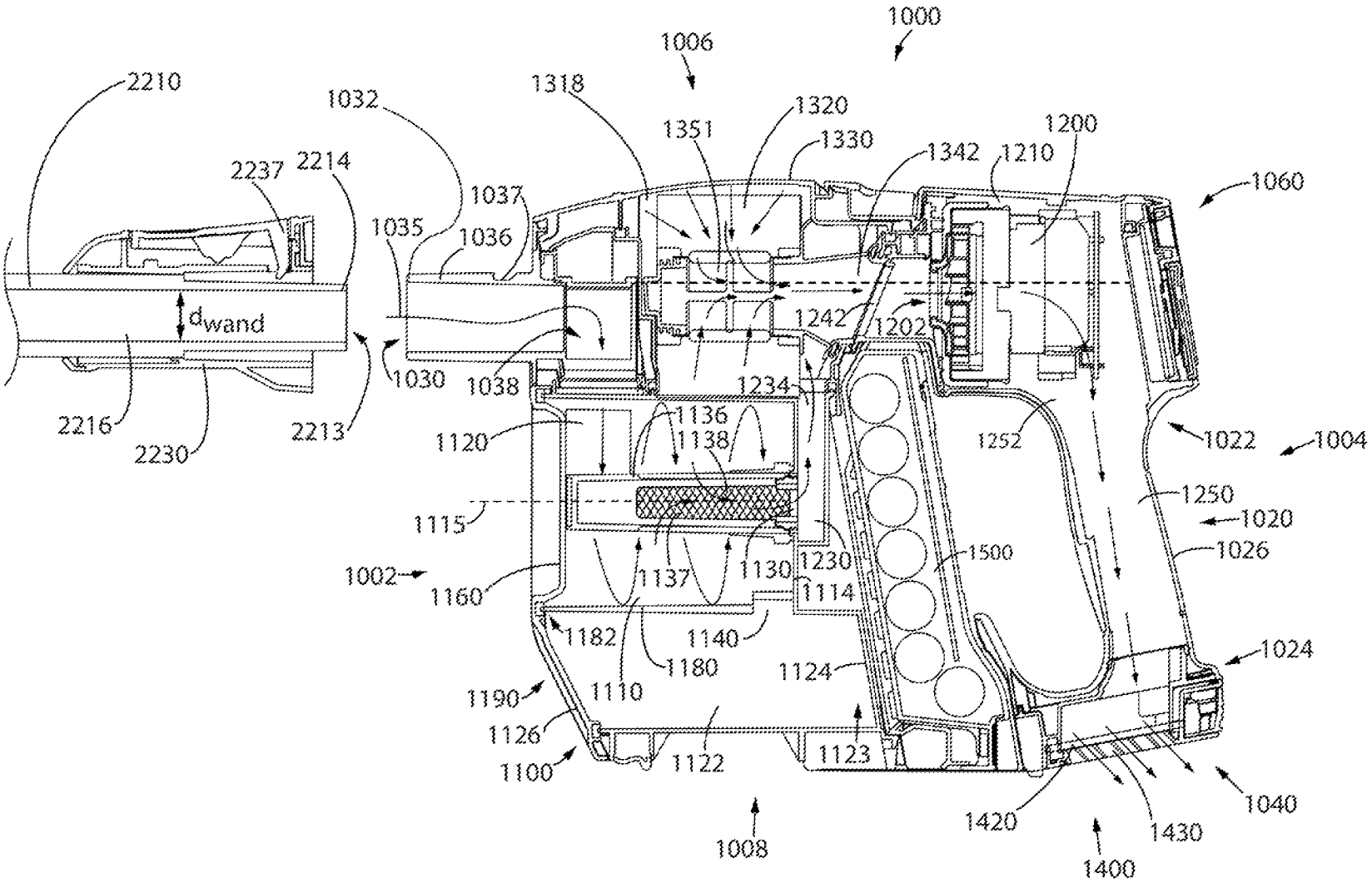
FIG. 6 is a cross-section view of the hand vacuum cleaner of the reconfigurable surface cleaning apparatus of FIG. 1, with the hand vacuum cleaner disconnected from the floor cleaning unit.
Figure 7:
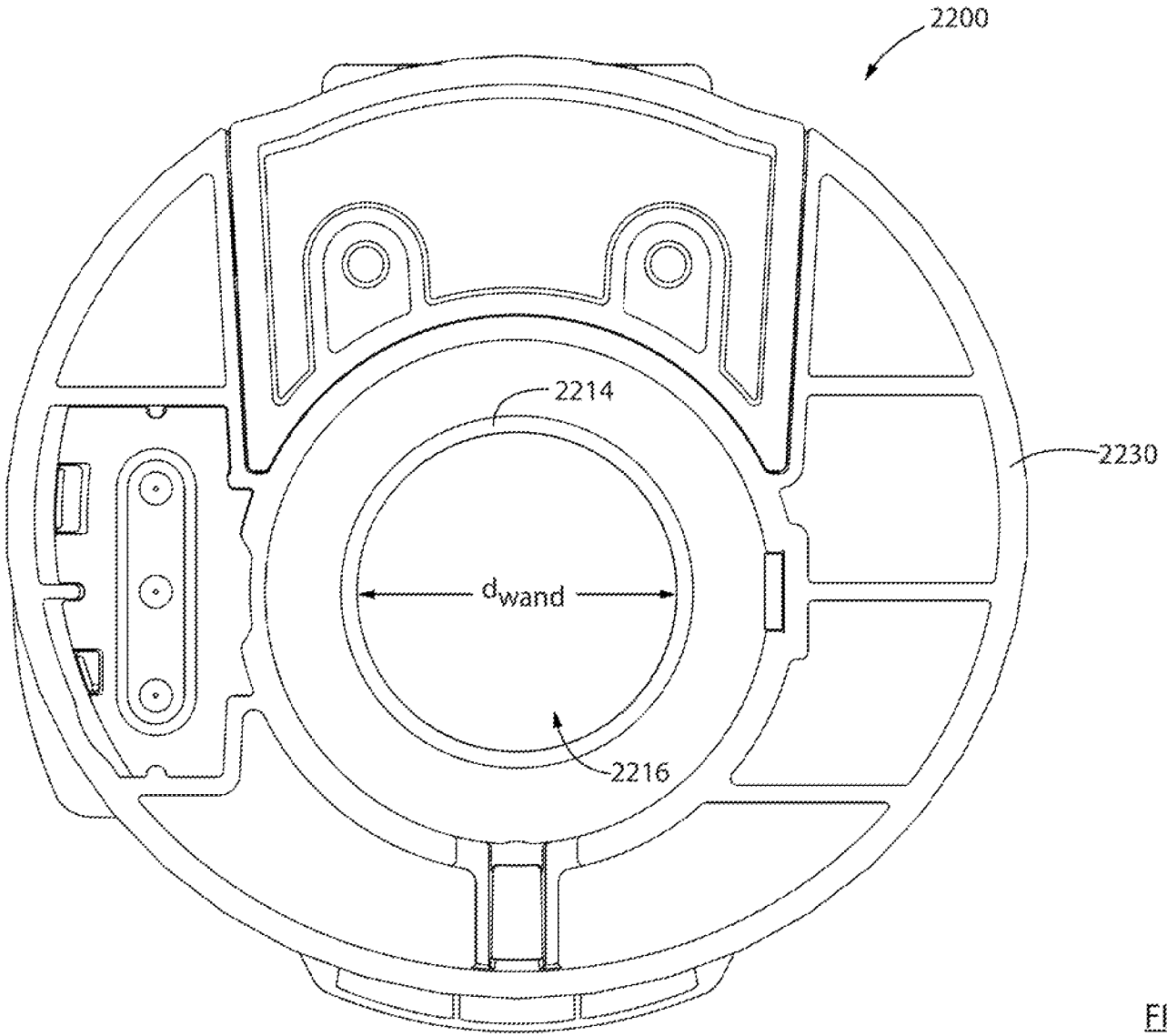
FIG. 7 is an end view of a rigid wand of the floor cleaning unit of FIG. 6, taken along line 7-7 in FIG. 3.
Figure 8:
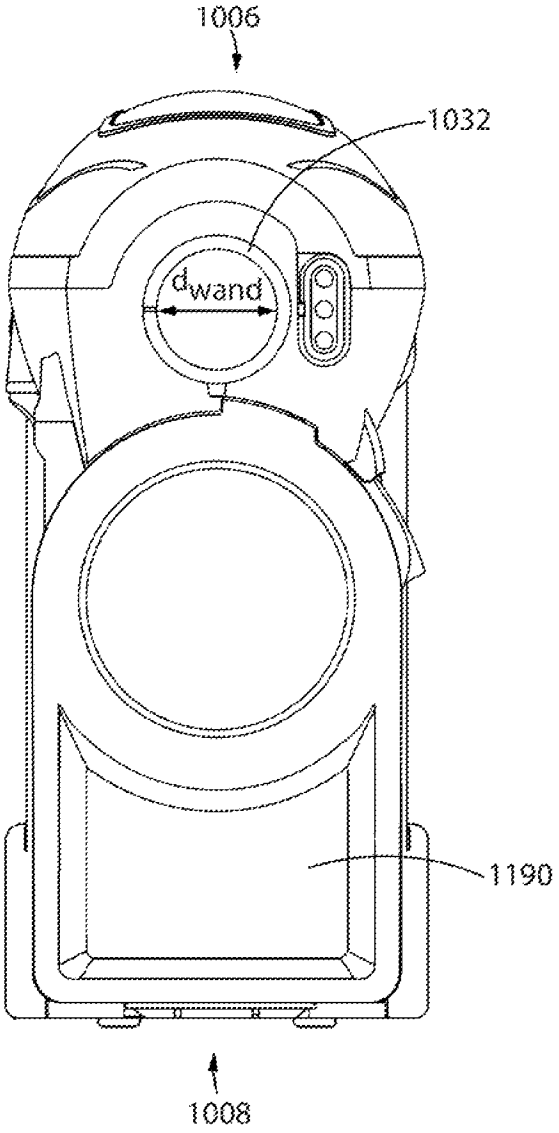
FIG. 8 is a front end view of the hand vacuum cleaner of FIG. 6, taken along line 8-8 in FIG. 3.

Reconfigurable surface cleaning apparatus 100 has at least one dirty air inlet, one clean air outlet, and an airflow path extending between the inlet and the outlet. Referring to FIG. 4, in a floor cleaning mode, a lower end 2102 of surface cleaning head 2100 includes a dirty air inlet 2130, and a rear end 1004 of hand vacuum cleaner 1000 includes a clean air outlet 1040. An airflow path extends from dirty air inlet 2130 through surface cleaning head 2100, upright section 2200, and hand vacuum cleaner 1000 to clean air outlet 1040. Referring to FIG. 6, in an above floor cleaning mode, hand vacuum 1000 includes a dirty air inlet 1030, and an airflow path extends from dirty air inlet 1030 through hand vacuum cleaner 1000 to clean air outlet 1040.

It will be appreciated that the floor cleaning unit may alternatively be of any configuration.

General Description of a Hand Vacuum Cleaner

Referring primarily to FIGS. 3, 6, 8, and 9, an exemplary embodiment of a hand vacuum cleaner is shown generally as 1000. In the illustrated embodiment, the hand vacuum cleaner (which may also be referred to as a "handvac" or "hand-held vacuum cleaner") can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g. a floor) during use. It will be appreciated that any portable cleaning unit may be used with aspects of this disclosure and that, if the portable cleaning unit is a hand vacuum cleaner, the hand vacuum cleaner may be of any configuration.

Figure 3:
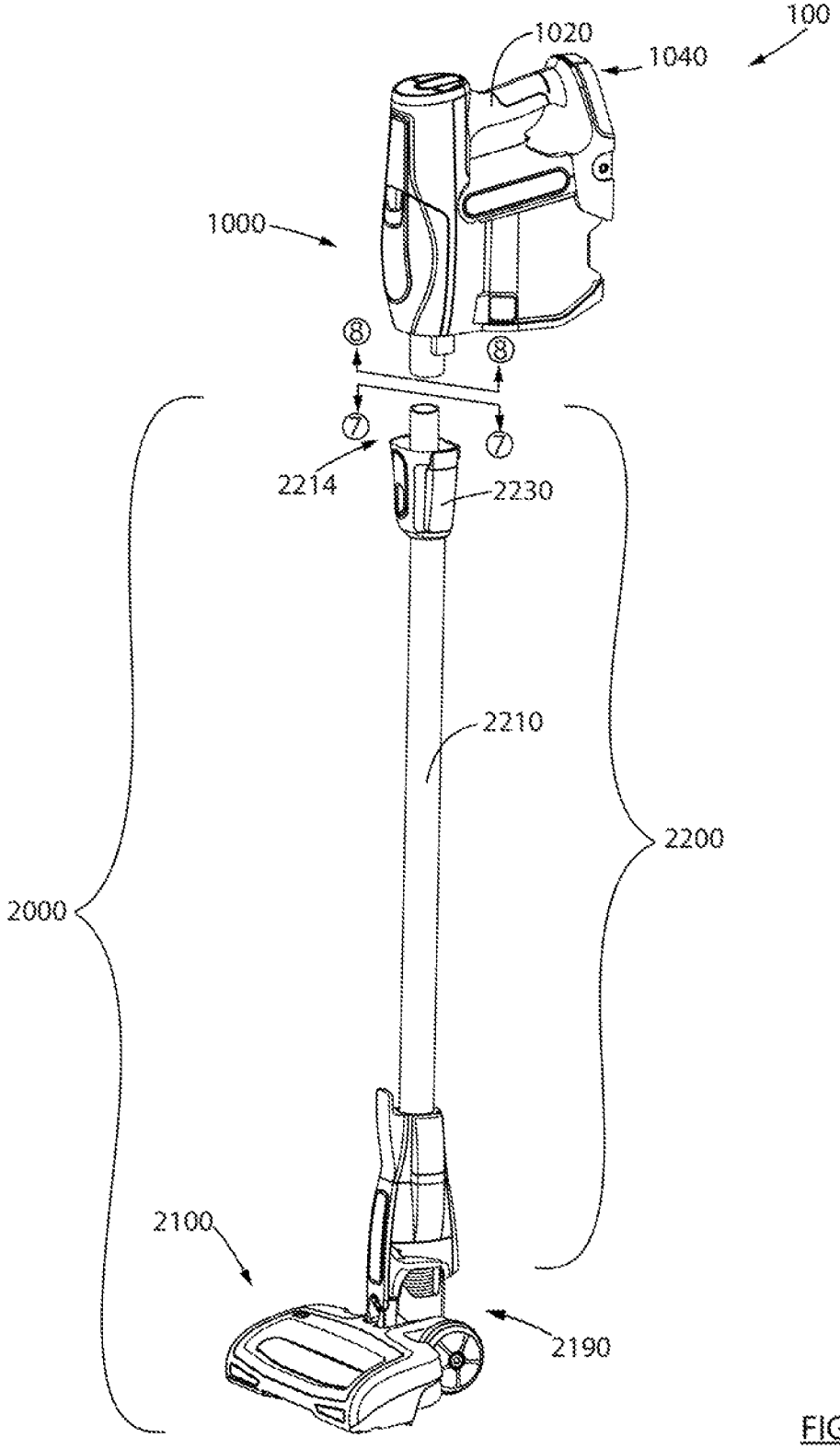
FIG. 3 is a perspective view of the reconfigurable surface cleaning apparatus of FIG. 1, with the hand vacuum cleaner disconnected from the floor cleaning unit.

As exemplified in FIGS. 3 and 6, surface cleaning apparatus 1000 includes a main body 1010 having a housing 1011 and a handle 1020, an air treatment member 1100 connected to the main body 1010, a dirty air inlet 1030, a clean air outlet 1040, and an air flow path extending between the dirty air inlet and the clean air outlet.

Surface cleaning apparatus 1000 has a front end 1002, a rear end 1004, an upper end or top 1006, and a lower end or bottom 1008. In the embodiment shown, dirty air inlet 1030 is at an upper portion of the front end 1102 and clean air outlet 1040 is at rearward portion of the lower end 1008. It will be appreciated that the dirty air inlet 1030 and the clean air outlet 1040 may be provided in different locations.

A suction motor 1200 (see e.g. FIG. 6) is provided to generate vacuum suction through the air flow path, and is positioned within a motor housing 1210. In the illustrated embodiment, the suction motor is positioned downstream from the air treatment member, although it may be positioned upstream of the air treatment member (e.g., a dirty air motor) in alternative embodiments.

Air treatment member 1100 is configured to remove particles of dirt and other debris from the air flow and/or otherwise treat the air flow. In the illustrated example, air treatment member 1100 includes a cyclone assembly having a single cyclonic cleaning stage with a single cyclone chamber 1110 and a dirt collection region 1122 external to the cyclone chamber. The cyclone chamber 1110 and dirt collection region 1122 may be of any configuration suitable for separating dirt from an air stream and collecting the separated dirt, respectively.

The cyclone chamber 1110 may be oriented in any direction. For example, when surface cleaning apparatus 1000 is oriented with the upper end 1106 above the lower end 1108, e.g. positioned generally parallel to a horizontal surface, a central axis or axis of rotation 1115 of the cyclone chamber 1110 may be oriented horizontally, as exemplified in FIG. 6. In alternative embodiments, the cyclone chamber may be oriented vertically, or at any angle between horizontal and vertical.

In alternative embodiments, the cyclone assembly may include two or more cyclonic cleaning stages arranged in series with each other. Each cyclonic cleaning stage may include one or more cyclone chambers (arranged in parallel or series with each other) and one or more dirt collection chambers, of any suitable configuration. The dirt collection chamber or chambers may be external to the cyclone chambers, or may be internal the cyclone chamber and configured as a dirt collection area or region within the cyclone chamber. Alternatively, the air treatment member need not include a cyclonic cleaning stage, and can incorporate a bag, a porous physical filter media (such as foam or felt), or other air treating means.

As exemplified in FIG. 6, hand vacuum cleaner 1000 may include a pre-motor filter housing 1310 provided in the air flow path downstream of the air treatment member 1100 and upstream of the suction motor 1200. Pre-motor filter housing 1310 may be of any suitable construction, including any of those exemplified herein. A pre-motor filter 1320 is positioned within the pre-motor filter housing 1310. Pre-motor filter 1320 may be formed from any suitable physical, porous filter media and having any suitable shape, including the examples disclosed herein with respect to a removable pre-motor filter assembly. For example, the pre-motor filter may be one or more of a foam filter, felt filter, HEPA filter, other physical filter media, electrostatic filter, and the like.

Optionally, the pre-motor filter housing 1310 may be openable, and at least a portion of the sidewall 1316 (e.g. removable or otherwise openable door 1330) and/or one of the end walls 1312 or 1314 may be removable, openable, or otherwise re-configurable to provide access to the interior of the pre-motor filter housing 1310.

As exemplified, hand vacuum cleaner 1000 may also include a post-motor filter 1420 provided in the air flow path downstream of the suction motor 1200 and upstream of the clean air outlet 1040. Post-motor filter 1420 may be formed from any suitable physical, porous filter media and having any suitable shape, including the examples disclosed herein. In alternative embodiments, the post-motor filter may be any suitable type of filter such as one or more of a foam filter, felt filter, HEPA filter, other physical filter media, electrostatic filter, and the like.

In the illustrated embodiment, the dirty air inlet 1030 of the hand vacuum cleaner 1000 is the inlet end 1032 of an inlet conduit 1036. Optionally, inlet end 1032 of the conduit 1036 can be used as a nozzle to directly clean a surface. The air inlet conduit 1036 is, in this example, a generally linear hollow member that extends along an inlet conduit axis 1035 that is oriented in a longitudinal forward/backward direction and is generally horizontal when hand vacuum cleaner 1000 is oriented with the upper end 1006 above the lower end 1008. Alternatively, or in addition to functioning as a nozzle, inlet conduit 1036 may be connected or directly connected to the downstream end of any suitable accessory tool such as a rigid air flow conduit (e.g., an above floor cleaning wand such as rigid wand 2210), a crevice tool, a mini brush, and the like. As shown, dirty air inlet 1030 is positioned forward of the air treatment member 1100, although this need not be the case. As exemplified, the dirty air inlet 1030 is positioned above the cyclone chamber. Optionally, the dirty air inlet 1030 may be provided at an alternative location, such as in the front end wall 1160.

As exemplified, power may be supplied to the suction motor and other electrical components of the hand vacuum cleaner from an onboard energy storage member which may include, for example, one or more batteries or other energy storage device. In the illustrated embodiment, the hand vacuum cleaner 1000 includes a removable battery pack 1500 provided between the handle 1020 and the air treatment member 1100. Battery pack 1500 may include any suitable number of cells 1510, and may include, for example, lithium ion battery cells. Any number of cells may be used to create a power source having a desired voltage and current, and any type of battery may be used, including NiMH, alkaline, and the like. Battery pack 1500 may be of any known design and may be electrically connected to the hand vacuum cleaner by any means known in the art. Optionally, the batteries and battery packs may be rechargeable or may be replaceable, non-rechargeable batteries. The on board energy storage member may alternatively not be removable and may be rechargeable in situ.

As exemplified, a power switch 1060 may be provided to selectively control the operation of the suction motor (e.g. either on/off or variable power levels or both), for example by establishing a power connection between the batteries and the suction motor. The power switch may be provided in any suitable configuration and location, including a button, rotary switch, sliding switch, trigger-type actuator and the like. As illustrated in FIG. 6, power switch 1060 is in the form of a button located toward upper end of the rear end 1004 of the hand vacuum cleaner, above a hand grip portion 1026 of the handle 1020. In this position, a user may be able to access the button 1060 while holding the hand vacuum via the hand grip, e.g. with the thumb of the hand holding the handle, and/or with a digit of their other hand.

The power switch or an alternative controller may also be configured to control other aspects of the hand vacuum (brush motor on/off, etc.). Optionally, instead of being provided at an upper end of the handle, the power switch may be provided on the main body (such as on the motor housing or other suitable location).

Air Flow Path Through a Hand Vacuum Cleaner

As exemplified, the air treatment member 1100 of the hand vacuum cleaner 1000 may optionally be a single cyclonic cleaning stage with unidirectional air flow or a 'uniflow' cyclone chamber 1110 (i.e. where the cyclone air inlet and cyclone air outlet are at opposite ends of the cyclone chamber). Referring primarily to FIG. 6, hand vacuum cleaner 1000 includes a single cyclonic cleaning stage with a cyclone chamber 1110 that has a cyclone air inlet 1120 in fluid communication with the inlet conduit 1036, a cyclone air outlet 1130, and a dirt outlet 1140 that is in communication with a dirt collection chamber 1122.

Optionally, the cyclone chamber 1110 may be generally horizontally oriented so that the cyclone air inlet 1120 is located toward the front end 1002 of the hand vacuum cleaner 1000, and the cyclone air outlet 1130 is spaced rearwardly behind the cyclone air inlet 1120, at a rear end 1114 of the cyclone chamber 1110. From the cyclone air outlet 1130, an upflow duct or conduit 1230 directs the airflow upwards to a pre-motor filter chamber 1318 that is vertically spaced from the cyclone chamber 1110. After passing through the pre-motor filter 1320, air may travel generally rearwardly from the pre-motor filter 1320 to an inlet end 1202 of the suction motor 1200. An advantage of this arrangement is that, by promoting air to travel in this manner, the need for air flow direction changes between an air outlet of the pre-motor filter and the suction motor may be reduced or eliminated, thereby reducing backpressure and/or air flow losses through this portion of the hand vacuum cleaner.

In the illustrated example, dirt collection chamber 1122 is positioned exterior to the cyclone chamber 1110 and is in communication with the dirt outlet 1140 to receive dirt and debris dis-entrained from a dirty air flow by the cyclone chamber 1110. In the illustrated example, the cyclone air inlet 1120 and dirt outlet 1140 are positioned toward opposing ends of the cyclone chamber 1110, and the cyclone air outlet 1130 is provided toward the same end as the dirt outlet 1140 (the rear end as illustrated). In this configuration, dirty air can enter at the front end of the cyclone chamber, while cleaner air and the separated dirt particles both exit the cyclone chamber at the opposing rear end.

In this embodiment, the cyclone chamber 1110 has a front end wall 1160 and an opposing rear end wall 1170 that is spaced apart from the front end wall along the cyclone axis 1115 about which air circulates within the cyclone chamber 1110 during operation of the hand vacuum cleaner. A cyclone chamber sidewall 1180 extends between the front and rear end walls 1160, 1170.

In this embodiment, the cyclone air inlet 1120 is a tangential air inlet that, as exemplified, terminates at an aperture or port that is formed in cyclone sidewall 1180, optionally an upper portion 1182 of the cyclone sidewall 1180, adjacent the front end wall 1160. Optionally, the cyclone air inlet 1120 may be provided at an alternative location, such as in the front end wall 1160.

The cyclone air inlet 1120 is fluidly connected with the outlet end of the conduit 1036 via a corresponding air outlet aperture or port 1038 that may be provided in a lower portion of the air inlet conduit 1036. The cyclone air inlet 1120 may have any suitable arrangement and/or configuration, and in the illustrated example is configured as a tangential air inlet that is directly connected to the air outlet aperture 1038. Connecting the air inlet 1120 to the air outlet aperture 1038 in this manner may help reduce the need for additional conduits to fluidly connect the dirty air inlet 1030 to the cyclone chamber 1110, and may reduce or eliminate the need for additional bends or air flow direction changes between the dirty air inlet 1030 and the cyclone chamber 1110. Reducing the conduit length and number of bends may help reduce the backpressure and air flow losses within the air flow path.

In the illustrated example, cyclone air inlet 1120 is directly adjacent the front wall 1160. Alternatively, cyclone air inlet 1120 may be axially spaced from the front end wall 1160, and may be located at another location along the length of the cyclone chamber 1110. Preferably, cyclone air inlet 1120 is provided in the front half of the cyclone chamber 1110 (i.e. forward of the axial mid-point of the cyclone chamber sidewall 1080) in order to help reduce the distance between the dirty air inlet 1030 and the cyclone air inlet 1120.

As shown in FIG. 6, the cyclone air outlet 1130 is provided in the rear end wall 1170 of the cyclone chamber 1110, and an axially extending vortex finder conduit 1136 extends from the rear end wall 1170 and is aligned with the cyclone air outlet 1130. Optionally, a mesh screen 1137 may be positioned over some or all of the inlet apertures 1138 of the vortex finder conduit 1136 to help inhibit lint, hair, and other such debris from entering the vortex finder conduit 1136. Positioning the air outlet 1130 toward the rear end (and optionally in the rear end wall 1170) may help facilitate the desired air flow through the cyclone chamber 1110, such that air, while swirling, travels generally axially though the cyclone chamber 1110 from the front end wall 1160 toward the rear end wall 1170.

Positioning the air outlet 1130 in the rear end wall 1170 of the cyclone chamber 1110 may also help facilitate the air flow connection between the cyclone chamber 1110 and other downstream components in the hand vacuum, such as the pre-motor filter housing 1310 and suction motor housing 1210 described herein. In the illustrated embodiment the air outlet 1130 is provided in the rear end wall 1170 and is connected to the pre-motor filter housing 1310 through an upflow duct or conduit 1230. This may help simplify the air flow path and construction of the hand vacuum. Alternatively, the air flow path may include one or more additional conduits connected downstream from the cyclone air outlet. Alternatively, the pre-motor filter may be located rearward of the air outlet 1130, and axially aligned with the cyclone axis.

The cyclone dirt outlet 1140 may be of any suitable configuration, and in the illustrated embodiment is a slot 1140 that is provided in the cyclone chamber side wall 1180, toward the rear end wall 1170. The slot 1140 may extend around at least a portion of the perimeter of the cyclone side wall 1180, and may have any suitable length 1186 in the axial direction (see e.g. FIG. 6). As exemplified, the slot may be provided only in a lower portion of the sidewall. Accordingly, when dirty air inlet 1030 faces downwardly during use, dirt will exit into an upper end of an external dirt collection chamber. Positioning the dirt collection chamber below the cyclone chamber, and not surrounding the cyclone chamber, reduces the width of the hand vacuum. While shown directly adjacent the rear end wall 1170, such that the slot 1140 is partially bounded by the cyclone side wall 1180 and the rear end wall 1170, the slot 1140 may be located at another location along the length of the cyclone side wall 1180, and need not be directly adjacent the rear end wall 1170. Alternatively, the dirt outlet 1140 may be provided toward the mid-point of the cyclone chamber sidewall 1180, or may be provided toward the front end wall 1160. While illustrated with a single dirt outlet 1140, the cyclone chamber 1110 may include two or more dirt outlets that are in communication with the same dirt collection chamber, or optionally with different dirt collection chambers.

Preferably, at least a portion of the air treatment member may be openable for emptying. For example, at least one end, and optionally both ends of the dirt collection chamber 1122 may be openable for emptying. Optionally, at least one end, and optionally both ends of the cyclone chamber 1110 may also be openable for emptying.

Figure 9:
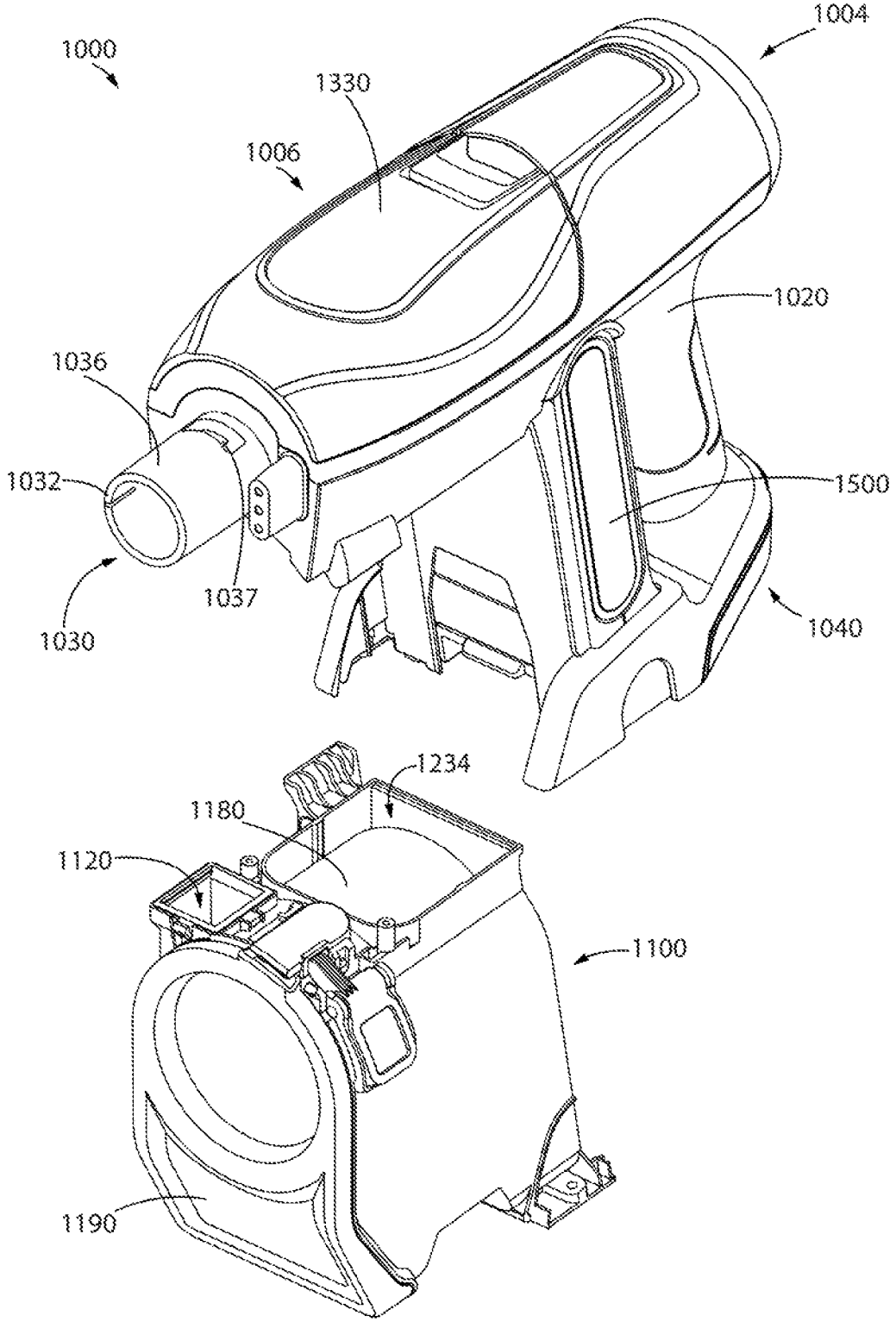
FIG. 9 is partially exploded perspective view of the hand vacuum cleaner of FIG. 6.

Referring primarily to FIGS. 6 and 9, the front end wall 1160 of the cyclone chamber 1110 and the front end wall 1126 of the dirt collection chamber 1122 are both provided by portions of an openable front door 1190 that covers the front end of the cyclone assembly. In this arrangement, opening the front door 1190 will concurrently open the front end walls 1160 and 1126 of the cyclone and dirt collection chambers 1110, 1122. In the illustrated example, a user may hold the hand vacuum 1000 via the handle 1020 with one hand and open the front door 1190 with the other hand. The front end wall 1160 of the cyclone chamber 1110 and the front end wall 1126 of the dirt collection chamber 1122 may be concurrently openable and may cover all of a substantial portion of the front end of the cyclone chamber and the dirt collection chamber. For example, the front end wall 1160 of the cyclone chamber 1110 and the front end wall 1126 of the dirt collection chamber 1122 may be a one piece assembly (i.e. they may be integrally formed).

The front door 1190 may be openably connected (e.g., pivotally openable or removably mounted) to the rest of the cyclone assembly using any suitable mechanism, including a hinge or other suitable device. Optionally, the front door 1190 may be secured in the closed position using any suitable type of locking mechanism, including a latch mechanism that may be released by a user.

In the embodiments described herein, the surface cleaning apparatus includes a pre-motor filter housing 1310 positioned in the air flow path between the cyclone chamber and the suction motor. It will be appreciated that in some embodiments, the pre-motor filter may be of any configuration and the direction of air flow through the pre-motor filter 1320 may be any particular direction.

Referring primarily to FIG. 6, as exemplified, in some embodiments, the main body 1010 may be configured such that the suction motor housing 1210 is located rearward of the pre-motor filter housing 1310 and, preferably, axially aligned with the pre-motor filter housing 1310 such that air exiting the pre-motor filter may travel generally linearly to the suction motor. It will be appreciated that suction motor housing 1210 and pre-motor filter housing 1310 may be of any configuration. It will be appreciated that, if the pre-motor filter is located rearward of the air outlet 1130, and axially aligned with the cyclone axis, then the suction motor may be located rearward of the pre-motor filter and also axially aligned with the cyclone axis.

As exemplified herein, the pre-motor filter 1320 may be configured as a generally cylindrical foam filter with a hollow, open interior, and is optionally part of a removable pre-motor filter assembly. The pre-motor filter 1320, which may be a foam filter, extends longitudinally along a filter axis 1325, which may be generally parallel with the suction motor axis of rotation and accordingly is exemplified as being generally horizontal in the illustrated embodiment. The interior, downstream surface of filter 1320 is in communication with the air outlet 1242 via an outlet conduit 1340 of the pre-motor filter assembly. An advantage of a cylindrical filter is that a relatively large upstream surface area may be provided in a small space.

Referring to FIG. 6, in the illustrated example the pre-motor filter housing 1310 has forward and rear end walls 1312 and 1314, and a chamber sidewall 1316 defining a pre-motor filter chamber or plenum 1318. Optionally, the pre-motor filter is removable, such as proving a removable or otherwise openable door 1330. The housing 1310 also has an air inlet 1234 that is connected downstream from the cyclone air outlet 1130 via upflow duct 1230, and an air outlet 1242 positioned in the rear end wall 1314. To travel from the air inlet 1234 to the air outlet 1242, air passes through the pre-motor filter 1320 positioned within the chamber 1318.

In the illustrated example, the suction motor 1200 is generally horizontally oriented, such that the suction motor axis of rotation 1205 is generally horizontal (e.g., ±20°, ±15°, ±10°, or ±5° from horizontal) when the hand vacuum cleaner is positioned with the upper end above the lower end (as illustrated in FIG. 6). In this arrangement, the suction motor axis 1205 is generally parallel to the cyclone axis 1115 and the pre-motor filter axis 1325.

Positioning the suction motor at an upper end of a handle of the vacuum cleaner with the suction motor axis vertically displaced from the cyclone axis of rotation may help provide a compact overall design of the hand vacuum cleaner without adversely affecting the hand feel and/or perceived balance of the hand vacuum.

It will be appreciated that the air may exit the hand vacuum cleaner via a grill located in an upper portion of the main body (e.g., via an air outlet provided in the rear end of the main body or a sidewall adjacent the rear end). Alternatively, air may exit through a lower portion of the main body. This may be achieved by conveying the air downwardly through the handle of the hand vacuum cleaner. Accordingly, as exemplified, at least a portion of the air flow path between the dirty air inlet 1030 and the clean air outlet 1040 may flow through the handle 1020. This may help facilitate a variety of different air flow path configurations and clean air outlet 1040 locations. In the illustrated embodiment, a handle air flow passage 1250 has an inlet end 1252 that is located toward the top 1022 of the handle downstream from the suction motor 1200, and an outlet end 1254 that is located toward the bottom 1024 of the handle. This may help channel the air through substantially the entire length of the hand grip portion 1026 of the handle 1020.

As exemplified, the air exhausted from the suction motor 1200 is routed through the handle, and the clean air outlet 1040 is provided in the form of a plurality of slots 1430 that are formed in the lower end 1024 of the handle. Air entering the inlet end 1252 is directed through the handle 1020 and exits via the slots 1430. In this example, the slots or grill 1430 are oriented such that air exiting the clear air outlet 1040 travels generally downwardly and rearwardly from the lower end 1024 of the handle 1020. It will be appreciated that the clean air outlet may be of any design and may be located anywhere in the lower portion of the hand vacuum cleaner.

Optionally, one or more post-motor filters may be placed in the air flow path between the suction motor 1200 and the clean air outlet 1040. The post-motor filter may be provided at the clean air outlet 1040. The post motor filter may be in an openable housing. The illustrated post-motor filter 1420 is a physical foam media filter, but optionally the post-motor filters may be any suitable type of filter and may include one or more of foam filters, felt filters, HEPA filters, other physical filter media, electrostatic filters, and the like.

Air Flow Paths Through a Reconfigurable Surface Cleaning Apparatus

In accordance with an aspect of this disclosure, a reconfigurable surface cleaning apparatus has an air flow path upstream of the air treatment member that is reconfigurable to provide a higher velocity of air flow in a floor cleaning mode as compared to an above floor cleaning mode, in the absence of changing the suction power provided by the suction motor. The air flow path may be reconfigured by inserting an upstream conduit into a downstream conduit to provide a narrower air flow path in the floor cleaning mode. Alternatively, the upstream air flow path may be expandable to have different size cross-sectional flow areas. Alternatively, different air flow paths may be provided for the different cleaning modes. It will be appreciated that, optionally, a surface cleaning apparatus may use a different power mode for a surface cleaning apparatus in the above floor cleaning mode as compared to the floor cleaning mode.

Stick Vac with an Upflow Duct Receivable in the Handvac Air Inlet

In accordance with this embodiment, a hand vacuum cleaner 1000 has an inlet which removably receives therein the outlet end of rigid wand 2210. As discussed subsequently, the outlet or downstream end 2214 of rigid wand 2210 has a smaller diameter than the inlet passage of hand vacuum cleaner 1000 and may extend to the inlet of the air treatment member (e.g., a cyclone inlet) of hand vacuum cleaner 1000, thereby providing a narrower inlet conduit when hand vacuum cleaner 1000 is mounted to floor cleaning unit 2000.

As exemplified in FIGS. 1, 2, 4, and 5, reconfigurable surface cleaning apparatus is illustrated in a floor cleaning mode, wherein the hand vacuum cleaner 1000 is mounted to the floor cleaning unit 2000 and operated using the energy storage member 1500.

As exemplified in FIG. 4, in a floor cleaning mode, when the suction motor of the hand vacuum is operated, air is drawn in through the dirty air inlet 2130 and through the body of the surface cleaning head 2100. Air then enters an upstream end 2212 of an upflow duct (which in the illustrated example is a rigid wand 2210), flows through the wand 2210, exits the downstream end 2214 of wand 2210, and enters the hand vacuum cleaner 1000. In hand vacuum cleaner 1000, the air is directed through the air treatment member, and to clean air outlet 1040.

Figure 5:
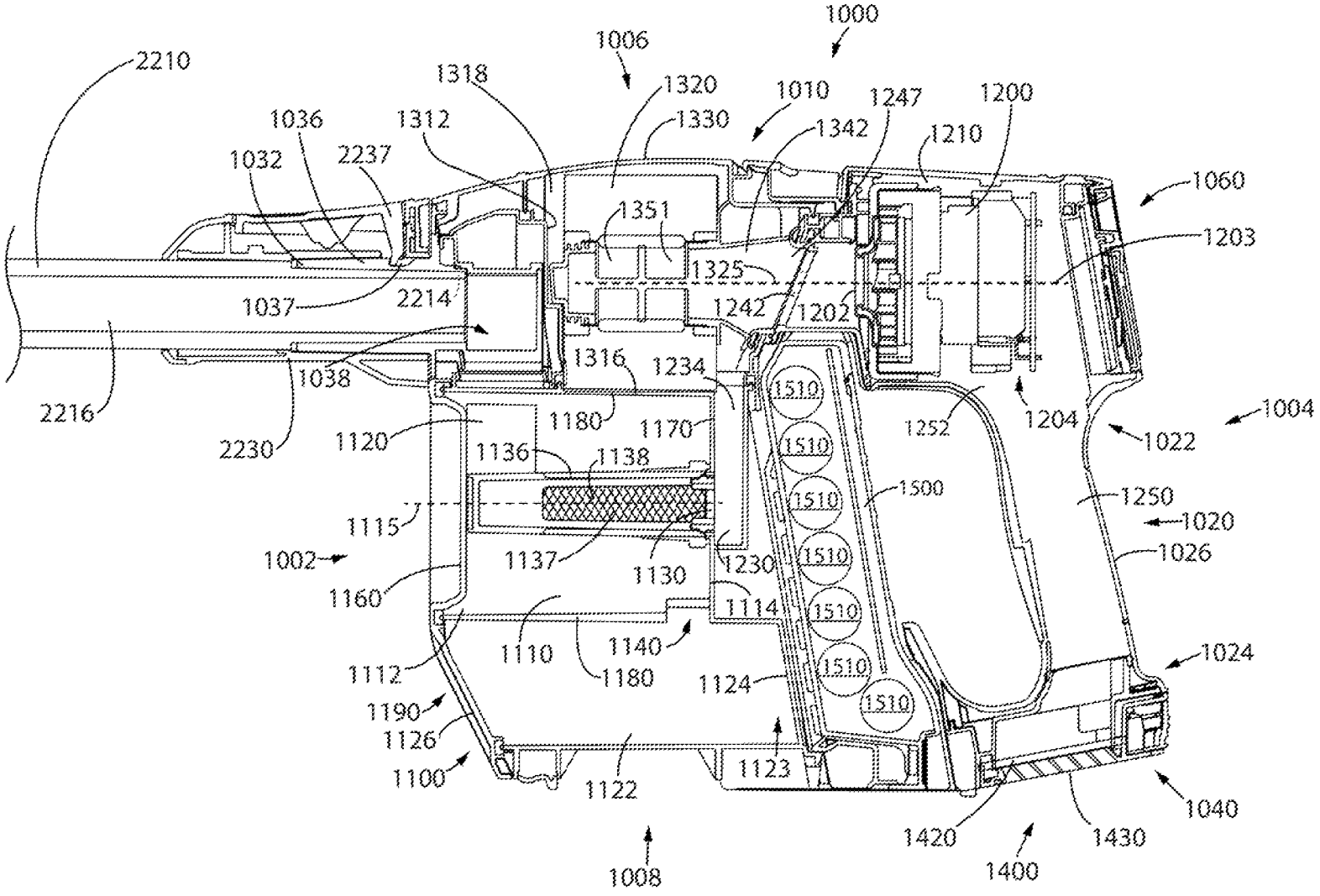
FIG. 5 is a cross-section view of the hand vacuum cleaner of the reconfigurable surface cleaning apparatus of FIG. 1, with the hand vacuum cleaner mounted to the floor cleaning unit.

Referring to FIGS. 5 and 6, when the hand vacuum cleaner 1000 is mounted to the floor cleaning unit 2200, a downstream end 2214 of rigid wand 2210 is inserted in the dirty air inlet 1030 and positioned in air inlet conduit 1036 of hand vacuum cleaner 1000. In the illustrated example, a collar 2230 is provided proximate the downstream end 2214 of rigid wand 2210. The collar 2230 includes a latch member 2237 for releasably securing the wand 2210 to the hand vacuum cleaner 1000. More specifically, latch member 2237 is configured to engage a corresponding recess 1037 provided on an exterior of air inlet conduit 1036. Latch 2237 is preferably user operable for selectively releasing downstream end 2214 of rigid wand 2210 from hand vacuum cleaner 1000.

As exemplified in FIG. 5, when inserted into the hand vacuum cleaner 1000, the end 2214 of wand 2210 extends along the entire length of the air inlet conduit 1036 to the location at which air exits the air inlet conduit 1036 and enter the treatment chamber of hand vacuum cleaner 1000 (in the exemplified embodiment, the cyclone chamber 1100). Accordingly, as exemplified, the end 2214 of wand 2210 extends inwardly to a position at which is abuts the air outlet aperture or port 1038 provided in a lower portion of the air inlet conduit 1036, thereby forming an air flow path between an air outlet 2213 of wand 2210 and the cyclone air inlet 1120. Optionally, one or more sealing members (not shown) may be provided at the interface between air outlet 2213 and cyclone air inlet 1120 for enhancing the airtightness of the connection.

In this configuration, as illustrated in FIG. 5, the air flow path through the floor cleaning unit 2000 includes the interior 2216 of wand 2120, which may be referred to as the flow area of the wand. This flow area may have a cross-sectional area in a plane transverse to a direction of air flowing through the wand. For example, interior 2216 of wand 2120 may have a generally cylindrical shape with a diameter $d_{wand}$ (see e.g. FIG. 7). Thus, the cross-sectional area may be calculated as $$Area_{wand} = \pi\left(\frac{d_{wand}}{2}\right)^2.$$

It will be appreciated that the flow area through wand 2120 may have any suitable shape, e.g. oval, quadrilateral, etc.

Referring to FIGS. 3 and 6, reconfigurable surface cleaning apparatus is illustrated in an above floor cleaning mode. In this mode, the hand vacuum cleaner 1000 is disconnected from the floor cleaning unit 2000 and operated using the energy storage member 1500.

As exemplified in FIG. 6, in an above floor cleaning mode, when the suction motor of the hand vacuum is operated, air is drawn into the dirty air inlet 1030 of the hand vacuum cleaner 1000 (which, in the illustrated example, is the inlet end 1032 of an inlet conduit 1036) and through air inlet conduit 1036 to air outlet aperture 1038, thereby forming an air flow path between dirty air inlet 1030 and the cyclone air inlet 1120. Thus, air inlet conduit 1036 may be characterized as an upstream portion of an air flow path through the hand vacuum cleaner 1000 when the hand vacuum cleaner 1000 is used in an above floor cleaning mode.

In this configuration, as illustrated in FIG. 6, this upstream portion of the air flow path through the hand vacuum cleaner 1000 includes the interior of inlet conduit 1036, which may be referred to as the flow area of this upstream portion. This flow area may have a cross-sectional area in a plane transverse to a direction of air flowing through the wand. For example, inlet conduit 1036 may have a generally cylindrical shape with a diameter $d_{inlet}$ (see e.g. FIG. 8). Thus, the cross-sectional area may be calculated as $$Area_{inlet} = \pi\left(\frac{d_{inlet}}{2}\right)^2.$$

It will be appreciated that the flow area through inlet conduit 1036 may have any suitable shape, e.g. oval, quadrilateral, etc.

Accordingly, as exemplified, the entire air flow path of the hand vacuum cleaner upstream of the air inlet to the air treatment member chamber may be adjusted depending upon the mode of operation. In the floor cleaning mode, the downstream end 2214 of wand 2210 is inserted into the dirty air inlet 1030 of hand vacuum cleaner 1000, and the cross-sectional area of the air flow path along the length of the inlet conduit 1036 is the cross-sectional area of the interior path 2216 of rigid wand 2210, which is less than the cross-sectional area of an upstream portion of the air flow path through the hand vacuum cleaner 1000 (e.g. the area of inlet conduit 1036). For example, the cross-sectional area of this upstream portion may be at least 5%, at least 10%, at least 15%, at least 20%, at least 25% or more than the cross-sectional area of the flow area of the interior path 2216 of the rigid wand 2210.

An advantage of such a configuration is that, without adjusting the operation of suction motor 1200, the velocity of air travelling through the rigid wand in the floor cleaning mode may be greater than the velocity of air travelling through the inlet conduit 1036 in the above floor cleaning mode. This may provide greater 'lifting power' in the floor cleaning mode automatically as a consequence of reconfiguring the surface cleaning apparatus 100 from the above floor cleaning mode to the floor cleaning mode, without e.g. changing the power level at which the suction motor is operated.

In some embodiments, the suction motor 1200 of hand vacuum cleaner 1000 may be operated by the energy storage member at different power levels in the floor cleaning and above floor cleaning modes. For example, the suction motor may be operated at a first power level in the floor cleaning mode and at a second, higher power level in the above floor cleaning mode. Operating the suction motor at different power levels may have one or more advantages. For example, operating the suction motor at a higher power level may improve the 'lifting power' of the hand vacuum cleaner 1000 in the above floor cleaning mode—as the 'lifting power' may otherwise be lower due to the larger cross-sectional area of the flow area through inlet conduit 1036 (i.e. $Area_{inlet})_1$ and the lower velocity of air through this flow area which may result. Accordingly, the hand vacuum cleaner 1000 may have a switch that may be set to a high power mode when additional lifting power is required in an above floor cleaning mode.

In some embodiments, the cross-sectional area of the flow area through inlet conduit 1036 (i.e. $Area_{inlet}$) 1 may be approximately equal to a cross-sectional area of all or a portion of the air flow path through hand vacuum cleaner 1000 that is downstream of the air treatment member(s), e.g. downstream of one or more cyclonic cleaning stages, and/or downstream of one or more pre-motor filters. For example, the cross-sectional area of air outlet 1242 of the pre-motor filter housing 1310 (e.g. immediately upstream of the inlet end 1202 of suction motor 1200) may be approximately equal to $Area_{inlet}$. Such a configuration may have one or more advantages. For example, this may reduce backpressure and/or otherwise improve the efficiency of airflow through the reconfigurable surface cleaning apparatus in the floor cleaning mode.

In some embodiments, the cross-sectional area of the flow area through the upstream portion of the air flow path through the hand vacuum cleaner 1000 (i.e. $Area_{inlet})_1$ may be approximately equal to a cross-sectional area of a portion of the air flow path through hand vacuum cleaner 1000 that is the portion of the air flow path downstream of the air treatment member(s), e.g. downstream of one or more cyclonic cleaning stages, or the portion of the air flow path downstream of one or more pre-motor filters. For example, the cross-sectional area of air outlet 1242 of the pre-motor filter housing 1310 may be approximately equal to $Area_{inlet}$. Such a configuration may have one or more advantages. For example, this may reduce the back pressure and/or otherwise improve the efficiency of airflow through the reconfigurable surface cleaning apparatus in the above floor cleaning mode. By reducing the back pressure through the hand vacuum cleaner downstream of the air treatment member(s), the power required to operate the hand vacuum cleaner 1000 may be reduced thereby enabling the hand vacuum cleaner 1000 to have a longer run time between recharges and/or reducing the number of onboard energy storage members, which may reduce the weight and size of the hand vacuum cleaner 1000.

Stick Vac with a Handvac Having Alternative Air Inlets

FIGS. 10 to 14 exemplify another example embodiment of a reconfigurable surface cleaning apparatus wherein the air flow path upstream of the air treatment member of the hand vacuum cleaner in the above floor cleaning mode has a larger cross sectional area. In this embodiment, an auxiliary air inlet 1730 is provided for use in the above floor cleaning mode. The auxiliary air inlet 1730 may be located at various locations on hand vacuum cleaner 1000, and may be isolated from air flow through inlet conduit 1036 when auxiliary air inlet 1730 is not in use (e.g., in the floor cleaning mode).

It will be appreciated that each of the auxiliary air inlet 1730 and the inlet conduit 1036 may be selective connected in flow communication with the air treatment member, such as by a valve which rotates or moves between a first position in which the inlet conduit 1036 is in air flow communication with inlet 1120 and a second position in which the auxiliary air inlet 1730 is in air flow communication with inlet 1120. Alternately, as exemplified in FIGS. 10-14, a plug 1735 may seal auxiliary air inlet 1730 in the floor cleaning mode and the insertion of a hose 1600 may isolate inlet 1120 from the inlet conduit 1036.

Figure 10:
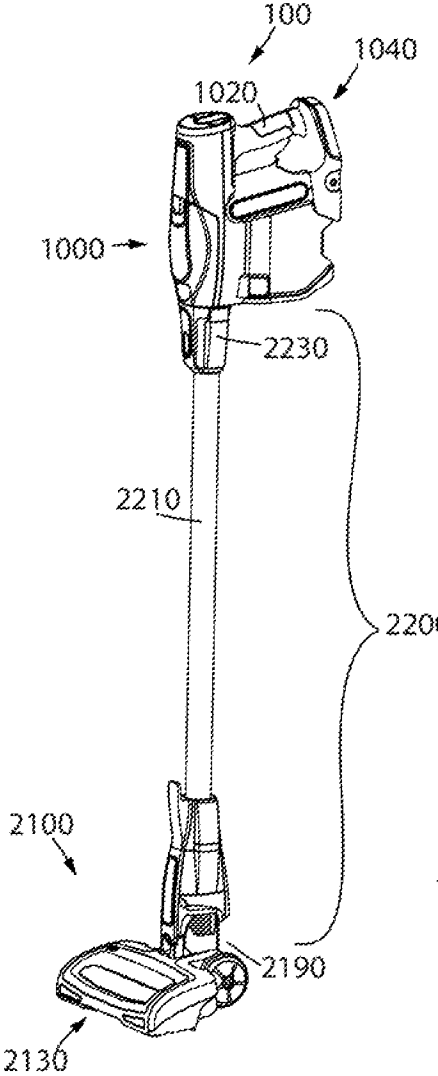
FIG. 10 is a perspective view of a reconfigurable surface cleaning apparatus in accordance with another embodiment, with a hand vacuum cleaner mounted to a floor cleaning unit, and with the floor cleaning unit positioned in an upright storage position.
Figure 13:
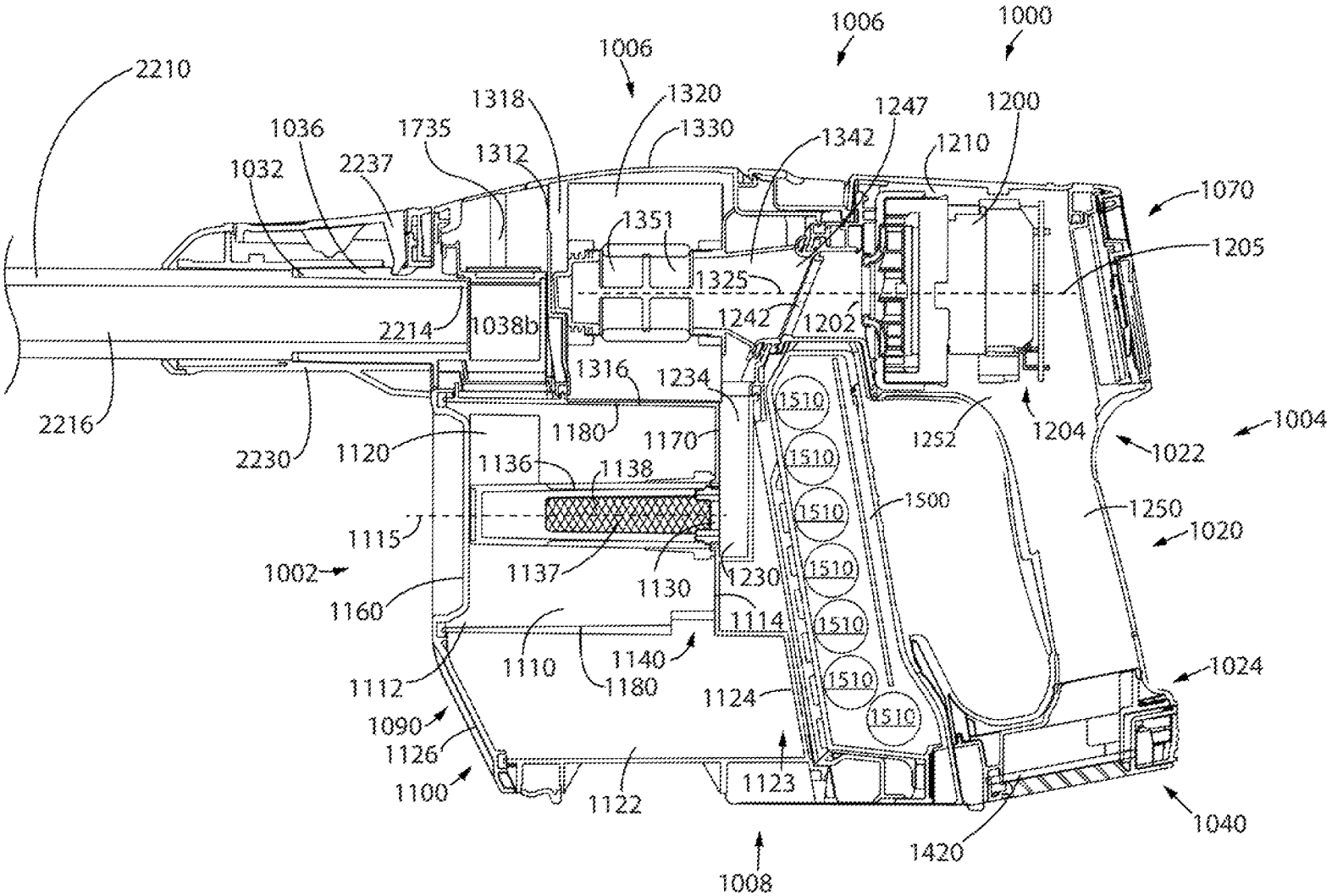
FIG. 13 is a cross-section view of the hand vacuum cleaner of the reconfigurable surface cleaning apparatus of FIG. 10, with the hand vacuum cleaner mounted to the floor cleaning unit.

FIGS. 10 and 13, exemplify this embodiment of a reconfigurable surface cleaning apparatus is in the floor cleaning mode. In this mode, the hand vacuum cleaner 1000 is mounted to the floor cleaning unit 2000 and operated using the energy storage member 1500. Also, a removable plug 1735 is positioned in an auxiliary air inlet 1730 to inhibit or prevent air flow through this inlet.

Similar to the reconfigurable surface cleaning apparatus illustrated in FIGS. 1 to 9, in a floor cleaning mode, when the suction motor of the hand vacuum is operated, air is drawn in through a dirty air inlet 2130 of the surface cleaning head 2100, through the body of the surface cleaning head, into an upstream end 2212 of rigid wand 2210, through the wand 2210, out of the downstream end 2214 of wand 2210, through the air treatment member of hand vacuum cleaner 1000, and ultimately to clean air outlet 1040.

As exemplified, the outlet end of the rigid wand is inserted into the inlet conduit 1036 in the same manner as exemplified in FIGS. 1-9. It will be appreciated that in an alternative embodiment, inlet conduit 1036 may be sized to provide a narrower flow area (i.e., the same as that of the rigid wand 2210) and inlet conduit may be received in the outlet end of the rigid wand 2210.

Figure 12:
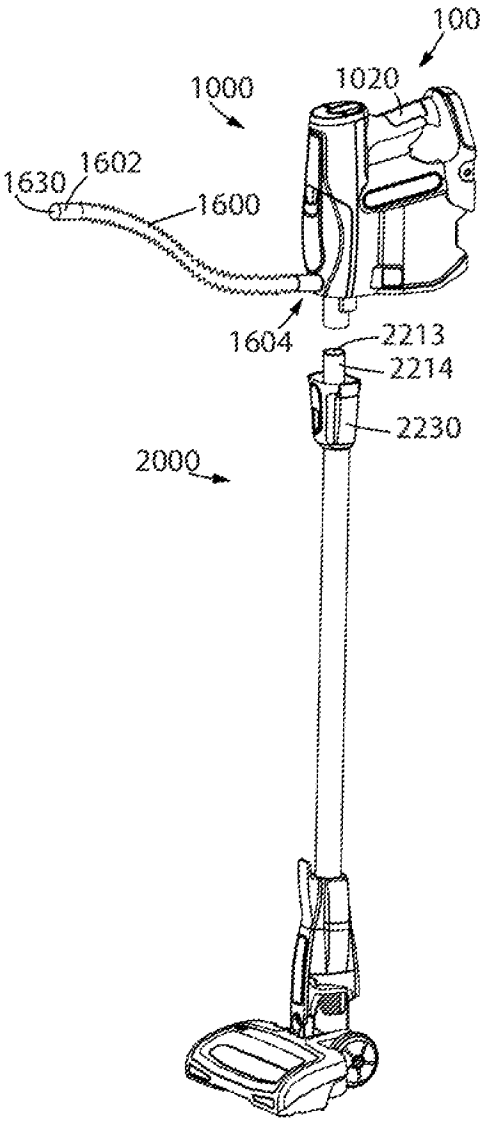
FIG. 12 is a perspective view of the reconfigurable surface cleaning apparatus of FIG. 10, with the hand vacuum cleaner disconnected from the floor cleaning unit and with a flexible hose coupled to the auxiliary air inlet.
Figure 11:
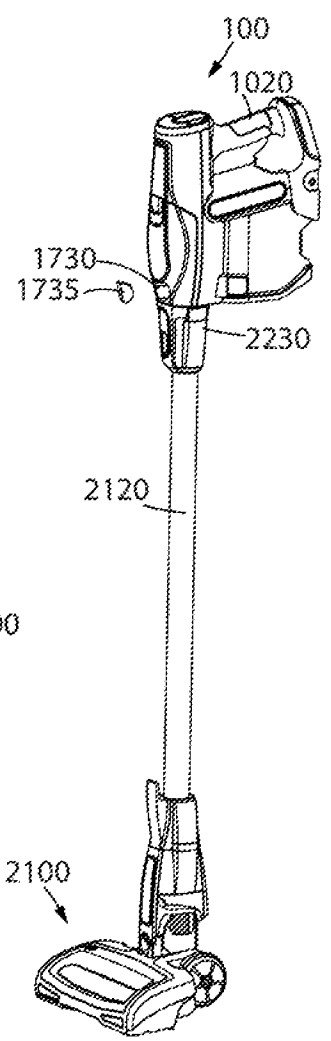
FIG. 11 is a perspective view of the reconfigurable surface cleaning apparatus of FIG. 10, with an auxiliary air inlet in an open position.
Figure 14:
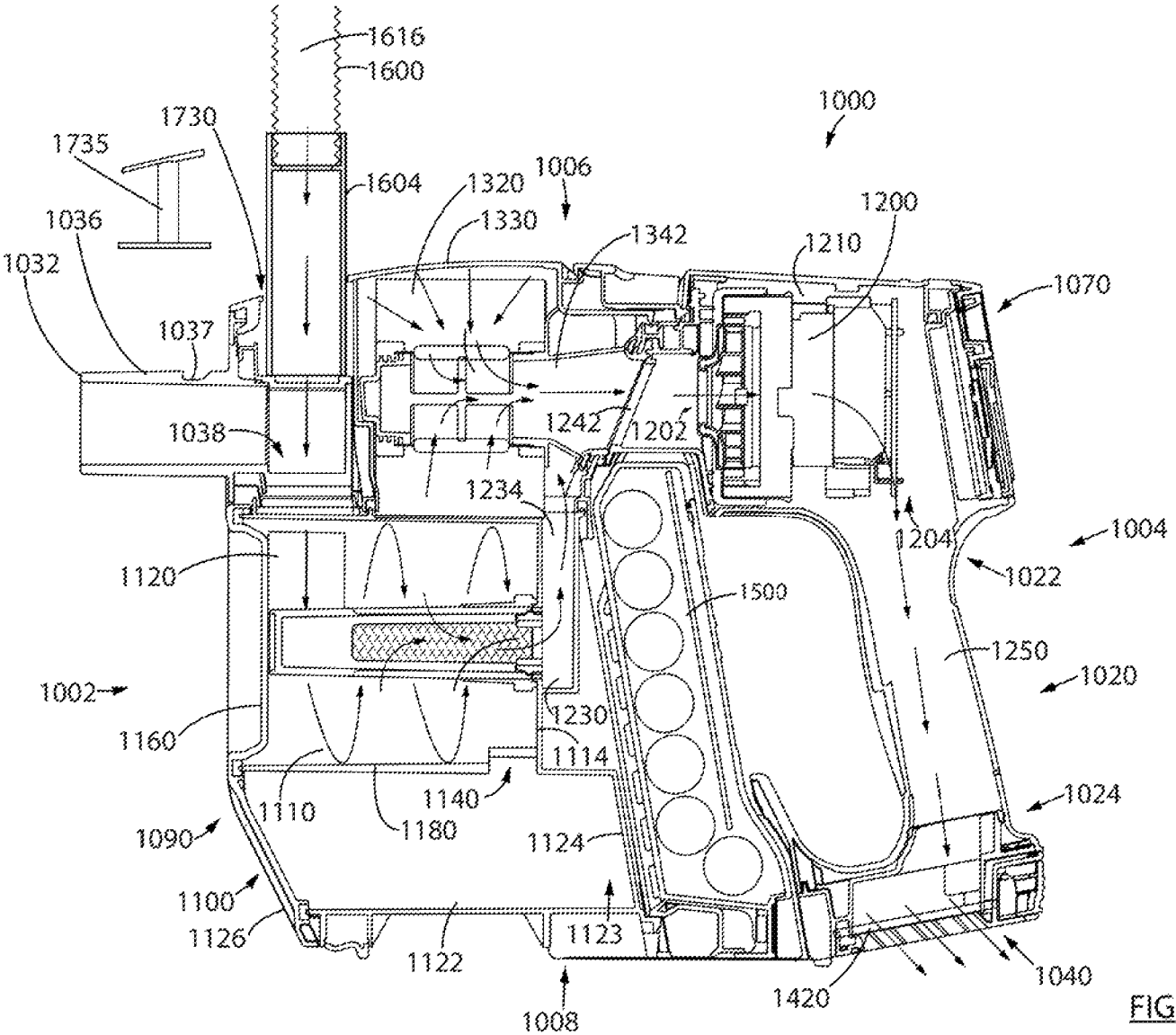
FIG. 14 is a cross-section view of the hand vacuum cleaner of the reconfigurable surface cleaning apparatus of FIG. 10, with the hand vacuum cleaner disconnected from the floor cleaning unit and with a flexible hose coupled to the auxiliary air inlet.

Referring to FIGS. 12 and 14, reconfigurable surface cleaning apparatus is illustrated in an above floor cleaning mode. In this mode, air enters hand vacuum cleaner 1000 via the auxiliary air inlet 1730 and is disconnected from air flow with the floor cleaning unit 2000. In the illustrated example, a downstream end 1604 of a flexible hose 1600 is inserted into the auxiliary air inlet 1730 and abuts the air outlet aperture or port 1038 provided in the air inlet conduit 1036, thereby forming an air flow path between an air outlet 1613 of hose 1600 and the cyclone air inlet 1120. Optionally, one or more sealing members (not shown) may be provided at the interface between air outlet 1613 and cyclone air inlet 1120 for enhancing the airtightness of the connection.

In this configuration, the downstream end 1604 of hose 1600 interrupts (and preferably seals off) airflow from air inlet conduit 1036 to air outlet aperture 1038 and the cyclone air inlet 1120. Thus, a dirty air inlet 1630 located at the upstream end 1602 of hose 1600 forms a dirty air inlet of the hand vacuum cleaner 1000.

As exemplified in FIG. 14, in the above floor cleaning mode, when the suction motor of the hand vacuum is operated, air is drawn into the dirty air inlet 1630 of the hose 1600 and through aperture 1038, thereby forming an air flow path between dirty air inlet 1630 and the cyclone air inlet 1120.

In this configuration, an upstream portion of the air flow path through the hand vacuum cleaner 1000 includes the interior 1616 of hose 1600, which may be referred to as the flow area of this upstream portion. This flow area may have a cross-sectional area in a plane transverse to a direction of air flowing through the hose. For example, the interior 1616 of hose 1600 may have a generally cylindrical shape with a diameter $d_{hose}$. Thus, the cross-sectional area may be calculated as $$Area_{hose} = \pi\left(\frac{d_{hose}}{2}\right)^2.$$

It will be appreciated that the flow area through hose 1600 may have any suitable shape, e.g. oval, quadrilateral, etc.

Preferably, the cross-sectional area of the air flow path through the rigid wand 2210 is less than the cross-sectional area of an upstream portion of the air flow path through the hand vacuum cleaner 1000 (e.g. the area of the interior 1616 of hose 1600). For example, the cross-sectional area of this upstream portion may be at least 5%, at least 10%, at least 15%, at least 20%, at least 25% or more than the cross-sectional area of the flow area of the wand 2210. For example, the cross-sectional area of the flow area of the wand may be between about 0.4 $in^2$ and 0.55 $in^2$, and the cross-sectional area of the flow area of the hose may be about 1.227 $in^2$.

An advantage of such a configuration is that, without adjusting the operation of suction motor 1200, the velocity of air travelling through the rigid wand in the floor cleaning mode may be greater than the velocity of air travelling through the upstream portion (e.g. hose 1600) in the above floor cleaning mode. This may provide greater 'lifting power' in the floor cleaning mode by simply reconfiguring surface cleaning apparatus 100, without e.g. changing the power level at which the suction motor is operated.

Reconfigurable Surface Cleaning Apparatus with Removable Air Treatment Member

The following is a description of different features of a removable air treatment member of a hand vacuum cleaner. These features may be used by themselves in any surface cleaning apparatus or in any combination or sub-combination with any other feature or features described herein.

Optionally, the air treatment member of hand vacuum 1000 may be removable. For example, as exemplified in FIG. 9, in the embodiment of a reconfigurable surface cleaning apparatus illustrated in FIGS. 1 to 9, the air treatment member 1100 may be removable from hand vacuum 1000 as a sealed unit (except for cyclone air inlet 1120 and cyclone air outlet 1130). In this example, when the air treatment member 1100 is removed, the interior of air inlet conduit 1036 may be accessed via air inlet 1030 provided at the first end 1032 of the conduit, and via the air outlet aperture or port 1038.

Optionally, a downstream end of the conduit 1036 may be openable. For example, when the air treatment member of hand vacuum 1000 is removed, a downstream end of the conduit 1036 may be accessible other than via air inlet 1030 and aperture 1038. Facilitating access to the interior of conduit 1136 may have one or more advantages. For example, opening the downstream end of conduit 1036 may facilitate the location and/or removal of debris that has become clogged in this portion of the air flow path of hand vacuum cleaner 1000.

Figure 15:
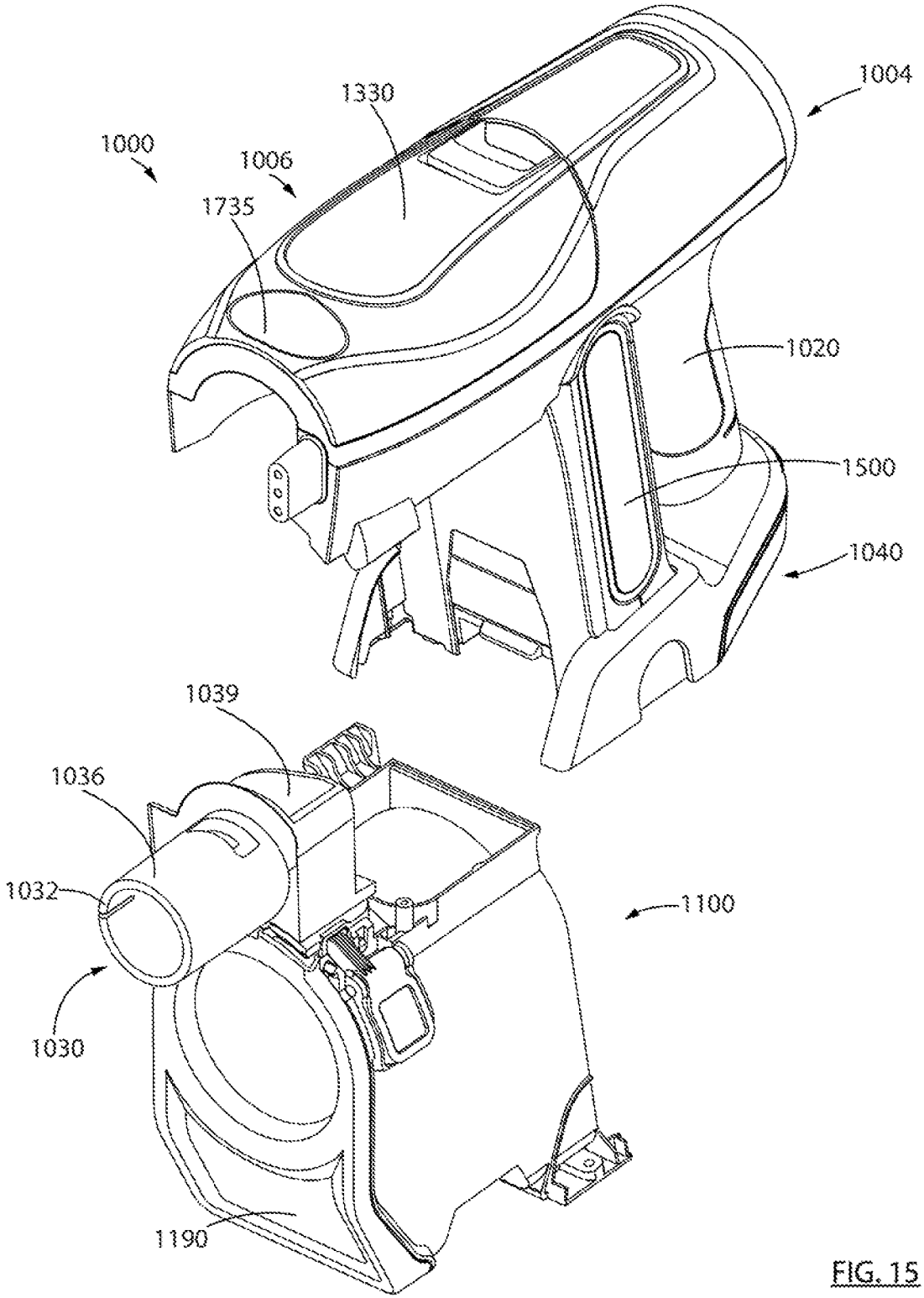
FIG. 15 is partially exploded perspective view of a hand vacuum cleaner in accordance with another embodiment.
Figure 16:
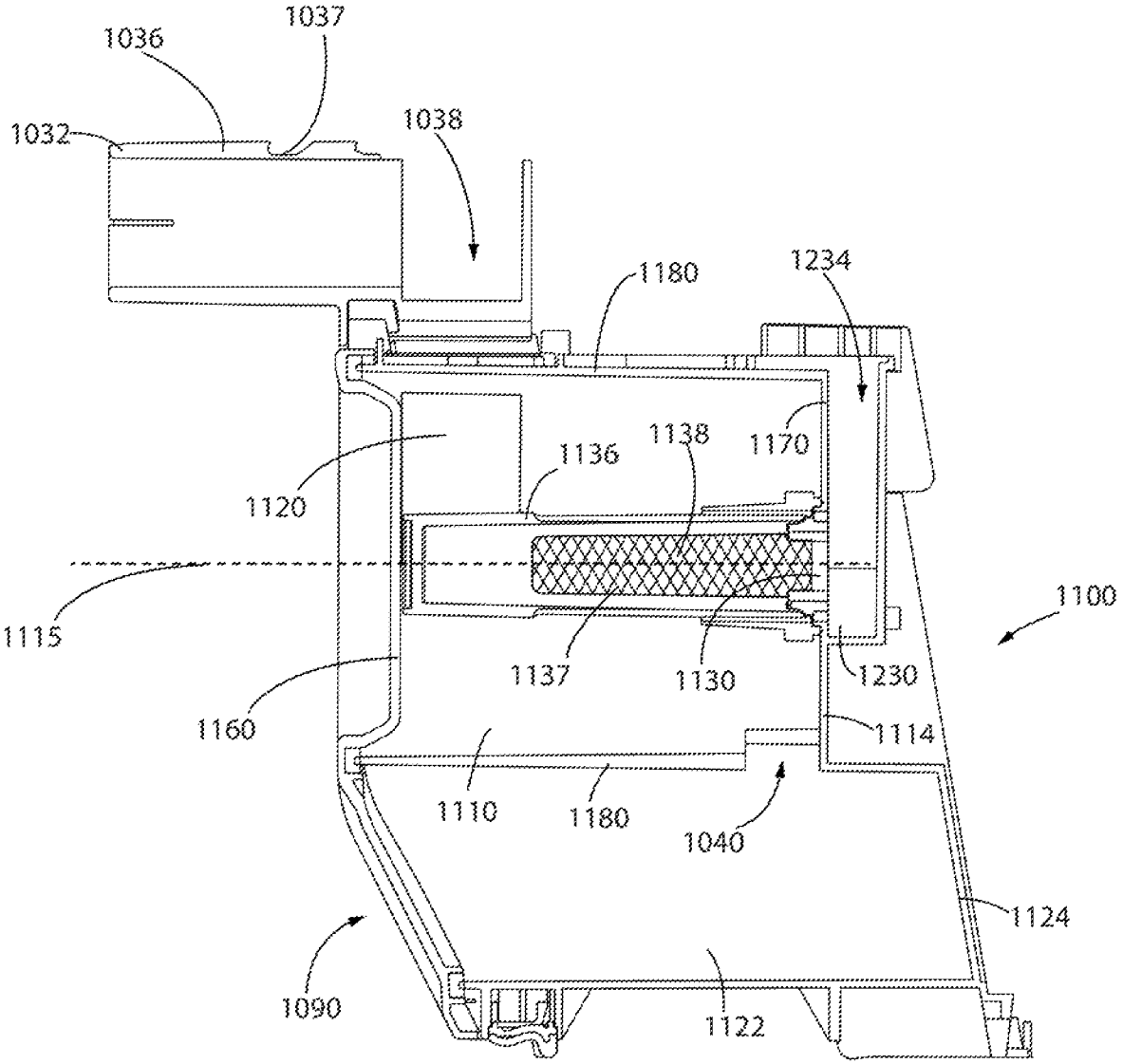
FIG. 16 is a cross section view of the air treatment member of the hand vacuum cleaner of FIG. 15.

For example, as exemplified in FIGS. 15 and 16, the air treatment member 1100 may be integrally formed with at least a portion of the inlet conduit 1036. In this example, when the air treatment member 1100 is removed, the interior of air inlet conduit 1036 may be accessed via air inlet 1030 provided at the first end 1032 of the conduit, and via an opening 1039 provided at the second or outlet end of the conduit.

It will be appreciated that some of the embodiments disclosed herein may not use any of the features of the removable air treatment member disclosed herein and that, in those embodiments, an air treatment member of any kind known in the art may be used.

Reconfigurable Surface Cleaning Apparatus with Variable Air Treatment Member Air Inlet Port Area The following is a description of different features of a variable air inlet of an air treatment member of a hand vacuum cleaner or portable cleaning unit. These features may be used by themselves in any surface cleaning apparatus or in any combination or sub-combination with any other feature or features described herein.

Alternatively, or in addition to adjusting the cross sectional flow area of the inlet conduit 1036 of hand vacuum cleaner, the cross-sectional flow area of the inlet port of the air treatment member air inlet (e.g., the inlet port of tangential cyclone inlet 1120) may be adjustable.

Accordingly, when the reconfigurable surface cleaning apparatus is in a floor cleaning mode, the cross-sectional area of the air inlet to an air treatment member (in a plane transverse to the direction of air flow through the air inlet) may be less than the cross-sectional area of the air inlet to the air treatment member when the reconfigurable surface cleaning apparatus is in an above floor cleaning mode. An advantage of such a configuration is that the cross-sectional flow area of the inlet port of the air treatment member air inlet may be automatically adjusted to be the same as the cross-sectional area of the upstream air flow path of the hand vacuum cleaner in the floor cleaning mode.

Figure 17:
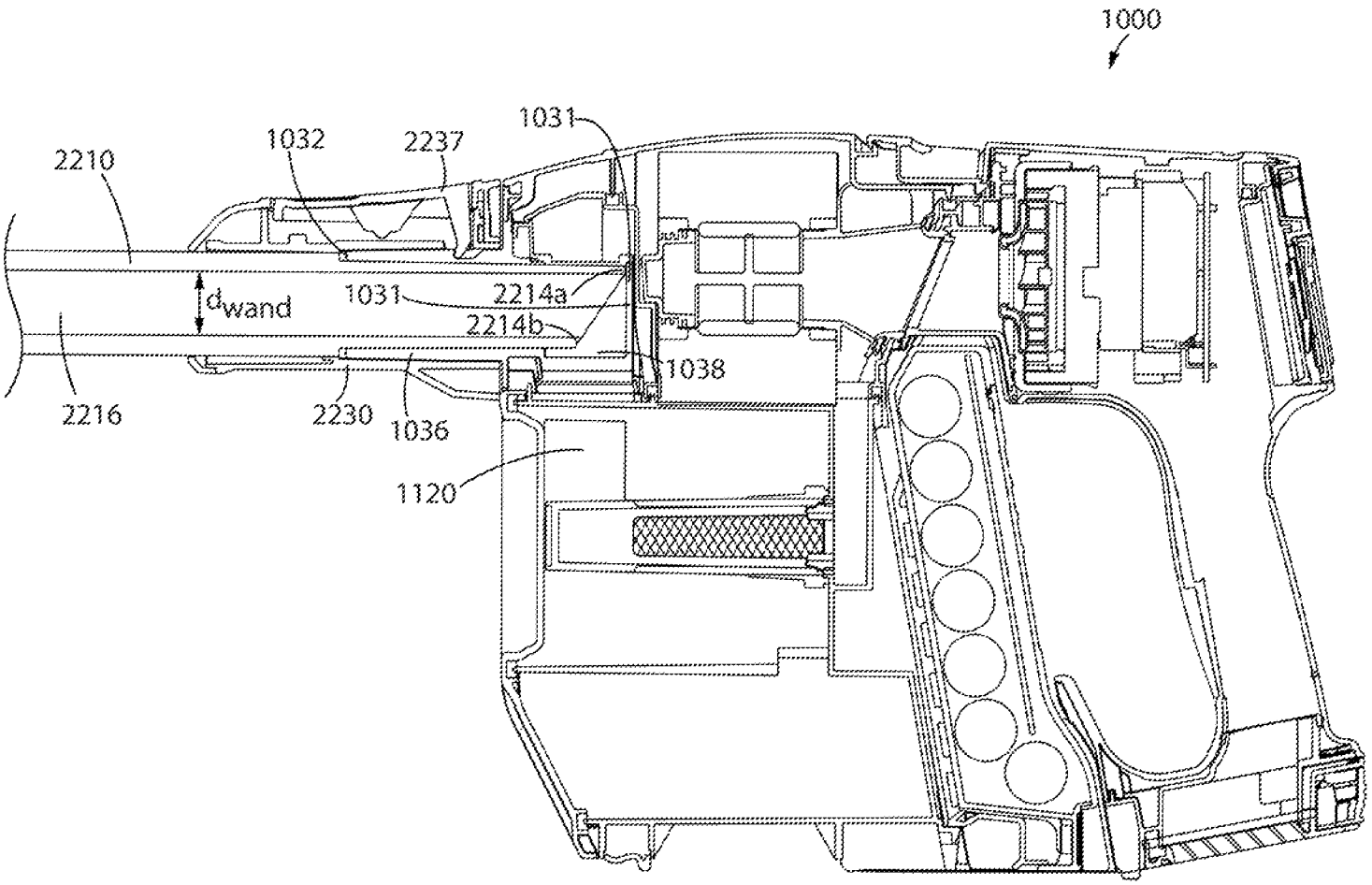
FIG. 17 is a cross-section view of a hand vacuum cleaner of a reconfigurable surface cleaning apparatus in accordance with another embodiment, with the hand vacuum cleaner mounted to the floor cleaning unit.
Figure 18:
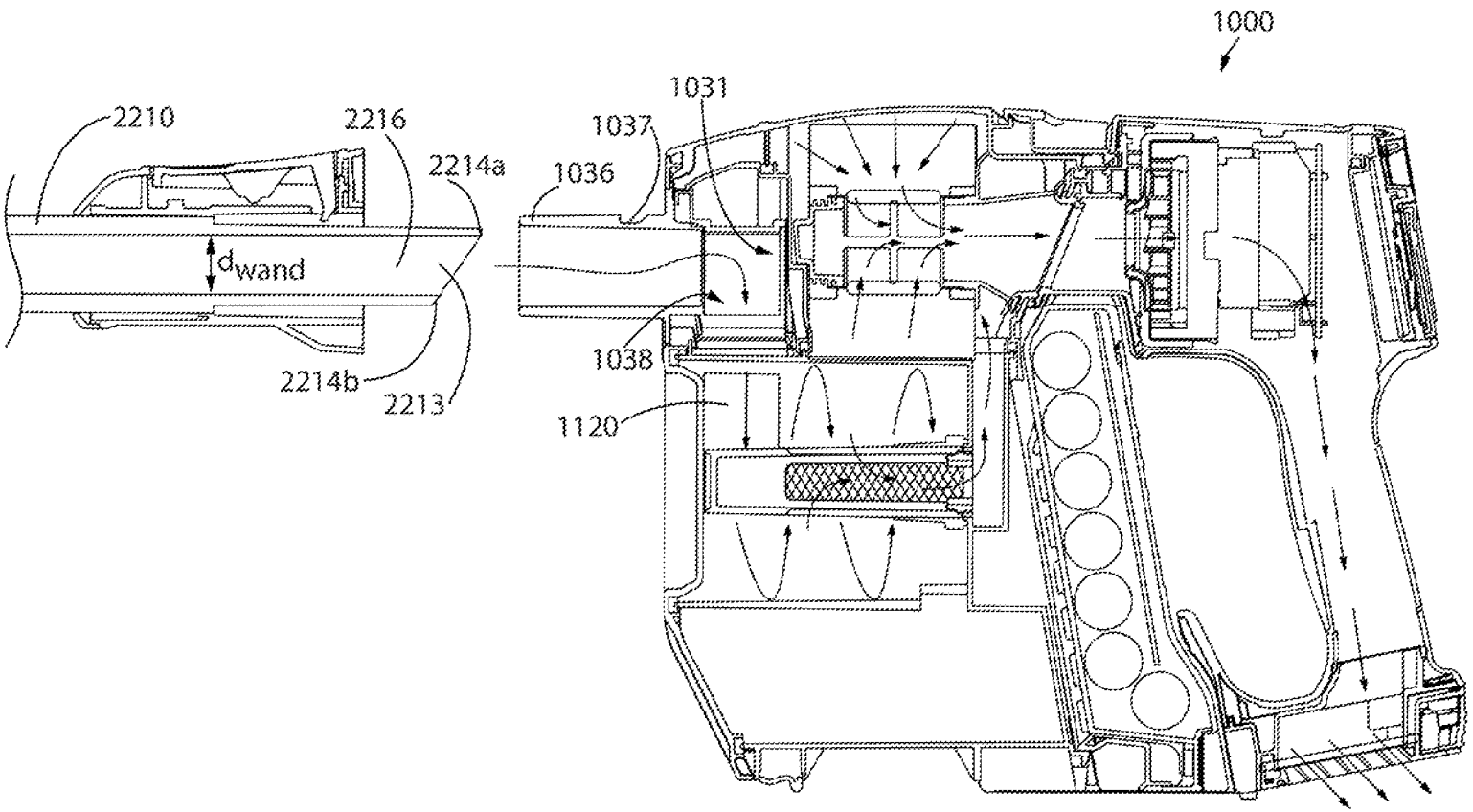
FIG. 18 is a cross-section view of the hand vacuum cleaner of the reconfigurable surface cleaning apparatus of FIG. 17, with the hand vacuum cleaner disconnected from the floor cleaning unit.

As exemplified in FIGS. 17 and 18, a downstream end 2214 of rigid wand 2210 has an angled profile, in which a distal portion 2214*a* of the wand end 2214 extends further in a longitudinal (rearward) direction than another portion 2214*b* of the wand end. When the hand vacuum cleaner 1000 is mounted to the floor cleaning unit, and downstream end 2214 of rigid wand 2210 is positioned in air inlet conduit 1036, the distal portion 2214*a* of wand end 2214 may abut the downstream end 1031 of air inlet conduit 1036 (or another stop member may be utilized to define the inward extend to which the downstream end 2214 of rigid wand 2210 may be inserted). The portion 2214*b* of the wand end 2214 partially occludes the port 1038 and the cyclone air inlet 1120, thereby reducing the effective cross-sectional area of the inlet port of the cyclone air inlet 1120. Optionally, one or more sealing members (not shown) may be provided at the interface between air outlet 2213 and cyclone air inlet 1120 for enhancing the airtightness of the connection.

In this configuration, as illustrated in FIG. 17, the air flow path upstream of the air treatment member 1100 includes the interior 2216 of wand 2210, which may have a cross-sectional area $Area_{wand}$ and the partially occluded air outlet 2213 and the inlet port 1038 of the cyclone air inlet 1120, which may have a cross-sectional area (in a plane transverse to a direction of air flowing through the cyclone air inlet) that may be approximately equal to $Area_{wand}$. Such a configuration may have one or more advantages. For example, this may reduce backpressure and/or otherwise improve the efficiency of airflow through the reconfigurable surface cleaning apparatus in the floor cleaning mode.

Referring to FIG. 18, the reconfigurable surface cleaning apparatus is illustrated in an above floor cleaning mode, in which the hand vacuum cleaner 1000 is disconnected from the floor cleaning unit. In this configuration, with wand 2210 is disconnected, the port 1038 of the cyclone air inlet 1120 is no longer occluded, thereby increasing the effective cross-sectional area of the cyclone air inlet 1120 (as compared to when it was partially occluded by portion 2214*b* of the wand end 2214).

Figure 19:
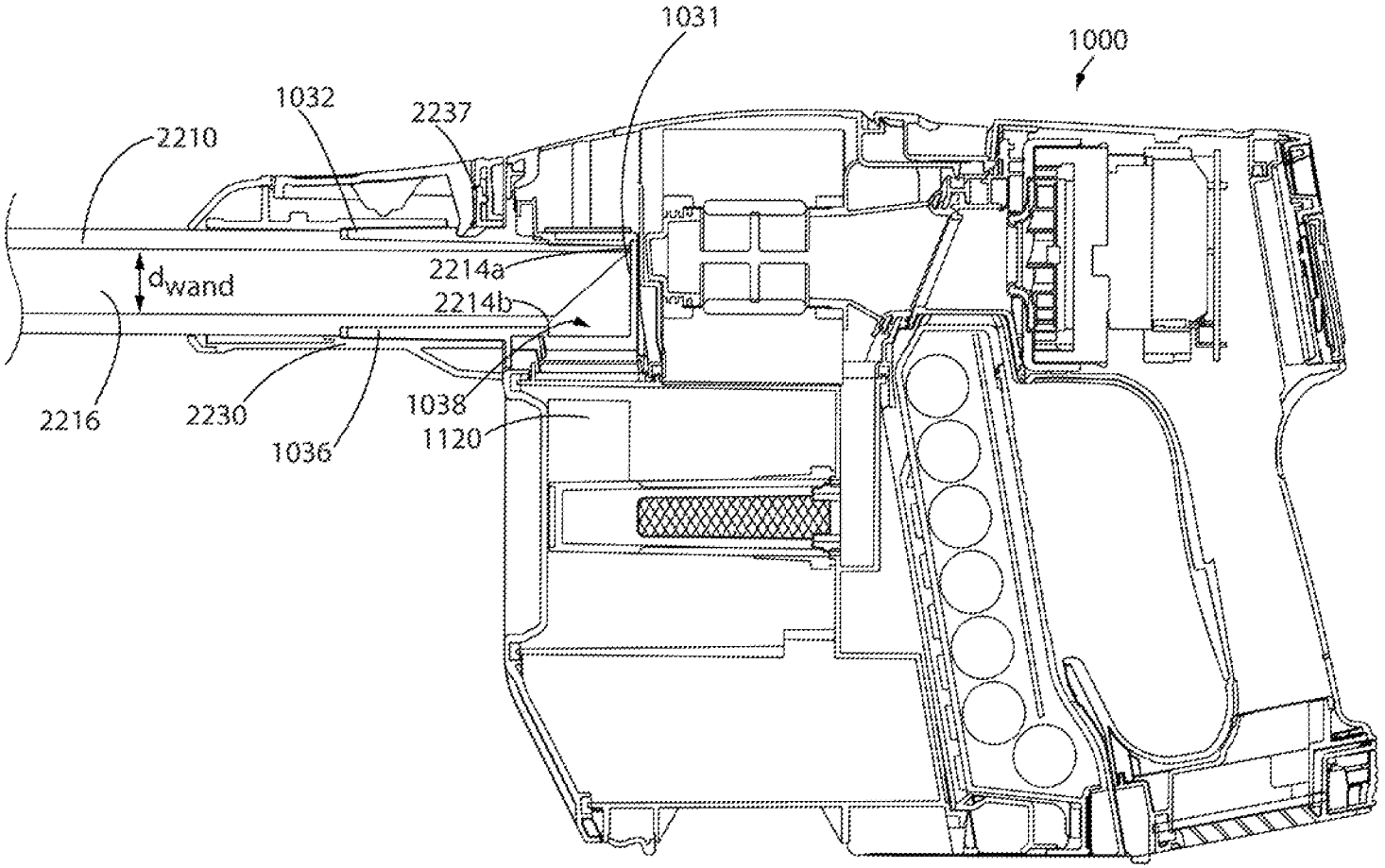
FIG. 19 is a cross-section view of a hand vacuum cleaner of a reconfigurable surface cleaning apparatus in accordance with another embodiment, with the hand vacuum cleaner mounted to the floor cleaning unit.

FIG. 19 exemplifies another example embodiment of a reconfigurable surface cleaning apparatus. In this illustrated embodiment, downstream end 2214 of rigid wand 2210 is more angled (the included angle between the sidewall of downstream end 2214 and the edge extending between wand ends 2214*a* and 2214*b* is less acute) than the embodiment illustrated in FIGS. 17 and 18. As a result, when the downstream end 2214 of rigid wand 2210 is positioned in air inlet conduit 1036 with the distal portion 2214*a* of wand end 2214 abutting the downstream end 1031 of air inlet conduit 1036, portion 2214*b* of wand end 2214 occludes less of the area of the port 1038 of the cyclone air inlet 1120, thereby reducing the effective cross-sectional area of the cyclone air inlet 1120 by a lesser amount than the embodiment illustrated in FIGS. 17 and 18.

It will be appreciated that some of the embodiments disclosed herein may not use any of the features of the variable air treatment member air inlet disclosed herein and that, in those embodiments, an air inlet of any kind known in the art may be used.

Reconfigurable Surface Cleaning Apparatus with a Cyclone Air Inlet Proximate the Surface Cleaning Head The following is a description of different features of a reconfigurable surface cleaning apparatus with a cyclone air inlet located proximate the surface cleaning head. These features may be used by themselves in any surface cleaning apparatus or in any combination or sub-combination with any other feature or features described herein.

As discussed previously, a higher velocity of air flow produces more lifting power. However, a higher velocity requires additional power, which reduces the run time of a surface cleaning apparatus on a single charge of the on board energy storage members. According to this aspect, reducing the height through which the dirt is raised to enter the air treatment member reduces the work which must be performed by the air flow upstream of the air treatment member. This in turn reduces the power requirement for a surface cleaning apparatus. Accordingly reducing the height of, e.g., a cyclone air inlet may enable a surface cleaning apparatus to have a longer run time on a single charge of the on board energy storage members. The height of an inlet may be lowered by using an inverted cyclone (i.e., a cyclone with an air inlet at the lower end) and/or lowering the height of the cyclone (e.g., by placing the cyclone as the lowest element in the upper section of an upright vacuum cleaner).

FIGS. 20 to 23 exemplify such an embodiment. As exemplified therein, portable cleaning unit 1000 is a lift away style unit that is removably connected to upper section 2200. In the illustrated example, an inlet conduit 1036 at the lower end of the portable cleaning unit may be seated on an upflow conduit 2210 of floor cleaning unit 2000 to mount the portable cleaning unit to the floor cleaning unit.

Figure 21:
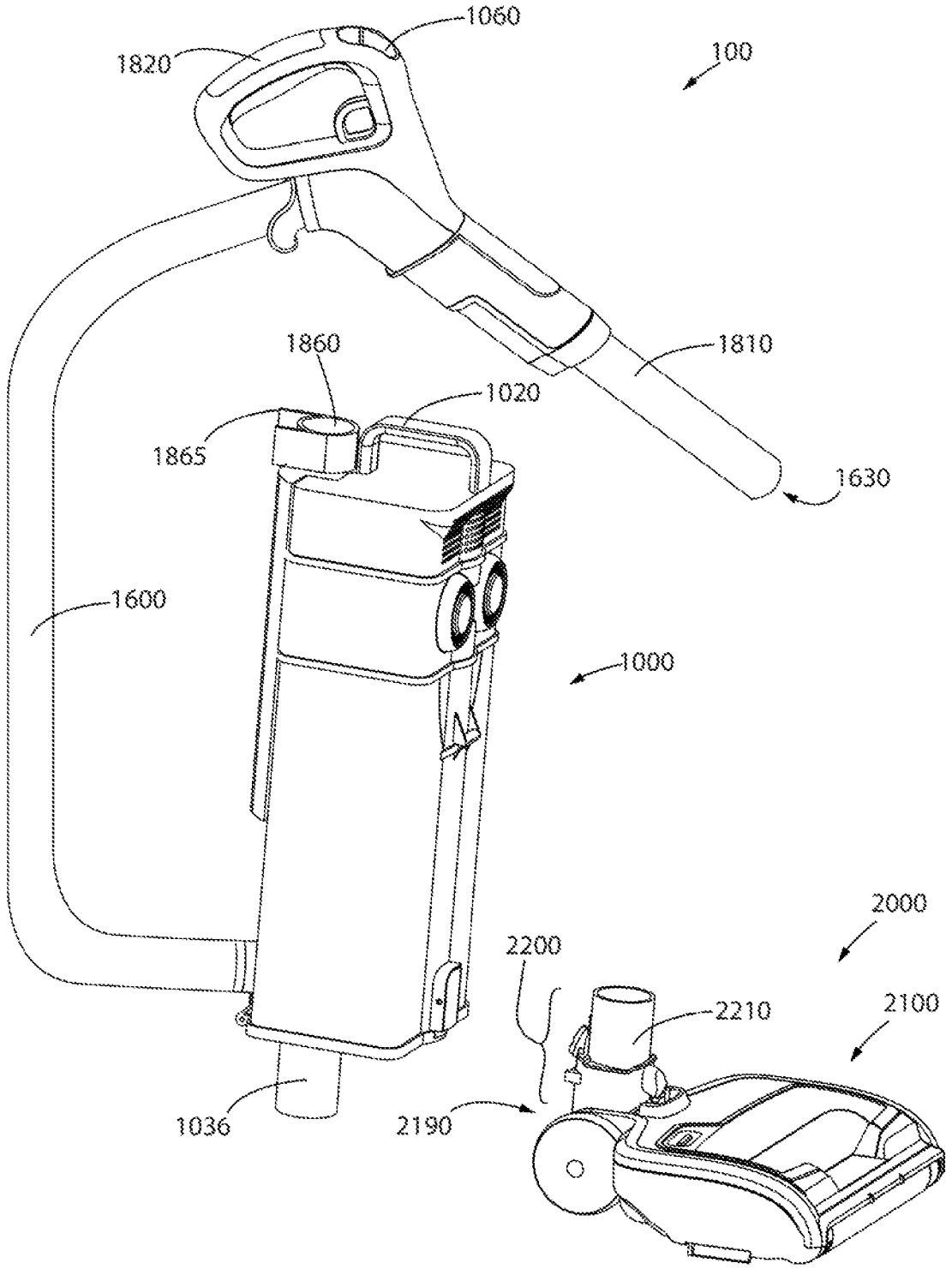
FIG. 21 is a perspective view of the reconfigurable surface cleaning apparatus of FIG. 20, with the portable cleaning unit disconnected from the floor cleaning unit and with a flexible hose coupled to an auxiliary air inlet.

In FIG. 21, the reconfigurable surface cleaning apparatus is illustrated in an above floor cleaning mode. In this mode, the portable cleaning unit 1000 may optionally be unmounted from the floor cleaning unit 1000 and carried by the handle 1020. Alternatively, the portable cleaning unit 1000 may remain mounted to the floor cleaning unit 2000 while being disconnected form airflow communication with the floor cleaning unit.

Figure 23:
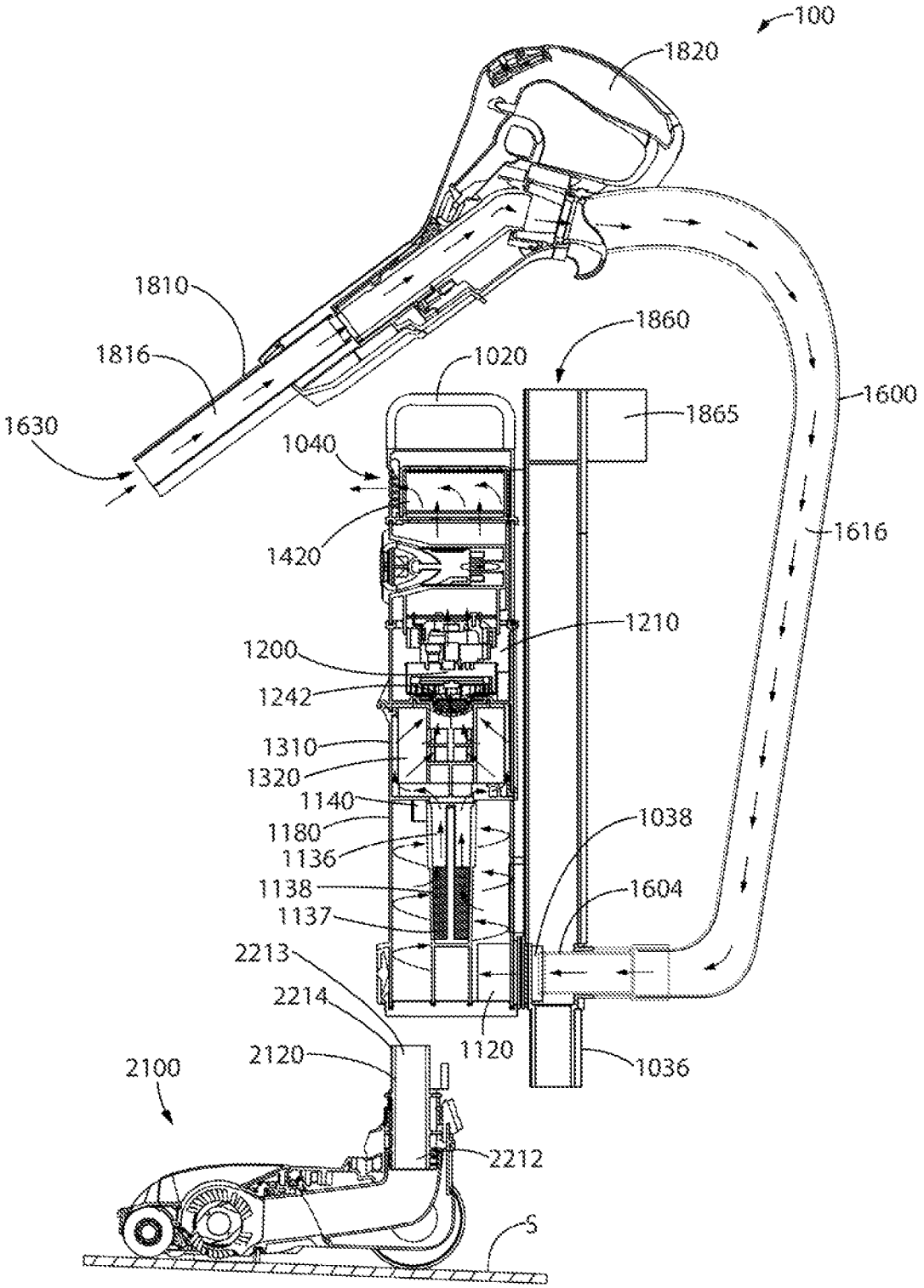
FIG. 23 is a cross-section view of the reconfigurable surface cleaning apparatus of FIG. 21.
Figure 24:
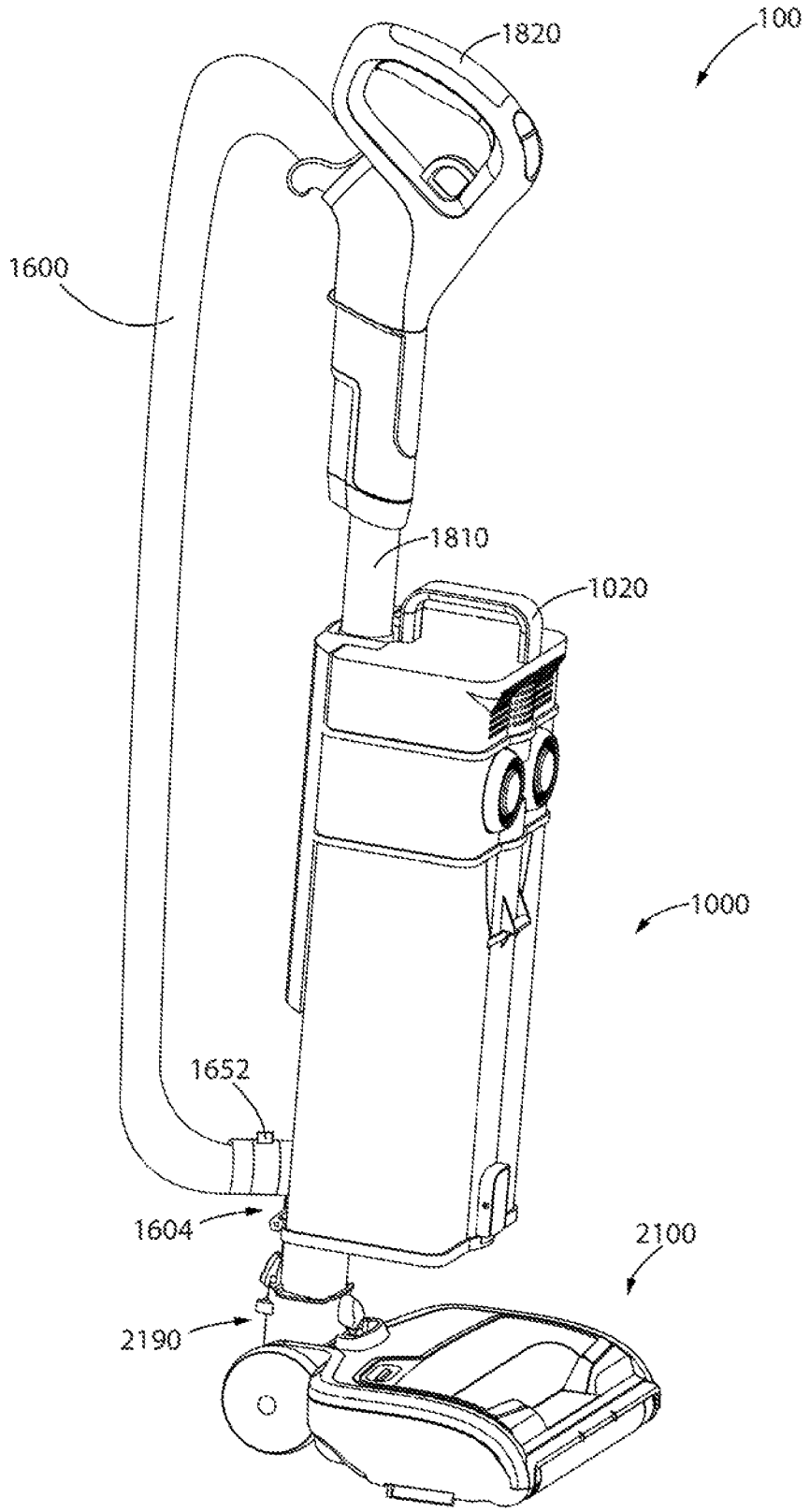
FIG. 24 is a perspective view of a reconfigurable surface cleaning apparatus in accordance with another embodiment, with a portable cleaning unit mounted to a floor cleaning unit, and with the floor cleaning unit positioned in an upright storage position.
Figure 25:
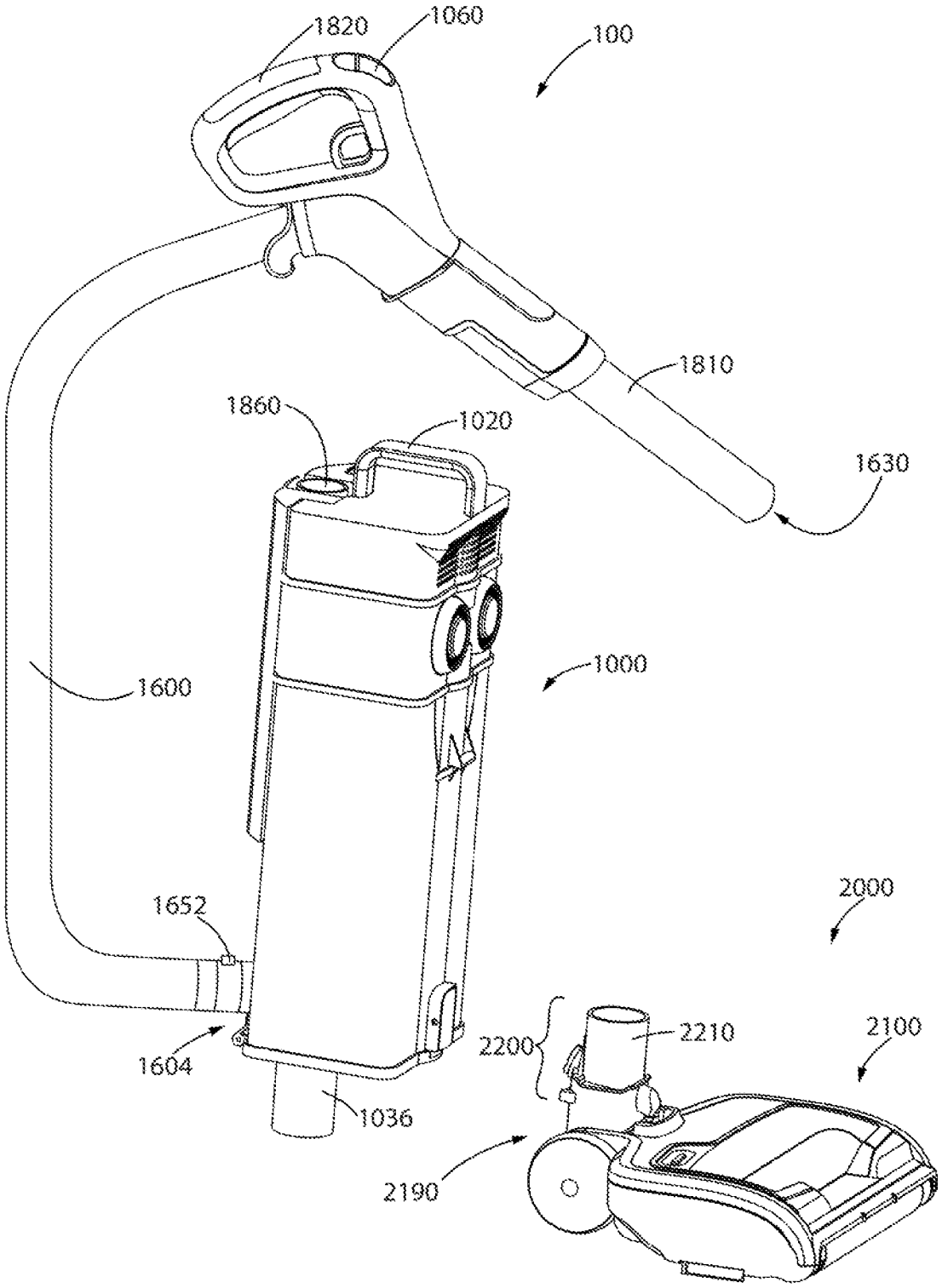
FIG. 25 is a perspective view of the reconfigurable surface cleaning apparatus of FIG. 24, with the portable cleaning unit disconnected from the floor cleaning unit.

In the illustrated above floor cleaning mode, air enters portable cleaning unit 1000 via an auxiliary air inlet 1730 and is disconnected from air flow with the floor cleaning unit 2000 (see FIG. 23). As exemplified, the fluid flow path may include at least one flexible fluid flow conduit member, in the form of a hose 1600, and at least one rigid fluid flow conduit member (a wand) 1810. In the illustrated example, a downstream end 1604 of a flexible hose 1600 is inserted into to the auxiliary air inlet 1730 and abuts the air outlet aperture or port 1038 provided in the air inlet conduit 1036, thereby forming an air flow path between an air outlet 1613 of hose 1600 and the cyclone air inlet 1120. Optionally, one or more sealing members (not shown) may be provided at the interface between air outlet 1613 and cyclone air inlet 1120 for enhancing the airtightness of the connection.

In this configuration, the downstream end 1604 of hose 1600 interrupts (and preferably seals off) airflow from air inlet conduit 1136 to air outlet aperture 1038 and the cyclone air inlet 1120. Thus, a dirty air inlet 1630 located at the upstream end 1802 of wand 1810 forms a dirty air inlet of the portable cleaning unit 1000.

As exemplified in FIG. 23, in the above floor cleaning mode, when the suction motor 1200 of the portable cleaning unit is operated, air is drawn into the dirty air inlet 1630 of the wand 1810, through hose 1600, and through aperture 1038, thereby forming an air flow path between dirty air inlet 1630 and the cyclone air inlet 1120.

Figure 20:
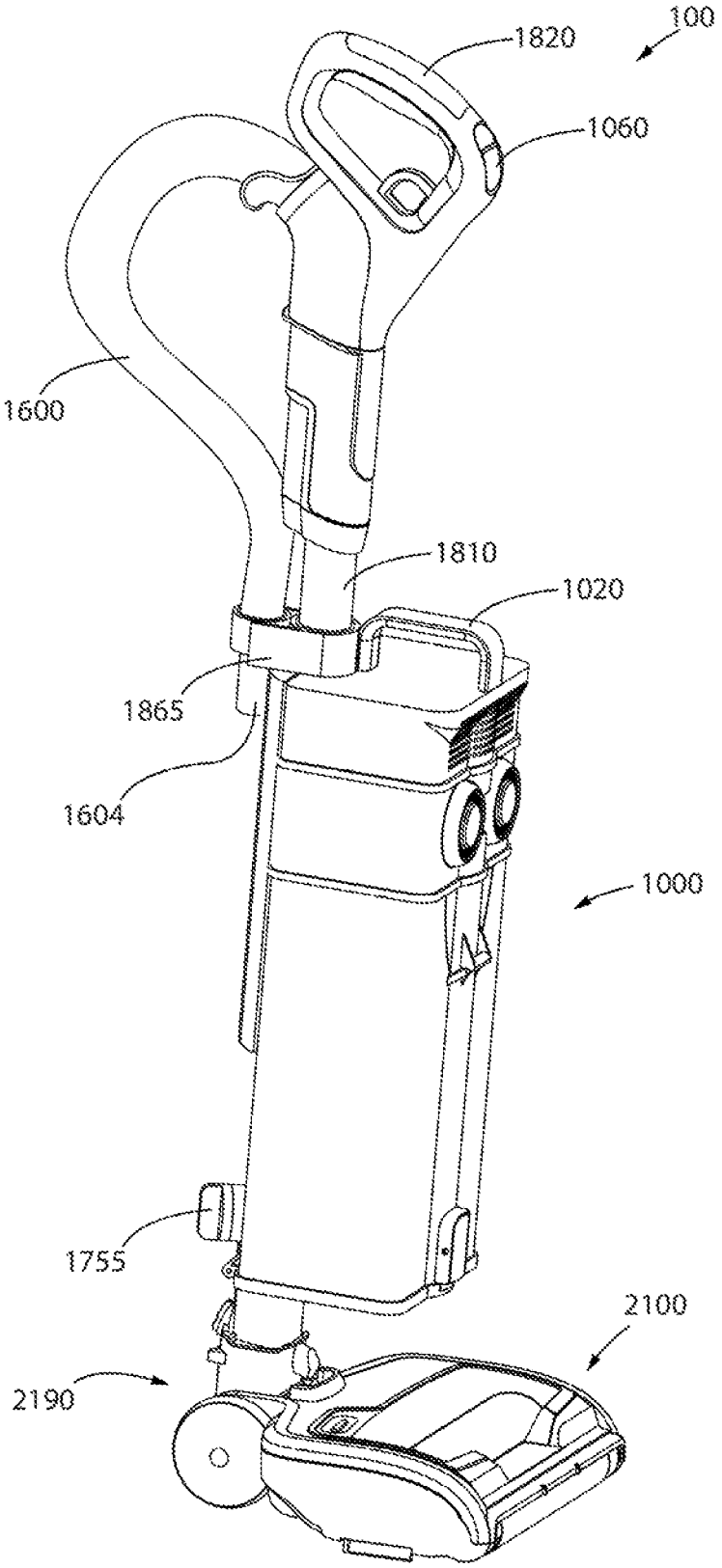
FIG. 20 is a perspective view of a reconfigurable surface cleaning apparatus in accordance with another embodiment, with a portable cleaning unit mounted to a floor cleaning unit, and with the floor cleaning unit positioned in an upright storage position.
Figure 22:
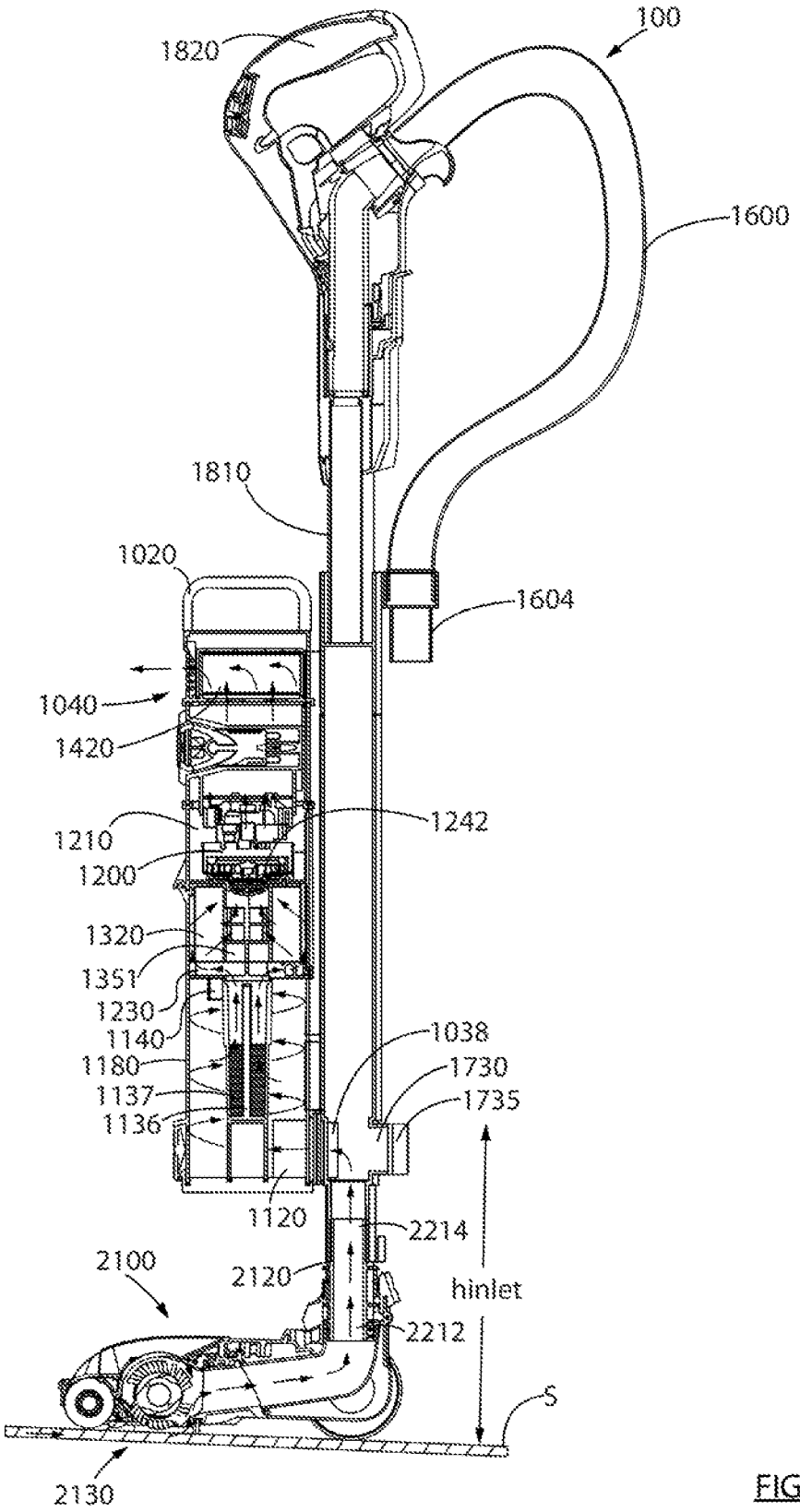
FIG. 22 is a cross-section view of the reconfigurable surface cleaning apparatus of FIG. 20.

As illustrated in FIGS. 20 and 22, in a floor cleaning mode the wand 1810 may be inserted into a recess 1860 provided at an upper end of portable cleaning unit 1000, and a drive handle 1820 may be provided proximate the connection between the wand 1810 and the hose 1600, and a user may grasp the drive handle 1820 to maneuver and/or steer the reconfigurable surface cleaning apparatus 100 across a surface. Accordingly, when portable cleaning unit 1000 is mounted to upper section 2200 and wand 1810 is secured in recess 1860, handle 1820 is the drive handle of reconfigurable surface cleaning apparatus 100. Optionally, a retaining clip 1865 may be provided for releasably securing the end 1604 of hose 1600 to the portable cleaning unit 1000.

In this configuration, an upstream portion of the air flow path through the portable cleaning unit 1000 includes the interior 1616 of hose 1600, and the interior 1816 of wand 1810. The flow area of this upstream portion may have a cross-sectional area in a plane transverse to a direction of air flowing through the hose. For example, the interior 1616 of hose 1600 may have a generally cylindrical shape with a diameter $d_{hose}$. Thus, the cross-sectional area may be calculated as $$Area_{hose} = \pi\left(\frac{d_{hose}}{2}\right)^2.$$

Also, the interior 1816 of wand 1810 may have a generally cylindrical shape with a diameter $d_{wand}$. Thus, the cross-sectional area may be calculated as $$Area_{wand} = \pi\left(\frac{d_{wand}}{2}\right)^2.$$

Optionally, the flow area of the wand 1810 and of the hose 1600 may be approximately equal (i.e. $Area_{hose}=Area_{wand}$) and may be larger than the flow area of rigid wand 2210 as discussed subsequently.

As exemplified in FIG. 22, in a floor cleaning mode, when the suction motor of the portable cleaning unit is operated, air is drawn in through the dirty air inlet 2130 and through the body of the surface cleaning head 2100. Air then enters an upstream end 2212 of an upflow conduit or duct 2210, flows through the duct 2210, exits the downstream end 2214 of duct 2210, and enters the portable cleaning unit 1000. In portable cleaning unit 1000, the air is directed through the air treatment member, and to clean air outlet 1040.

Referring to FIG. 22, when the portable cleaning unit 1000 is mounted to the floor cleaning unit 2200, a downstream end 2214 of upflow duct 2210 is positioned in air inlet conduit 1036 of portable cleaning unit 1000. Optionally, a latch or other retaining member (not shown) member may be provided for releasably securing the portable cleaning unit 1000 to the floor cleaning unit 2200. In the illustrated example, the end 2214 of duct 2210 extends proximate the air outlet aperture or port 1038 provided proximate the downstream end of air inlet conduit 1036, thereby forming an air flow path between an air outlet 2213 of duct 2210 and the cyclone air inlet 1120. Optionally, one or more sealing members (not shown) may be provided at the interface between air outlet 2213 and cyclone air inlet 1120 for enhancing the airtightness of the connection.

In this configuration, as illustrated in FIG. 22, the air flow path through the floor cleaning unit 2000 includes the interior 2216 of upflow duct 2120, which may be referred to as the flow area of the duct. This flow area may have a cross-sectional area in a plane transverse to a direction of air flowing through the duct. For example, the interior 2216 of duct 2120 may have a generally cylindrical shape with a diameter $d_{upflow}$. Thus, the cross-sectional area may be calculated as $$Area_{upflow} = \pi\left(\frac{d_{upflow}}{2}\right)^2.$$

Preferably, the cross-sectional area of the air flow path through the upflow duct 2210 is less than the cross-sectional area of an upstream portion of the air flow path through the portable cleaning unit 1000 (e.g. the area of the interior 1616 of hose 1600 and/or the area of the interior 1816 of wand 1810). For example, the cross-sectional area of this upstream portion may be at least 5%, at least 10%, at least 15%, at least 20%, at least 25% or more than the cross-sectional area of the flow area of the upflow duct 2210.

An advantage of such a configuration is that, without adjusting the operation of suction motor 1200, the velocity of air travelling through the upflow duct in the floor cleaning mode may be greater than the velocity of air travelling through the upstream portion (e.g. hose 1600 and/or wand 1810) in the above floor cleaning mode. This may provide greater 'lifting power' in the floor cleaning mode by simply reconfiguring surface cleaning apparatus 100, without e.g. changing the power level at which the suction motor is operated.

Also, in this configuration, as illustrated in FIG. 22, the air flow path from the dirty air inlet 2130, through surface cleaning head 2100, and to the air inlet of the air treatment member (i.e. the cyclone air inlet 1120) may have an overall height $h_{inlet}$ from the floor surface S on which surface cleaning head 2100 is positioned. Preferably, this height $h_{inlet}$ is relatively short, e.g. less than about 30 inches, less than 24 inches, less than 20 inches and optionally about 15 to 18 inches.

Providing the cyclone air inlet no more than, e.g., 20 inches above the floor may have one or more advantages. For example, this may allow the use of a higher velocity of air flow in the floor cleaning mode without substantially reducing the run time of the surface cleaning apparatus on a single charge of the on board energy storage members. As exemplified, the air flow path of upflow duct 2210 may have a relatively smaller cross-sectional area that the inlet air flow path in the above floor cleaning mode, which promotes an increased velocity of air travelling through this air flow path (thereby increasing the 'lifting power' of the air flowing through this air flow path) when the suction motor is operated at a given power level, as the 'drag' (or other aerodynamic inefficiencies) of a narrower air flow path are reduced due to its reduced length. It will be appreciated that the enhanced lifting power and run time enabled without increasing the power storage capacity of a surface cleaning apparatus in a cordless mode may be obtained even if the flow area of the air inlet path in the above floor cleaning mode is not adjusted.

FIGS. 24 to 27 exemplify another example embodiment of a reconfigurable surface cleaning apparatus, referred to generally as 100. This illustrated embodiment is generally similar to the embodiment illustrated in FIGS. 20 to 23, but with hose 1600 coupled to portable cleaning unit 1000 via a valve 1650 that can be operated to change the air flow path through the reconfigurable surface cleaning apparatus.

Figure 26:
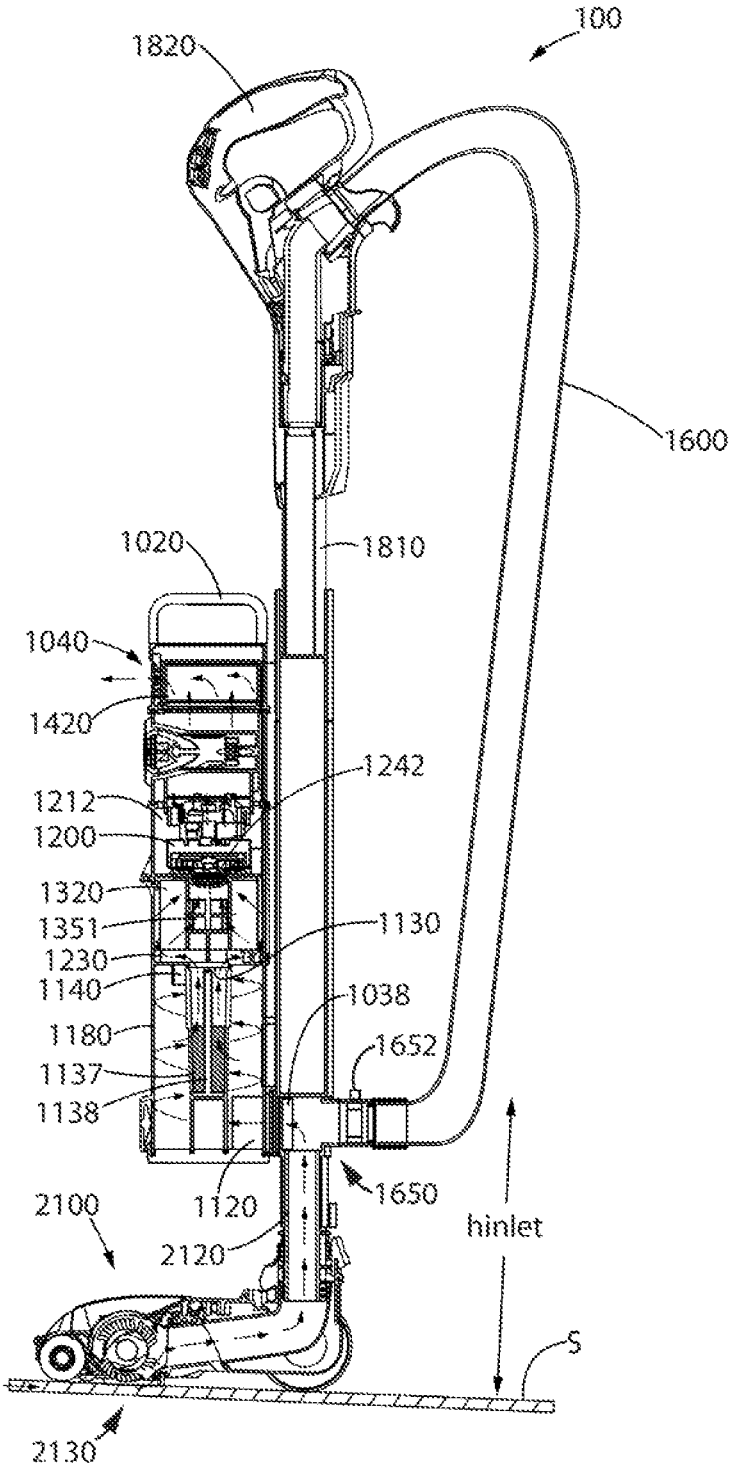
FIG. 26 is a cross-section view of the reconfigurable surface cleaning apparatus of FIG. 24.

Referring to FIG. 26, when the portable cleaning unit 1000 is mounted to the floor cleaning unit 2200, valve 1650 may be adjusted (e.g. using lever 1652) to fluidly connect upflow duct 2120 with port 1038, thereby forming an air flow path between dirty air inlet 2130 and cyclone air inlet 1120, and to fluidly disconnect the downstream end 1604 of flexible hose 1600 from port 1038. Accordingly, when the suction motor of the portable cleaning unit is operated, air is drawn in through the dirty air inlet 2130, through the body of the surface cleaning head 2100, through the duct 2210, and to the air treatment member air inlet 1120.

Figure 27:
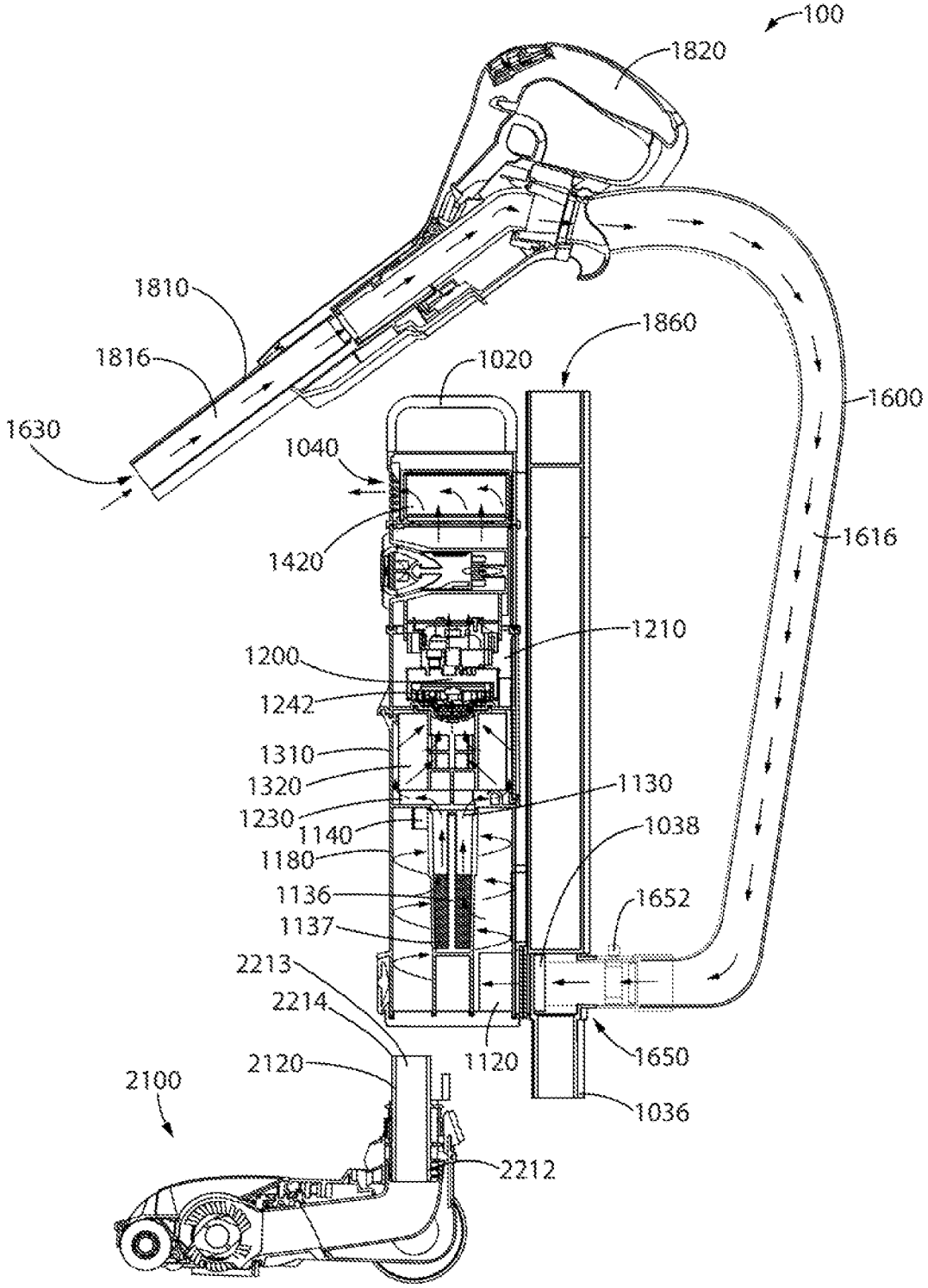
FIG. 27 is a cross-section view of the reconfigurable surface cleaning apparatus of FIG. 25.
Figure 28:
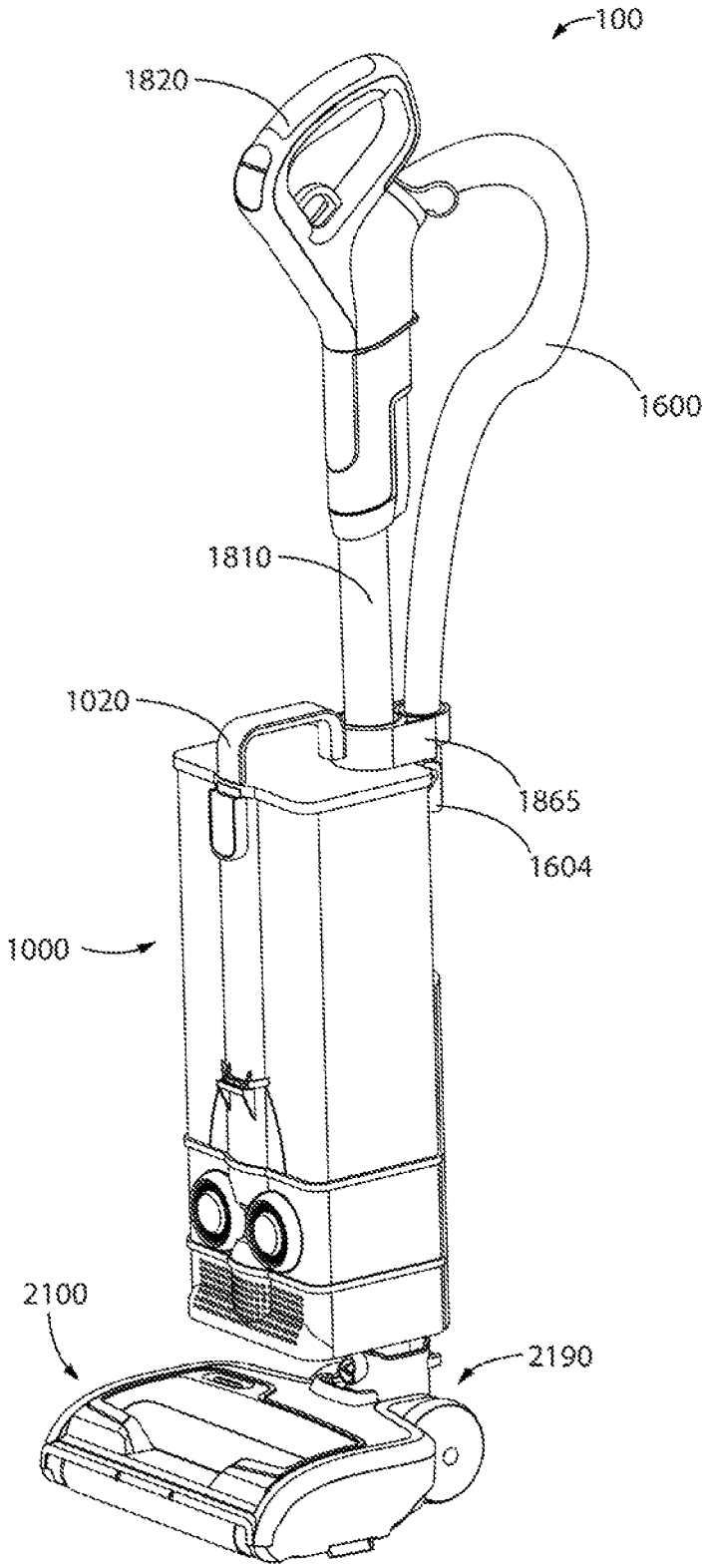
FIG. 28 is a front perspective view of a reconfigurable surface cleaning apparatus in accordance with another embodiment, with a portable cleaning unit mounted to a floor cleaning unit, and with the floor cleaning unit positioned in an upright storage position.
Figure 29:
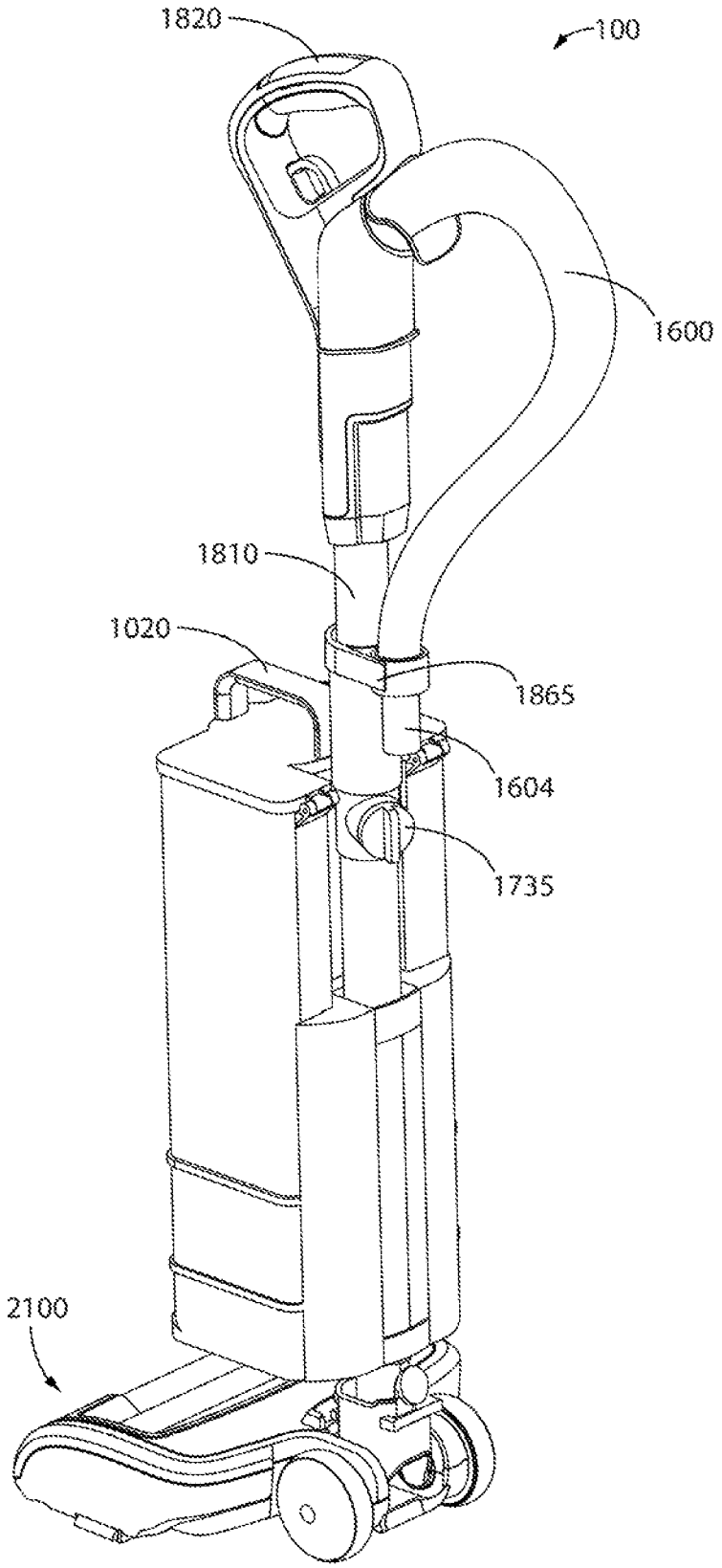
FIG. 29 is a rear perspective view of the reconfigurable surface cleaning apparatus of FIG. 28.

Referring to FIG. 27, in an above floor cleaning mode, valve 1650 may be adjusted (e.g. using lever 1652) to fluidly disconnect upflow duct 2120 from port 1038, and to fluidly connect the downstream end 1604 of flexible hose 1600 with port 1038, thereby forming an air flow path between dirty air inlet 1630 and cyclone air inlet 1120. Thus, dirty air inlet 1630 located at the upstream end 1802 of wand 1810 forms a dirty air inlet of the portable cleaning unit 1000.

It will be appreciated that some of the embodiments disclosed herein may not use any of the features of the relatively low air treatment member air inlet disclosed herein and that, in those embodiments, an air inlet of any kind known in the art may be used.

Reconfigurable Surface Cleaning Apparatus with Portable Assembly Having a Conduit Receiving the Upflow Duct The following is a description of different features of a reconfigurable surface cleaning apparatus with a relatively high cyclone air inlet. These features may be used by themselves in any surface cleaning apparatus or in any combination or sub-combination with any other feature or features described herein.

As in the embodiment of FIGS. 1 to 9, a reconfigurable upright surface cleaning apparatus may have an removable above floor cleaning unit or pod that has an inlet conduit that removably receives an upflow duct. Accordingly, as with previous embodiments, inserting a narrower upflow duct into the inlet conduit of the removable above floor cleaning unit permits some or all of the up flow air flow path (from the inlet port of the inlet conduit of the removable above floor cleaning unit to the inlet of the air treatment member) to be narrower so as to increase the velocity of air flow therein.

FIGS. 28 to 32 and FIGS. 32B and 32C exemplify such embodiments. The illustrated embodiments are generally similar to the embodiment illustrated in FIGS. 20 to 23, but with the internal components of the portable cleaning unit generally inverted. An advantage of this design is that the suction motor and/or one or more energy storage members of portable cleaning unit 1000 may be positioned closer to the floor surface S, which may assist in lowering the center of gravity of reconfigurable surface cleaning apparatus 100.

Figure 31:
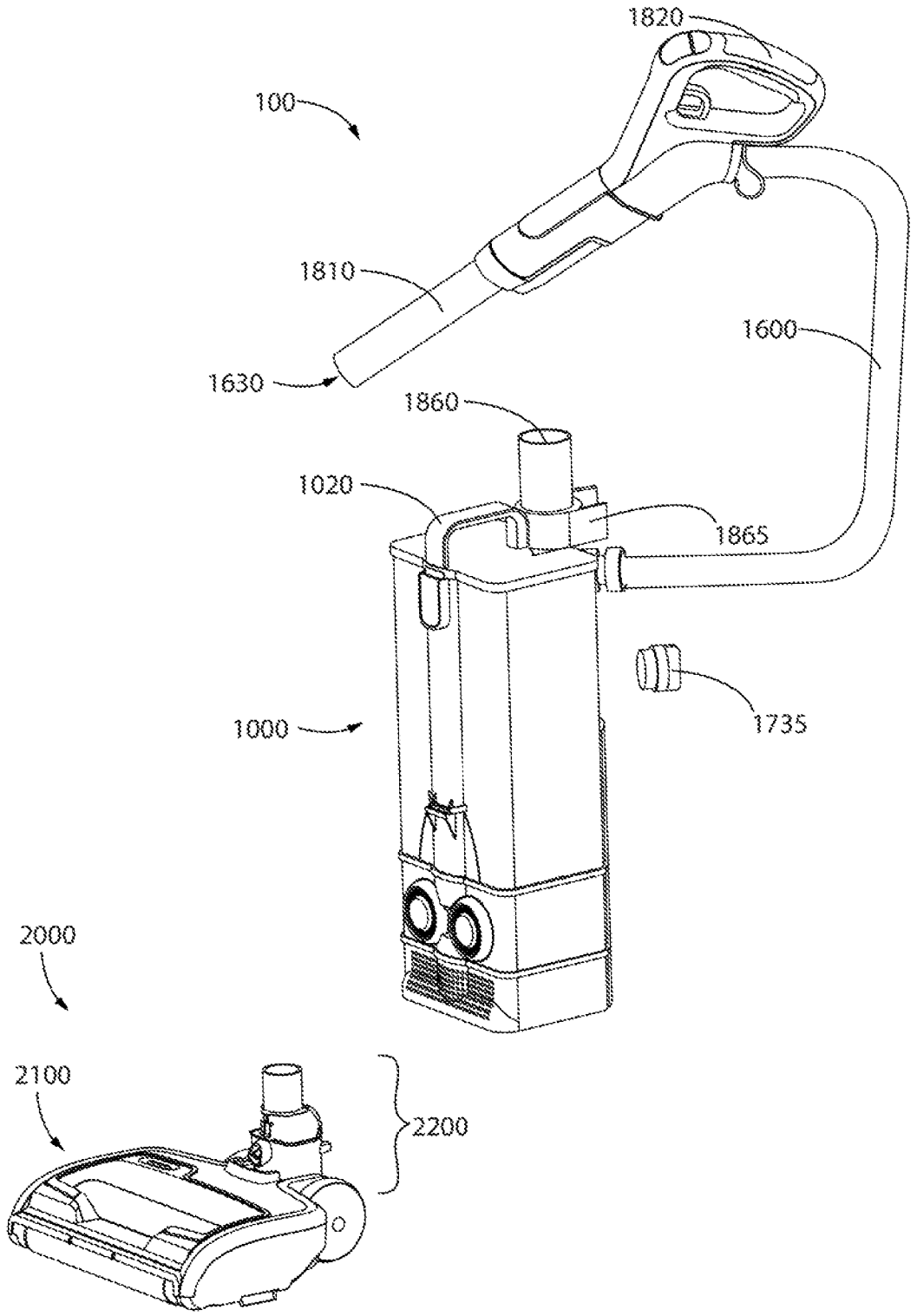
FIG. 31 is a perspective view of the reconfigurable surface cleaning apparatus of FIG. 28, with the portable cleaning unit disconnected from the floor cleaning unit and with a flexible hose coupled to an auxiliary air inlet.
Figure 32:
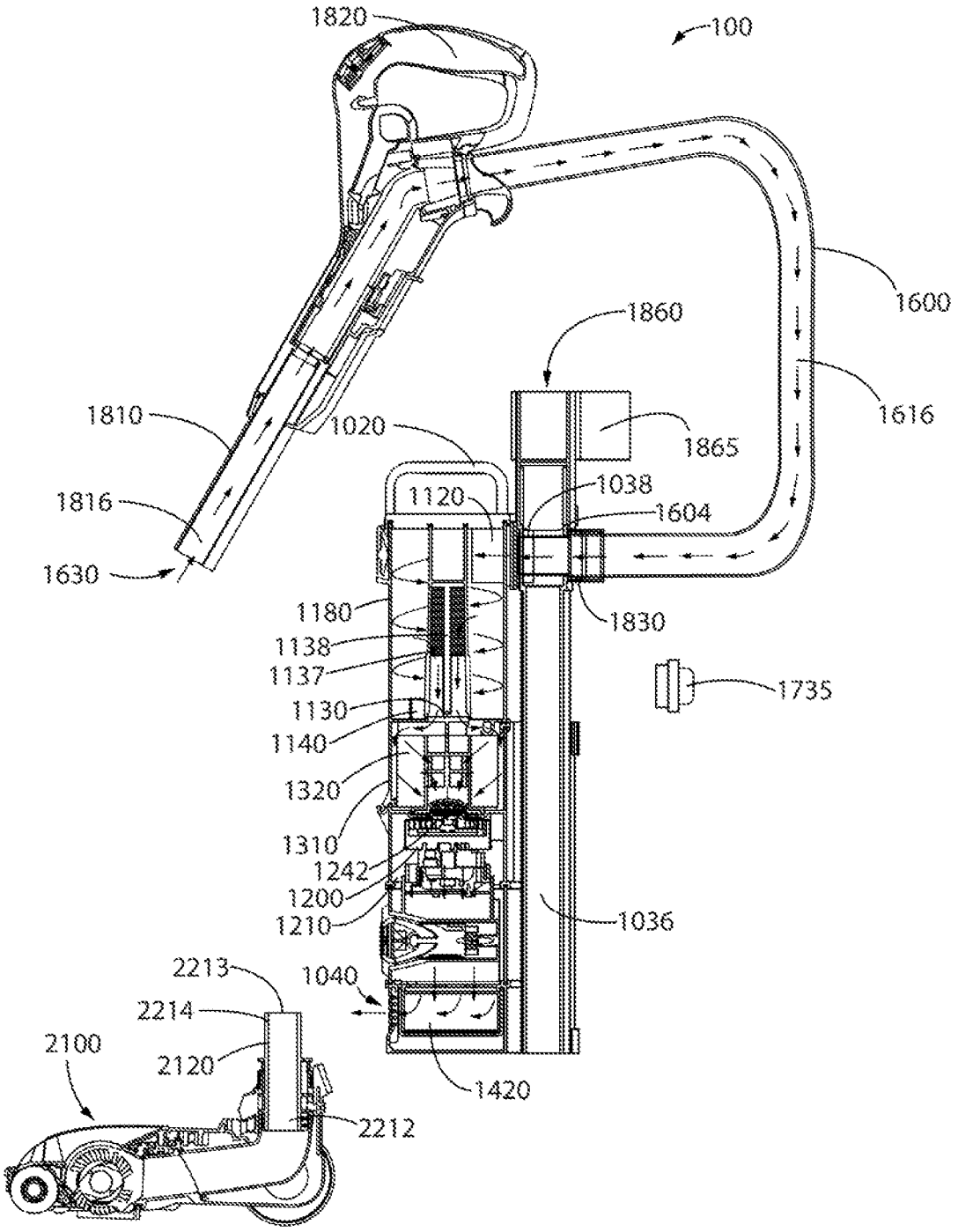
FIG. 32 is a cross-section view of the reconfigurable surface cleaning apparatus of FIG. 31.

In FIGS. 31 and 32, the reconfigurable surface cleaning apparatus is illustrated in an above floor cleaning mode. As exemplified in FIG. 25, in the above floor cleaning mode, when the suction motor 1200 of the portable cleaning unit is operated, air is drawn into the dirty air inlet 1630 of the wand 1810, through hose 1600, and through aperture 1038, thereby forming an air flow path between dirty air inlet 1630 and the cyclone air inlet 1120.

Figure 30:
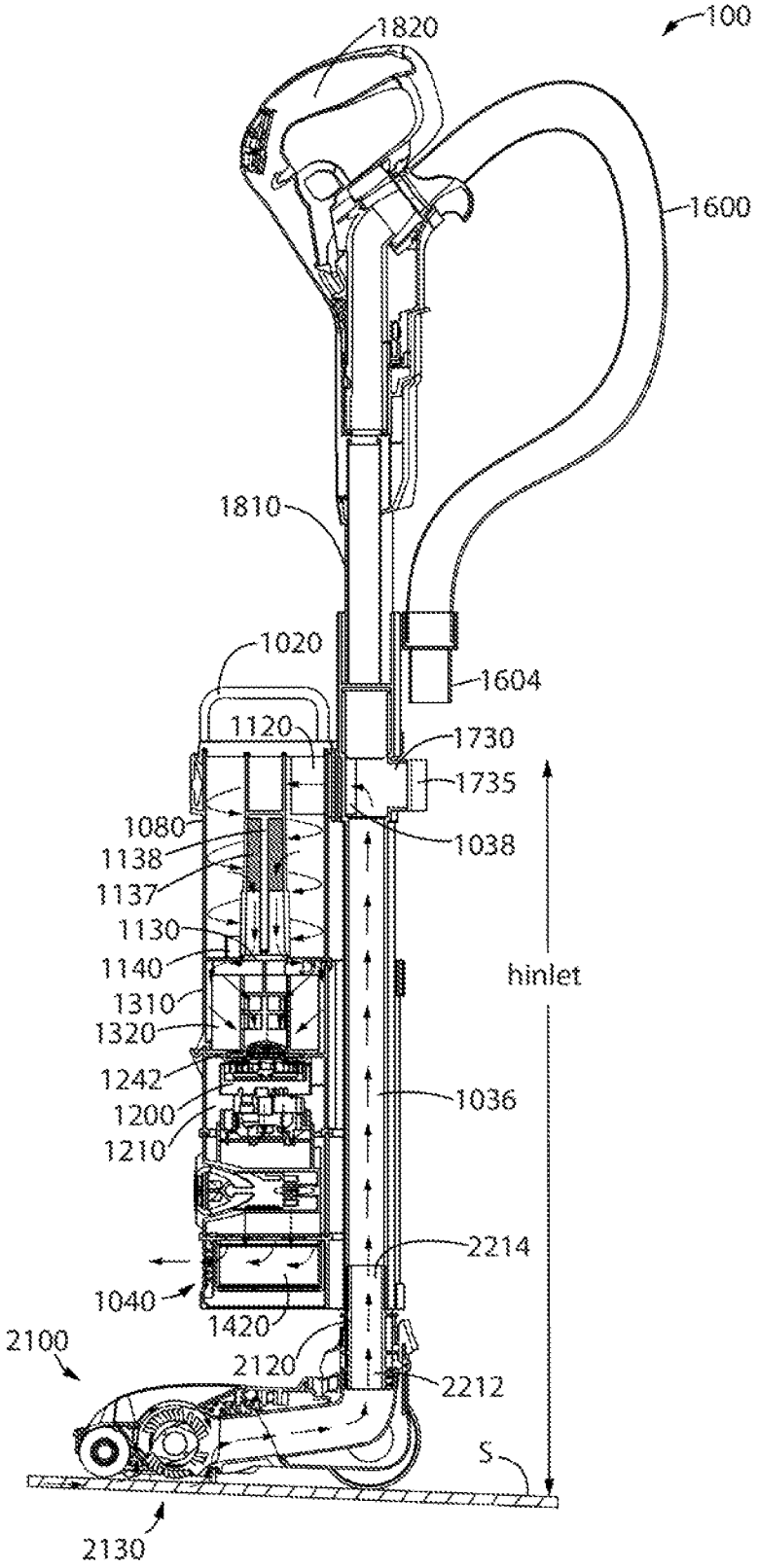
FIG. 30 is a cross-section view of the reconfigurable surface cleaning apparatus of FIG. 28.

As exemplified in FIG. 30, in a floor cleaning mode, when the suction motor of the portable cleaning unit is operated, air is drawn in through the dirty air inlet 2130 and through the body of the surface cleaning head 2100. Air then enters an upstream end 2212 of an upflow conduit or duct 2210, flows through the duct 2210, exits the downstream end 2214 of duct 2210, and enters the portable cleaning unit 1000. In portable cleaning unit 1000, the air is directed through the air treatment member, and to clean air outlet 1040.

Figure 32B:
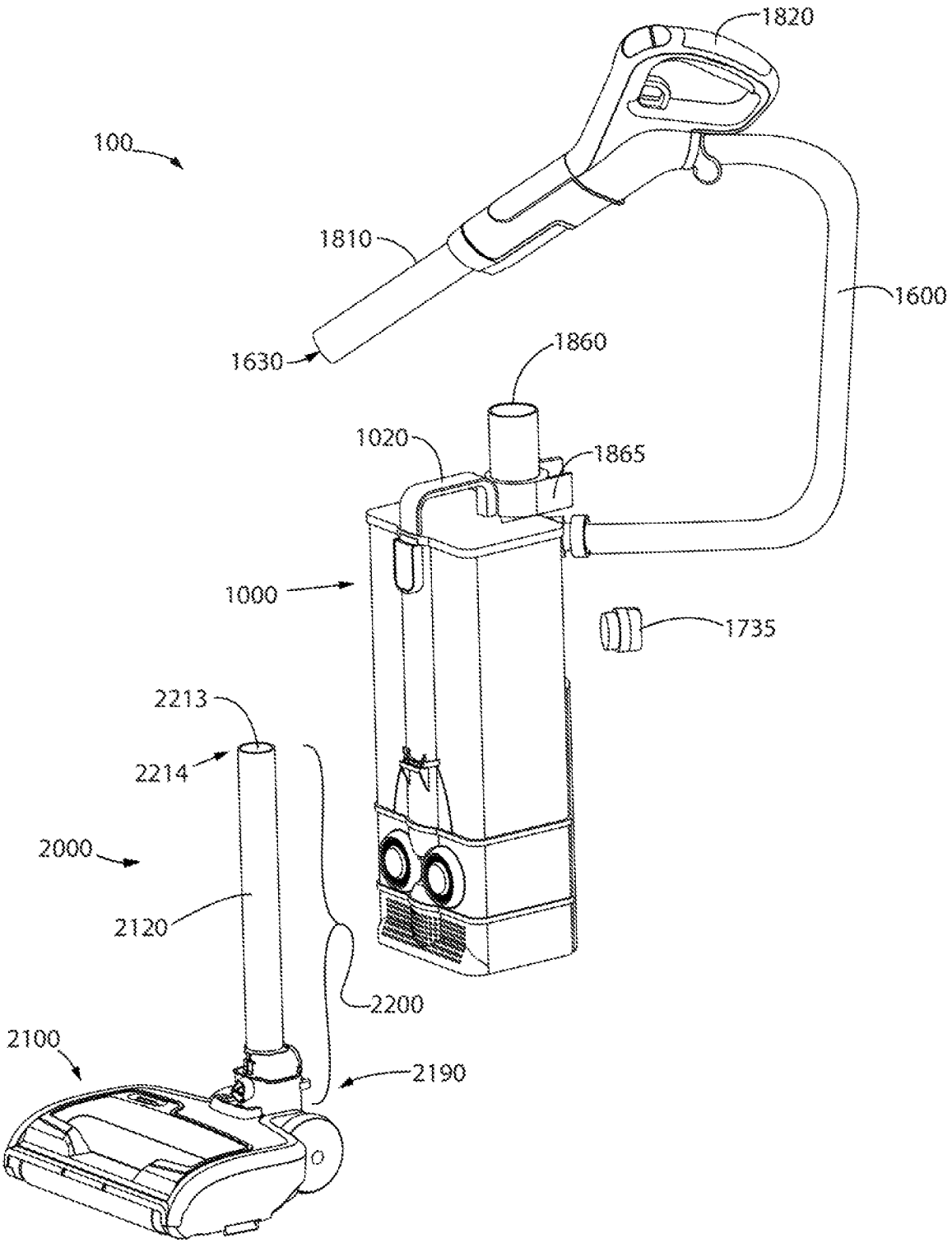
FIG. 32B is a perspective view of a reconfigurable surface cleaning apparatus in accordance with another embodiment, with the portable cleaning unit disconnected from the floor cleaning unit and with a flexible hose coupled to an auxiliary air inlet.
Figure 32C:
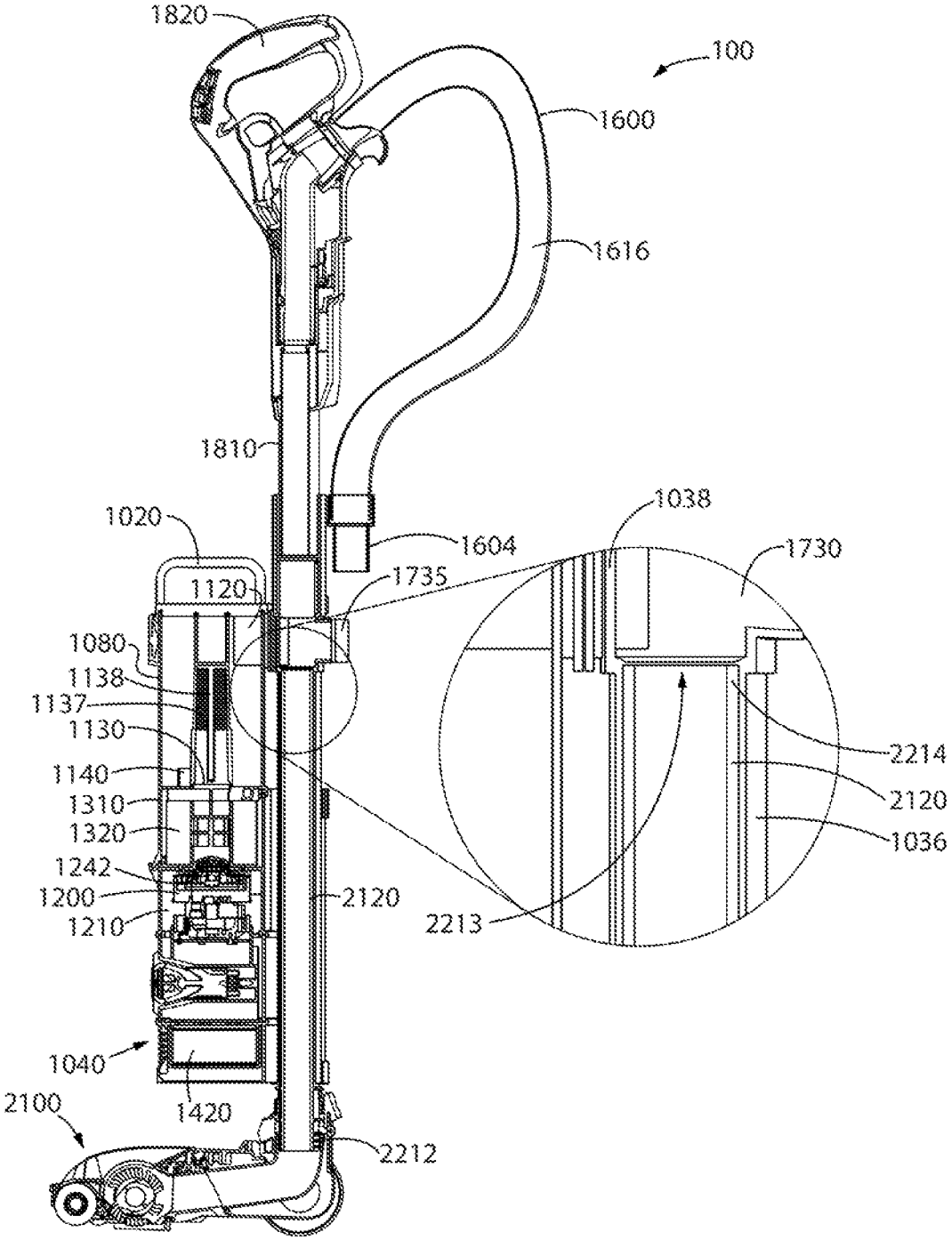
FIG. 32C is a cross-section view of the reconfigurable surface cleaning apparatus of FIG. 32B, with the portable cleaning unit mounted to the floor cleaning unit, and with the floor cleaning unit positioned in an upright storage position.

In the embodiment of FIGS. 32B and 32C, when portable cleaning unit 1000 is seated on upflow conduit or duct 2210, the downstream end 2214 extends through all of conduit 1036, and the downstream air outlet 2213 is positioned adjacent the air treatment air inlet 1120.

Reconfigurable Surface Cleaning Apparatus with Air Flow Conduit with Adjustable Flow Area The following is a description of different features of an air flow conduit with an adjustable flow area. These features may be used by themselves in any surface cleaning apparatus or in any combination or sub-combination with any other feature or features described herein.

In accordance with this aspect, an air flow conduit may be reconfigurable to have a different, e.g., diameter, to thereby change the cross-sectional area of at least a portion of the air flow path to an air treatment member (in a plane transverse to the direction of air flow through the air flow path). For example, when the reconfigurable surface cleaning apparatus is in a floor cleaning mode, at least a portion of an air flow conduit (e.g. an upflow duct) may be adjusted to provide a first cross-sectional area, and when the reconfigurable surface cleaning apparatus is in an above floor cleaning mode, that portion of the air flow conduit (e.g. which may be downstream of another portion of the air flow path in the above floor cleaning mode) may be adjusted to provide a second, larger cross-sectional area.

An advantage of such a configuration is that the flow area of a portion of the air flow path upstream of the air treatment member may be adjusted to be approximately equal to the flow area of another portion of the air flow path upstream of the air treatment member. For example, if in an above floor cleaning mode, the air flow path includes a flexible hose, the adjustable portion of the air flow conduit may be adjusted to provide a flow area that is approximately equal to the flow area of the hose.

In some embodiments, the ability to adjust a flow area of the air flow path may allow a user to affect the velocity of air flowing through the conduit, and thereby adjust the 'lifting power' and/or airflow performance (e.g. a relatively high mass transport rate) of the surface cleaning apparatus depending on the intended use of the surface cleaning apparatus, without adjusting the operating power of the suction motor.

Figure 34:
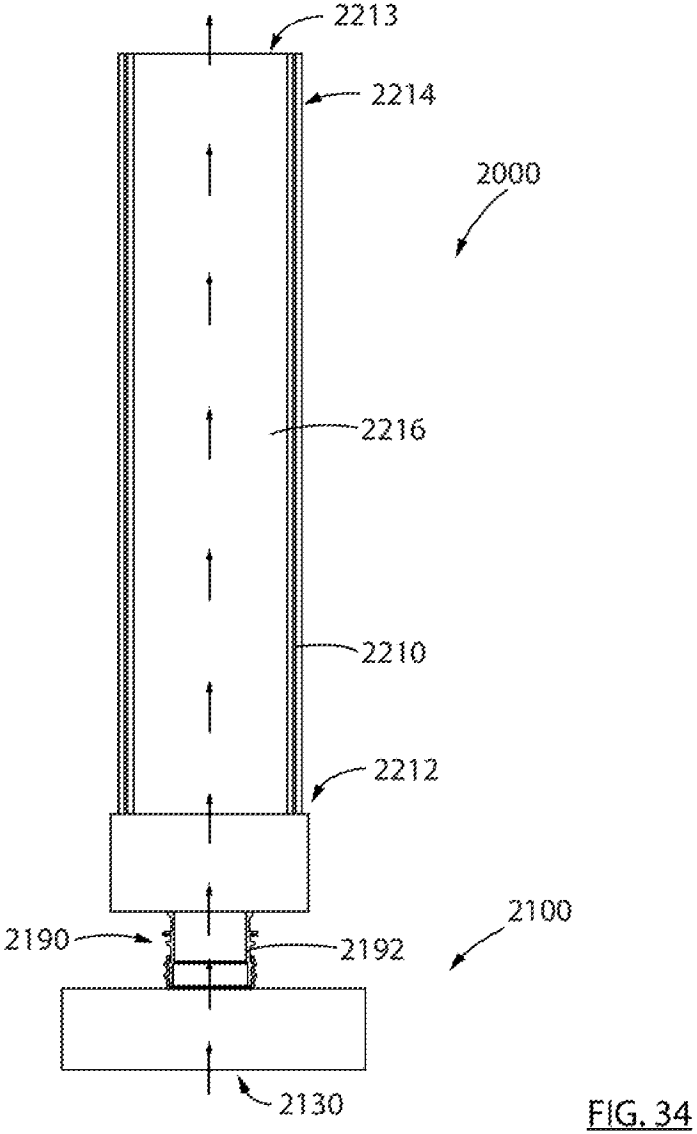
FIG. 34 is a schematic cross-section view of the floor cleaning unit of FIG. 33, with the upflow duct adjusted to provide a second, larger internal cross-sectional flow area.
Figure 33:
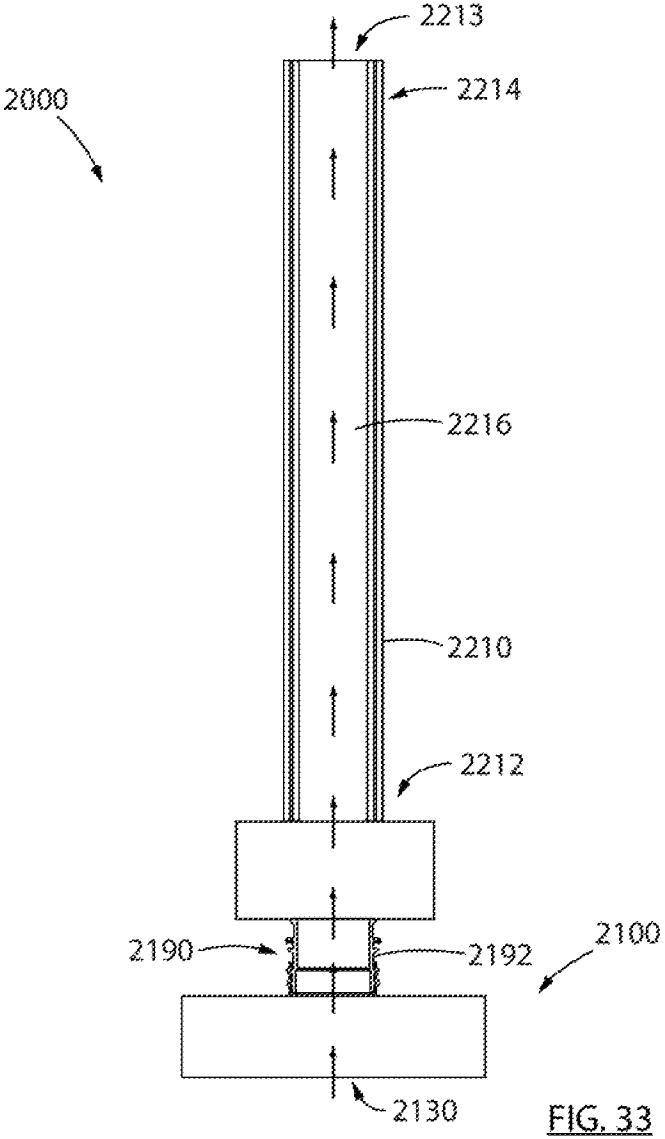
FIG. 33 is a schematic cross-section view of a floor cleaning unit that includes a reconfigurable upflow duct, with the upflow duct adjusted to provide a first internal cross-sectional flow area through the duct.

FIGS. 33 and 34 schematically illustrate an example embodiment of a floor cleaning unit 2000. In this illustrated embodiment, the floor cleaning unit includes a surface cleaning head 2100, with a dirty air inlet 2130 in airflow communication with a downstream end 2214 of upflow duct 2210 via a flexible conduit 2192 provided within pivotable joint 2190.

In FIG. 33, the interior 2216 of duct 2120 has a first cross-sectional area (in a plane transverse to a direction of air flowing through the duct). Based on this cross sectional area, when a suction motor of the surface cleaning apparatus is operated at a constant power level, air may travel through the upflow duct 2210 at a first velocity. This may offer improved 'lifting power' as compared to the configuration shown in FIG. 34.

In FIG. 34, the interior 2216 of duct 2120 has a second cross-sectional area that is greater than the cross-sectional area of the conduit in the configuration illustrated in FIG. 33. Based on this larger cross sectional area, when the suction motor of the surface cleaning apparatus is operated at the same power level, air may travel through the upflow duct 2210 at a second, lower velocity. This may offer improved airflow efficiency as compared to the configuration shown in FIG. 33.

In this way, without adjusting the power level at which a suction motor of the surface cleaning apparatus is operated, the cross-sectional flow area of the reconfigurable airflow conduit may be adjusted to promote a relatively high velocity of air flowing through the conduit, and thereby promote a relatively high 'lifting power' (e.g. in a floor cleaning mode, when this performance characteristic may be considered desirable). The cross-sectional flow area may also adjusted to promote a lower velocity of air through the conduit, and thereby promote improved airflow performance (e.g. mass transport rate and/or efficiency), e.g. in an above floor cleaning mode (when this performance characteristic may be considered desirable).

A conduit having an adjustable cross-sectional flow area may be of various constructions. For example, some or all of the sidewall of the conduit may be made or a resilient material (see for example the embodiment of FIGS. 35 to 40) or be of an expandable construction (e.g., an accordion section) or may comprise two longitudinally extending parts that have sidewalls that slide inwardly and outwardly in a direction transverse to the direction of air flow through the conduit (see for example the embodiment of FIGS. 47 to 52).

FIGS. 35 to 40 illustrate an example embodiment of an air flow conduit 2210 whose internal cross-sectional area (i.e. flow area) may be adjusted. In this example embodiment, conduit 2210 includes a resilient elastomeric conduit 2285 that has an outer surface adhered or otherwise coupled to a pair of rigid conduit frame members 2281 that substantially surround the conduit 2285.

Figures 35, 36, 37, 38:
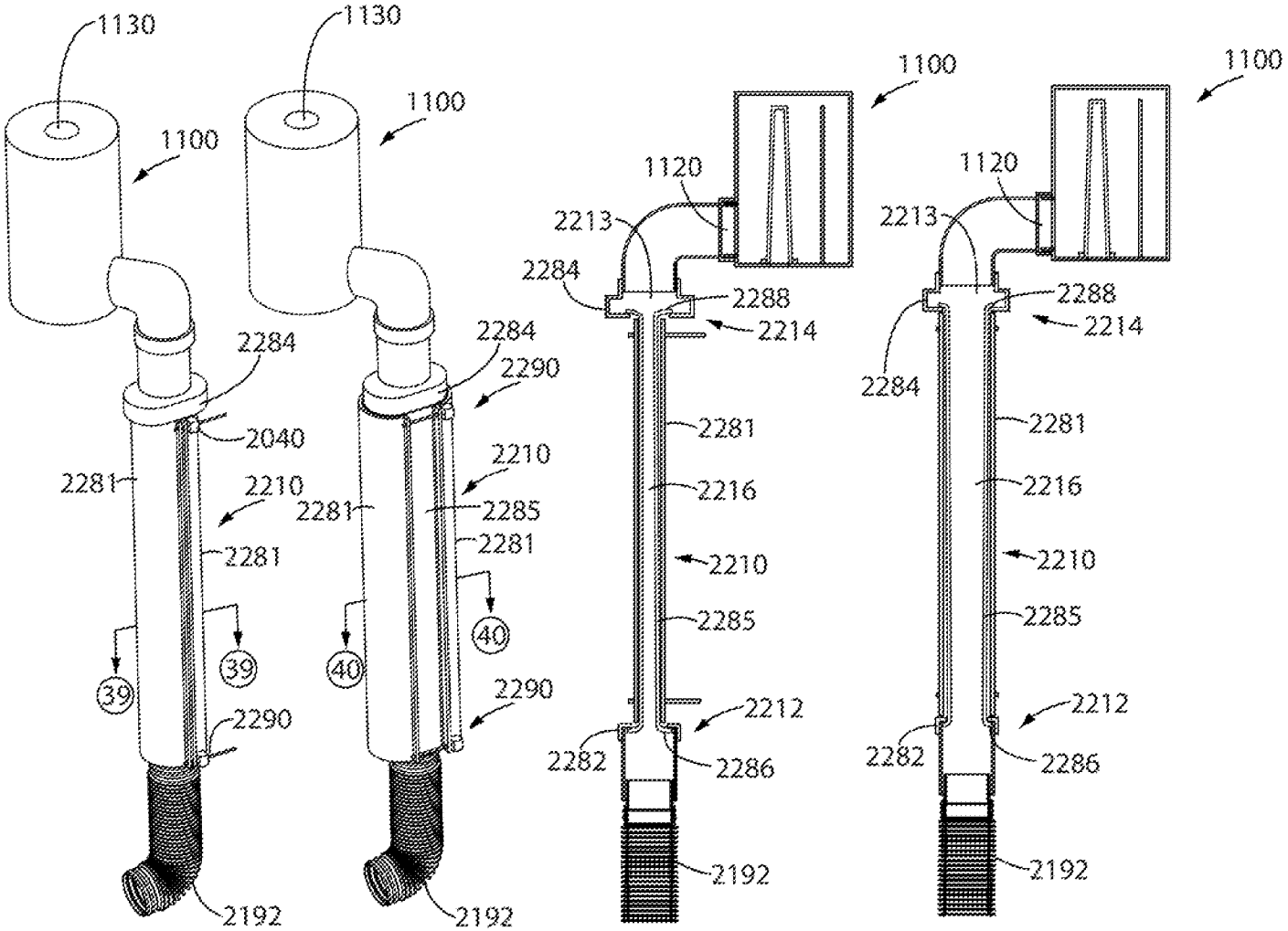
FIG. 35 is a schematic perspective view of an air treatment member and a reconfigurable upflow duct and in accordance with one embodiment, with the upflow duct in a relaxed state.
FIG. 36 is a schematic perspective view of the reconfigurable upflow duct and air treatment member of FIG. 35, with the upflow duct in an expanded state.
FIG. 37 is a schematic cross-section view of the reconfigurable upflow duct and air treatment member of FIG. 35, with the upflow duct in a relaxed state.
FIG. 38 is a schematic cross-section view of the reconfigurable upflow duct and air treatment member of FIG. 35, with the upflow duct in an expanded state.

As illustrated in FIGS. 37 and 38, the perimeter of a downstream end 2286 of the elastomeric conduit 2285 is sealingly coupled to a rigid downstream conduit block 2282, and the perimeter of an upstream end 2288 of the elastomeric conduit 2285 is sealingly coupled to a rigid upstream conduit block 2284. Accordingly, an airflow path between the interiors of blocks 2282, 2284 extends through the interior 2216 of elastomeric conduit 2285.

Figure 40:
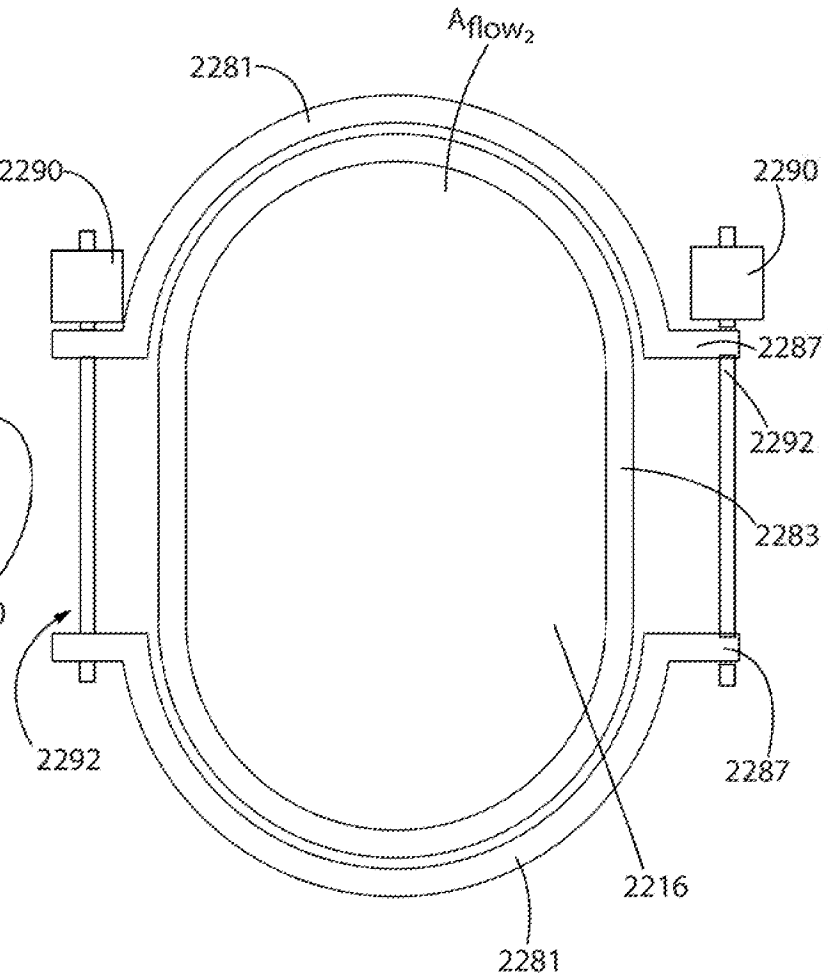
FIG. 40 is a longitudinal section view of the upflow duct of FIG. 36, taken along line 40-40 in FIG. 36.
Figure 39:
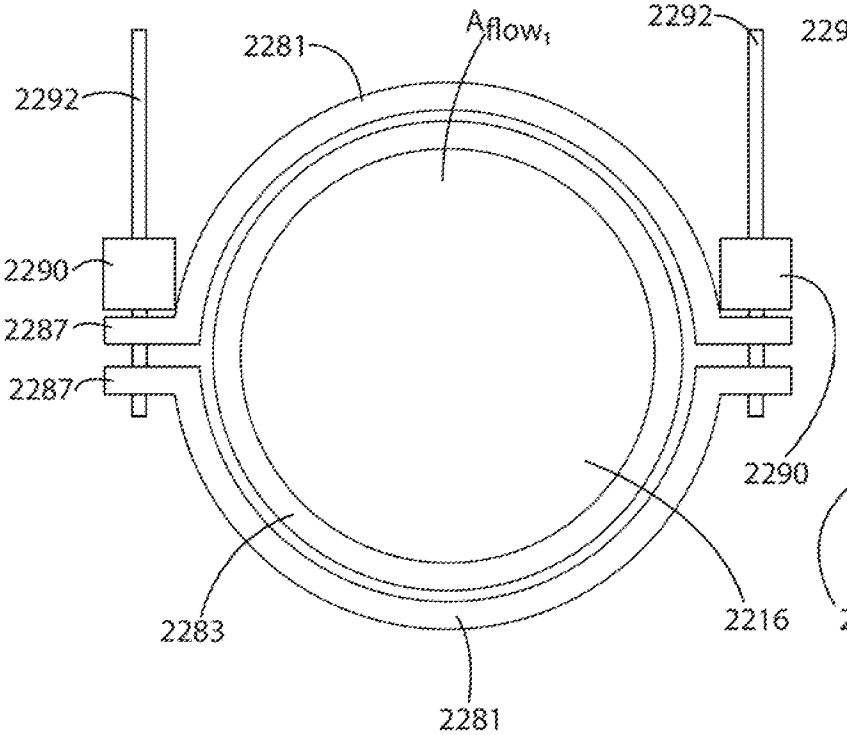
FIG. 39 is a longitudinal section view of the upflow duct of FIG. 35, taken along line 39-39 in FIG. 35.
Figures 41, 42, 43, 44:
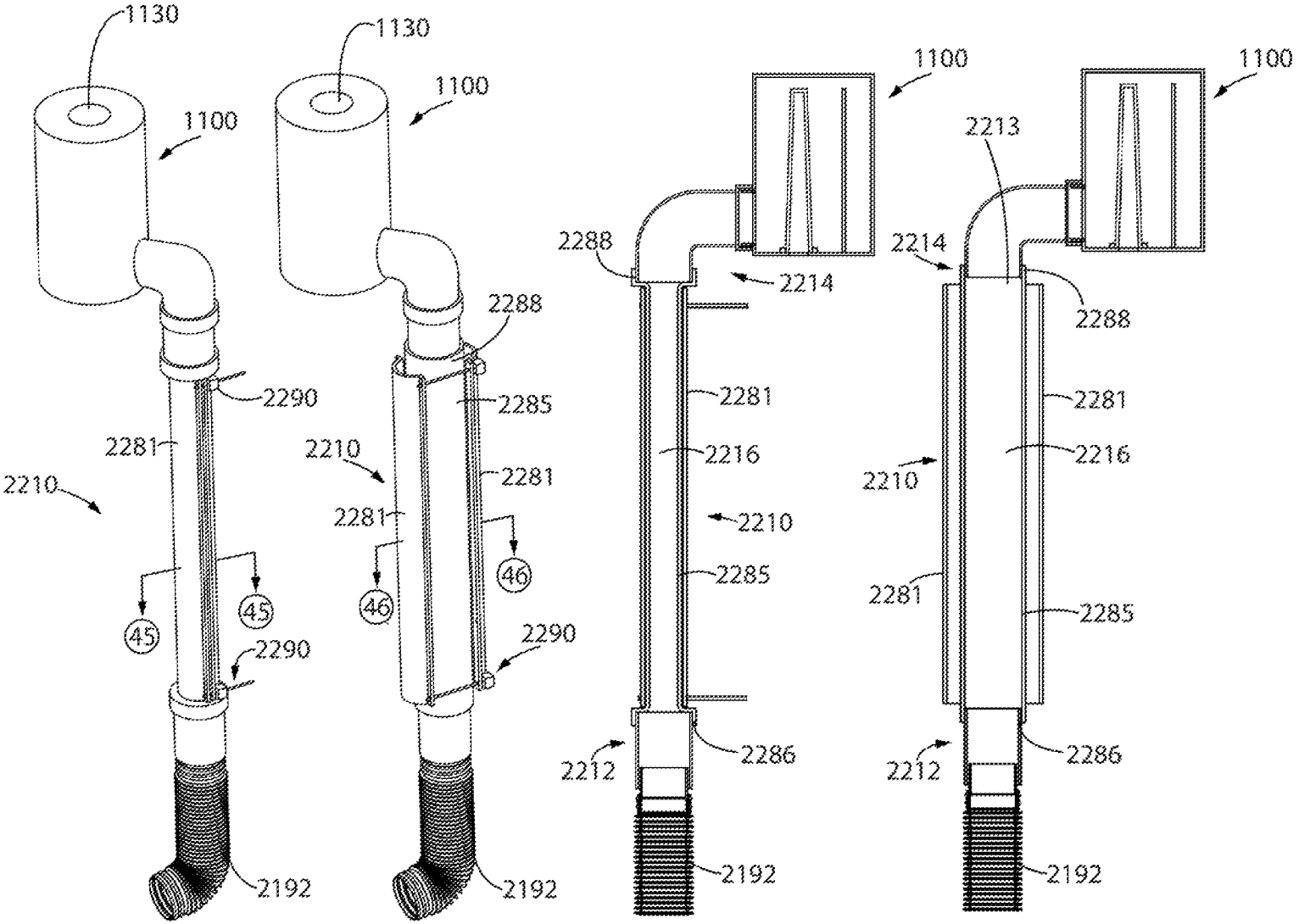
FIG. 41 is a schematic perspective view of an air treatment member and a reconfigurable upflow duct and in accordance with another embodiment, with the upflow duct in a compressed state.
FIG. 42 is a schematic perspective view of the reconfigurable upflow duct and air treatment member of FIG. 41, with the upflow duct in a relaxed state.
FIG. 43 is a schematic cross-section view of the reconfigurable upflow duct and air treatment member of FIG. 41, with the upflow duct in a compressed state.
FIG. 44 is a schematic cross-section view of the reconfigurable upflow duct and air treatment member of FIG. 41, with the upflow duct in a relaxed state.

The longitudinal ends of the frame members 2281 are slidingly coupled to the conduit blocks 2282, 2284, such that the frame members may be displaced laterally relative to the longitudinal axis of the elastomeric conduit 2285. For example, as illustrated in FIGS. 35, 37, and 39, when the frame members 2281 are laterally close together, the interior 2216 of elastomeric conduit 2285 may have a first a cross sectional area $A_{flow_1}$. Also, as illustrated in FIGS. 36, 38, and 40, when the frame members 2281 are displaced laterally outwardly, the interior 2216 of elastomeric conduit 2285 may have a second, larger cross sectional area $A_{flow_2}$. Thus, by moving the frame members 2281 laterally relative to each other, a cross-sectional flow area of the interior 2216 of elastomeric conduit 2285 may be varied.

The relative position of frame members 2281 may be adjusted using any suitable mechanism. In the illustrated example, electrically powered linear actuators 2290 that can selectively traverse actuator rails 2292 are coupled to outwardly protruding flanges 2287 of frame members 2281. Accordingly, actuators 2290 may be advanced along their respective rails 2292 in a first direction to urge the frame members 2281 towards each other, and may alternatively be advanced in a second, opposite direction to urge frame members 2281 away from each other.

It will be appreciated that any other suitable adjustment mechanism(s) may be provided to control the relative positioning of frame members 2281. For example, a mechanical member may interact with the conduit as the surface cleaning apparatus is reconfigured between the floor cleaning mode and an above floor cleaning mode. If the conduit is biased to the contracted (narrower flow area) configuration, then insertion of a hose into the inlet of the conduit may drive the conduit to an expanded (larger flow area) configuration. If the conduit is biased to the expanded configuration, then mounting the portable unit on the surface cleaning head may drive the conduit to the contracted configuration. For example, the surface cleaning head (e.g., the upflow duct) may have a member (e.g., a lever or a cam member) that engages a part of the conduit (e.g., a cam surface or apart of the exterior of the conduit) to drive the conduit to the contracted configuration. Alternatively, the duct may be manually adjustable by a user.

In the example illustrated in FIGS. 35 to 40, resilient conduit 2285 is biased towards a relatively narrow state (contracted configuration) with a relatively small internal cross-sectional area (e.g. as illustrated in FIG. 39), and may be stretched outwardly to an expanded state (e.g. as illustrated in FIG. 40) by laterally displacing frame members 2281 away from each other, e.g., by inserting a part of another conduit therein, such as the inlet end of a hose, crevice tool of the like.

Figure 46:
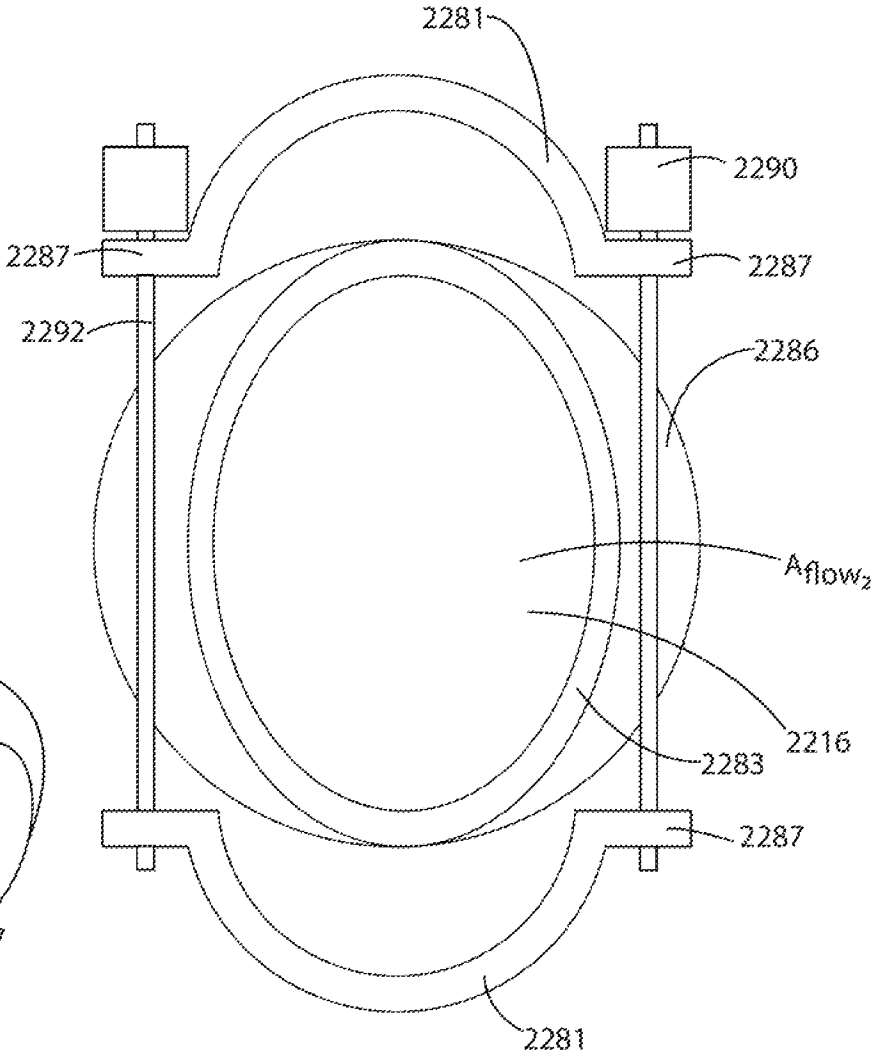
FIG. 46 is a longitudinal section view of the upflow duct of FIG. 42, taken along line 46-46 in FIG. 42.
Figure 45:
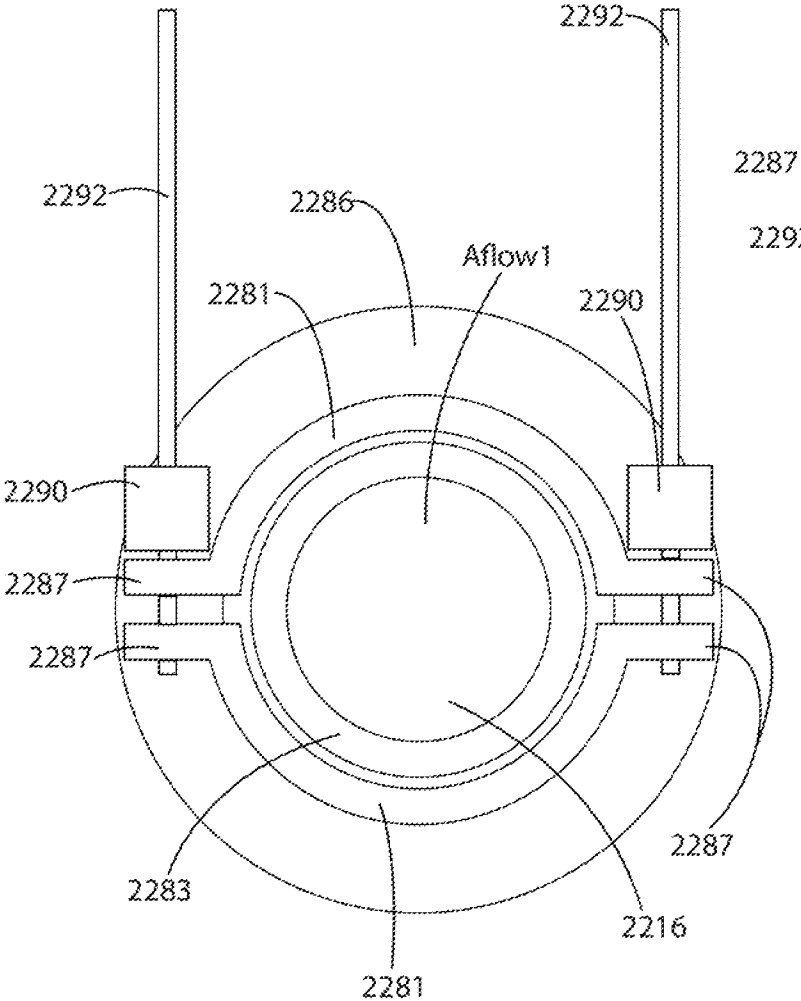
FIG. 45 is a longitudinal section view of the upflow duct of FIG. 41, taken along line 45-45 in FIG. 41.

FIGS. 41 to 46 illustrate another example embodiment of an air flow conduit 2210 whose internal cross-sectional area (i.e. flow area) may be adjusted. In this example embodiment, resilient elastomeric conduit 2285 is biased towards a relatively wide state (expanded configuration) with a relatively large internal cross-sectional area (e.g. as illustrated in FIG. 46), and may be compressed inwardly to a compressed state (e.g. as illustrated in FIG. 45) by laterally displacing frame members 2281 towards each other (e.g. as illustrated in FIG. 40), such as by a cam member that engages an outer surface of the adjustable conduit, which may be provided on an upflow duct that is received in the conduit in the floor cleaning configuration. An advantage of this design is that it may not be necessary to adhere (or otherwise secure) elastomeric conduit 2285 to frame members 2281. Additionally, or alternatively, the ends 2286, 2288 of elastomeric conduit 2285 may be more easily sealed to upstream and downstream portions of the airflow path than in the example illustrated in FIGS. 35-40.

FIGS. 47 to 52 illustrate another example embodiment of an air flow conduit 2210 whose cross-sectional area (i.e. flow area) may be adjusted. In this example embodiment, conduit 2210 includes a first rigid conduit frame member 2281A and a second rigid conduit frame member 2281B that cooperatively define an interior passage 2216 therebetween. In the illustrated example, at least a portion of conduit frame member 2281B is nested within conduit frame member 2281A. At least two longitudinally extending sealing members or gaskets 2289 are preferably provided between overlapping portions of the conduit members to enhance the airtightness of the passage 2216.

Figures 47, 48, 49, 50:
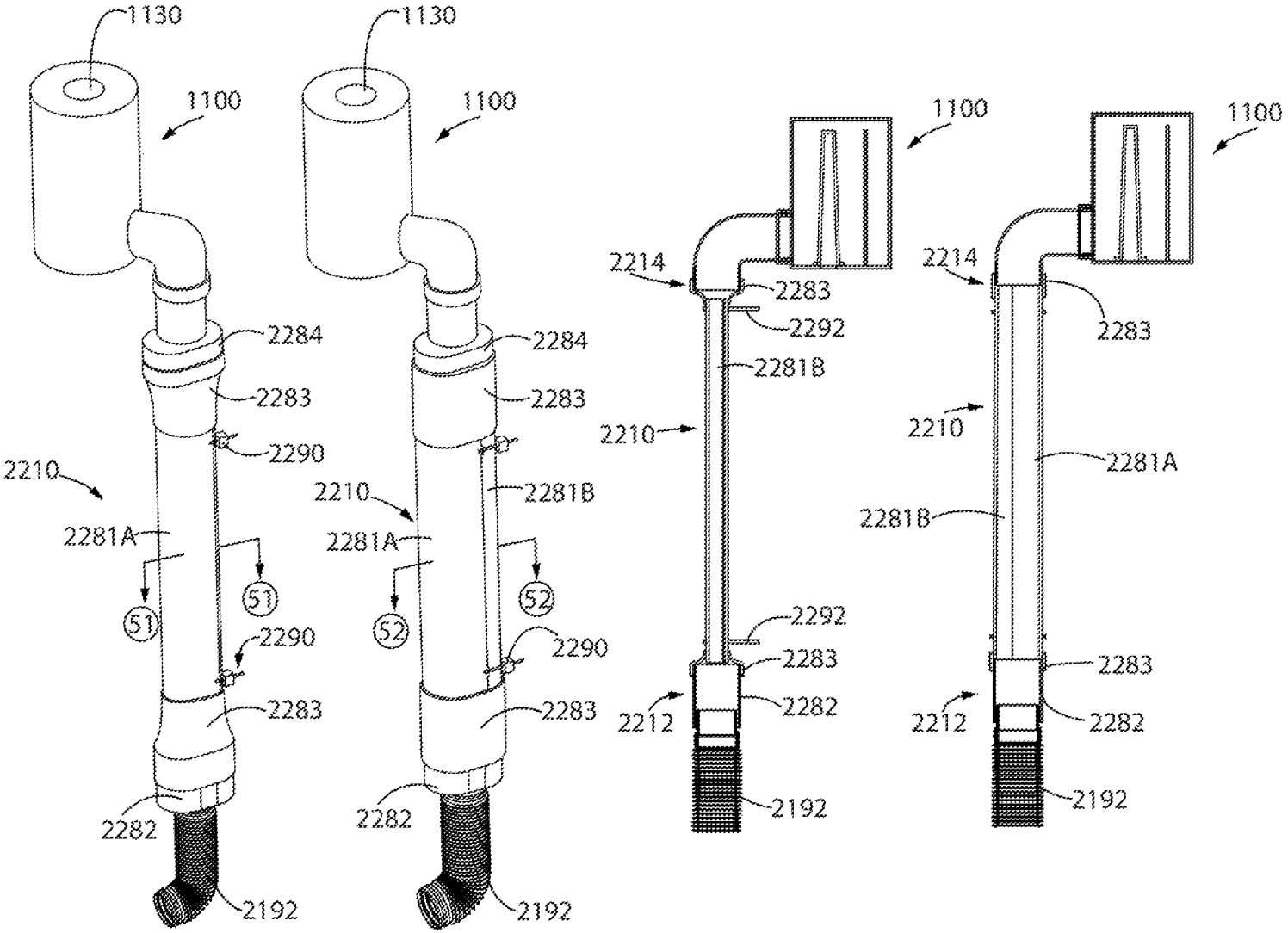
FIG. 47 is a schematic perspective view of an air treatment member and a reconfigurable upflow duct and in accordance with another embodiment, with the upflow duct in a contracted state.
FIG. 48 is a schematic perspective view of the reconfigurable upflow duct and air treatment member of FIG. 47, with the upflow duct in an expanded state.
FIG. 49 is a schematic cross-section view of the reconfigurable upflow duct and air treatment member of FIG. 47, with the upflow duct in a contracted state.
FIG. 50 is a schematic cross-section view of the reconfigurable upflow duct and air treatment member of FIG. 47, with the upflow duct in an expanded state.
Figure 52:
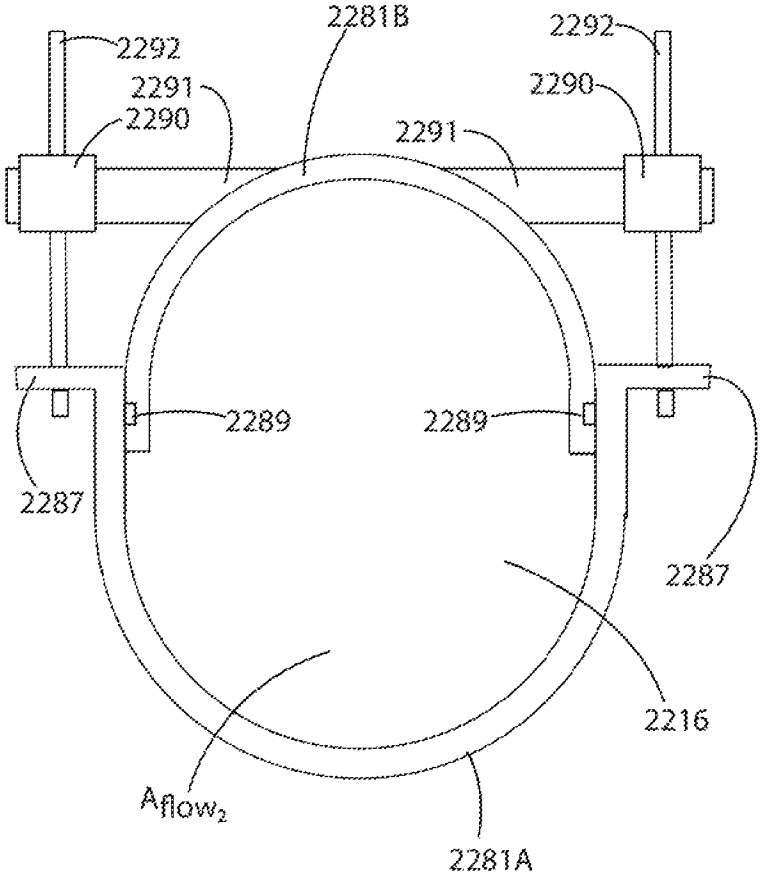
FIG. 52 is a longitudinal section view of the upflow duct of FIG. 48, taken along line 52-52 in FIG. 48.
Figure 51:
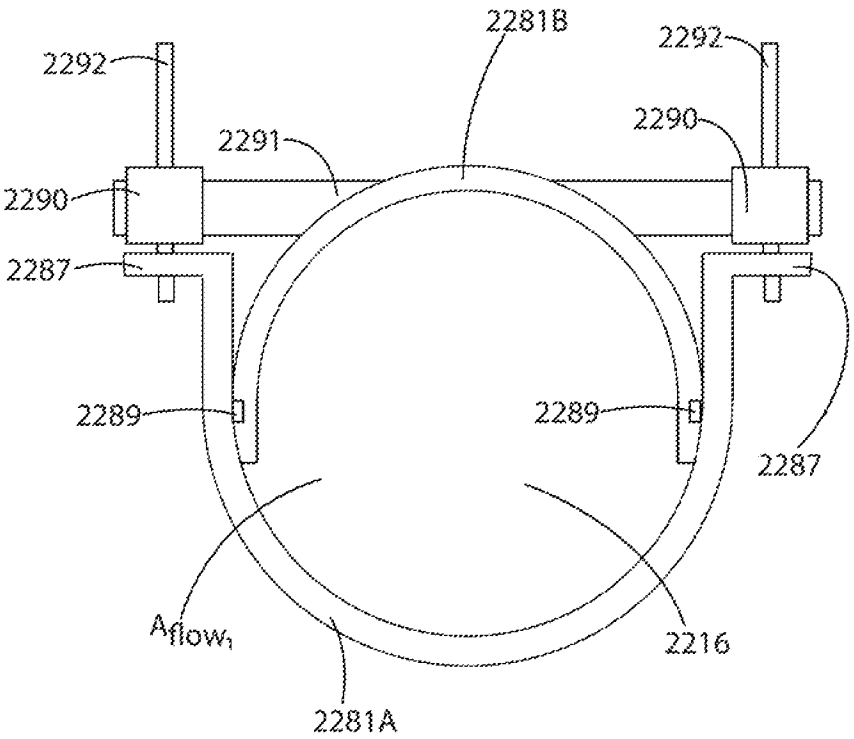
FIG. 51 is a longitudinal section view of the upflow duct of FIG. 47, taken along line 51-51 in FIG. 47.

As illustrated in FIGS. 47 and 48, the longitudinal ends of the frame members 2281A, 2281B may be slidingly coupled to conduit blocks 2282, 2284, such that the frame members may be displaced laterally relative to the longitudinal axis of the conduit 2210. For example, as illustrated in FIGS. 47, 49, and 51, when the conduit frame members 2281A, 2281B are laterally close together, the interior space 2216 defined between the conduit frame members 2281A, 2281B may have a first a cross sectional area $A_{flow_1}$. Also, as illustrated in FIGS. 48, 50, and 52, when the conduit frame members 2281A, 2281B are displaced laterally outwardly, the interior passage 2216 may have a second, larger cross sectional area $A_{flow_2}$. Thus, by moving the conduit frame members 2281A, 2281B laterally relative to each other, a cross-sectional flow area of the interior passage 2216 within conduit 2210 may be varied.

As illustrated in FIGS. 47 and 48, resilient elastomeric collars 2283 may be provided at the longitudinal ends of the conduit frame members 2281A, 2281B to sealingly couple the conduit frame members to conduit blocks 2282, 2284.

Notably, the configuration illustrated schematically in FIGS. 47 to 52 does not require an elastomeric conduit extending between the upstream end 2212 and the downstream end 2214 of conduit 2210. Optionally, an internal elastomeric conduit may be provided in order to enhance the airtightness of the passage 2216.

Figure 53:
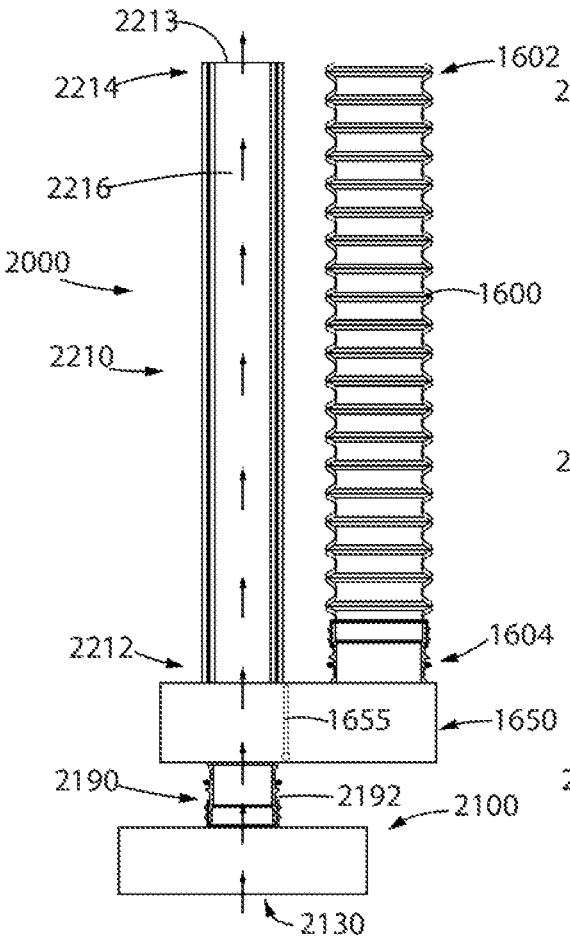
FIG. 53 is a schematic cross-section view of a floor cleaning unit that includes a reconfigurable upflow duct and a hose, with the upflow duct adjusted to provide a first internal cross-sectional flow area through the duct.
Figure 54:
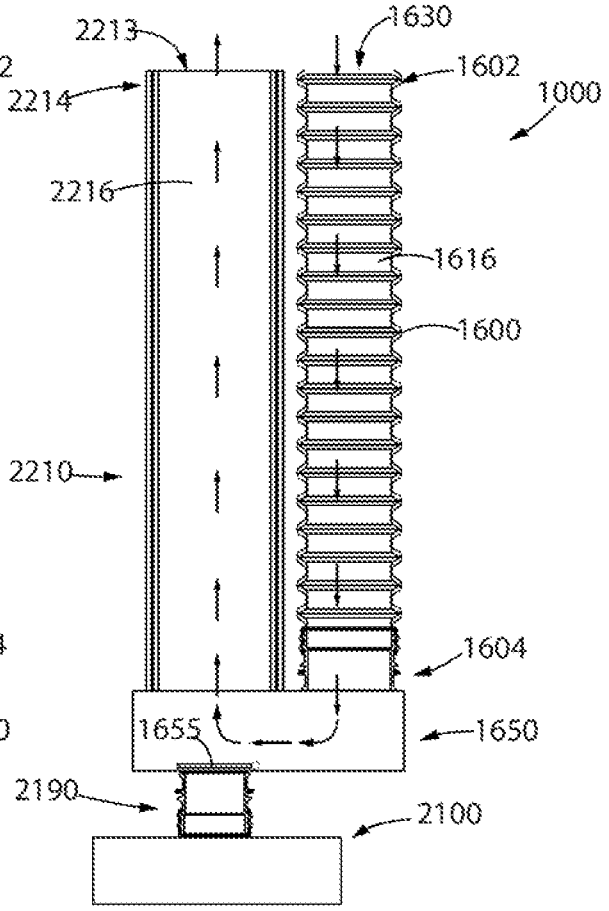
FIG. 54 is a schematic cross-section view of the floor cleaning unit of FIG. 53, with the upflow duct adjusted to provide a second, larger internal cross-sectional flow area.

FIGS. 53 and 54 schematically illustrate another example embodiment of a floor cleaning unit 2000. In this illustrated embodiment, the floor cleaning unit includes a surface cleaning head 2100, with a dirty air inlet 2130 in airflow communication with a downstream end 2214 of upflow duct 2210 via a valve block 1650. A downstream end 1604 of a flexible hose 1600 is also in fluid communication with valve block 1650.

Valve block 1650 is operable to selectively fluidly connect dirty air inlet 2130 or dirty air inlet 1630 of hose 1600 with the air outlet 2213 of upflow conduit or duct 2210. For example, as illustrated in FIG. 53, in a floor cleaning mode valve block 1650 may be adjusted (e.g. by pivoting door 1655) to provide airflow communication between dirty air inlet 2130 and downstream end 2214 of upflow duct 2210, while inhibiting or preventing airflow communication between upflow duct 2210 and hose 1600.

Also, in this configuration of a floor cleaning mode, duct 2120 has been adjusted so that interior 2216 has a relatively small cross-sectional area, which may promote a relatively high velocity of air, and thereby promote improved 'lifting power', through the duct 2120.

As illustrated in FIG. 54, in an above floor cleaning mode valve block 1650 may be adjusted (e.g. by pivoting door 1655) to provide airflow communication between dirty air inlet 1630 of hose 1600 and downstream end 2214 of upflow duct 2210, while inhibiting or preventing airflow communication between upflow duct 2210 and the surface cleaning head 2100.

Also, in this configuration of an above floor cleaning mode, duct 2120 has been adjusted so that interior 2216 has a relatively large cross-sectional area, which may promote a relatively lower velocity of air, and thereby promote improved airflow efficiency through the duct 2120.

It will be appreciated that the valve, or the valve actuator, may be drivingly connected to duct 2210 such that the flow area of duct 2210 is adjusted as the valve is actuated between the floor and above floor cleaning modes.

An advantage of this configuration of a floor cleaning unit is that the expected velocity of air in the air flow path through the floor cleaning unit (e.g. upstream of the air treatment member) may be adjusted without adjusting the power level at which a suction motor of the surface cleaning apparatus is operated.

Another advantage of this configuration is that the flow area of airflow conduit 2210 may be adjusted based on the mode of operation of the surface cleaning apparatus. For example, in an above floor cleaning mode, the internal flow area of upflow duct 2210 may be adjusted to be approximately equal to an internal flow area of hose 1600. Such a configuration may have one or more advantages. For example, this may reduce backpressure and/or otherwise improve the efficiency of airflow through the reconfigurable surface cleaning apparatus in the above floor cleaning mode.

It will be appreciated that some of the embodiments disclosed herein may not use any of the features of the adjustable area air conduit disclosed herein and that, in those embodiments, an air inlet of any kind known in the art may be used.

Surface Cleaning Head with a Reconfigurable Air Inlet Passage

The following is a description of different features of a surface cleaning head that include a reconfigurable dirty air inlet. These features may be used by themselves in any surface cleaning apparatus or in any combination or sub-combination with any other feature or features described herein.

Alternatively, or in addition to changing the flow area of the air flow path between the surface cleaning head and the air treatment member, the flow area through part or all of the surface cleaning head may be adjustable. Accordingly, at least the upstream portion of the dirty air inlet passage may be reconfigurable to vary its cross-sectional flow area (i.e. a cross-sectional area in a plane transverse to a direction of air flowing through the inlet). By changing the cross-sectional flow area, the expected velocity of air flowing through the dirty air inlet may be adjusted without adjusting the power level at which a suction motor of the surface cleaning apparatus is operated. For example, in the floor cleaning mode, if it is required to pick up heavier or denser dirt or debris, a user may actuate a control or switch to narrow the inlet flow passage in the surface cleaning head.

Figure 55:
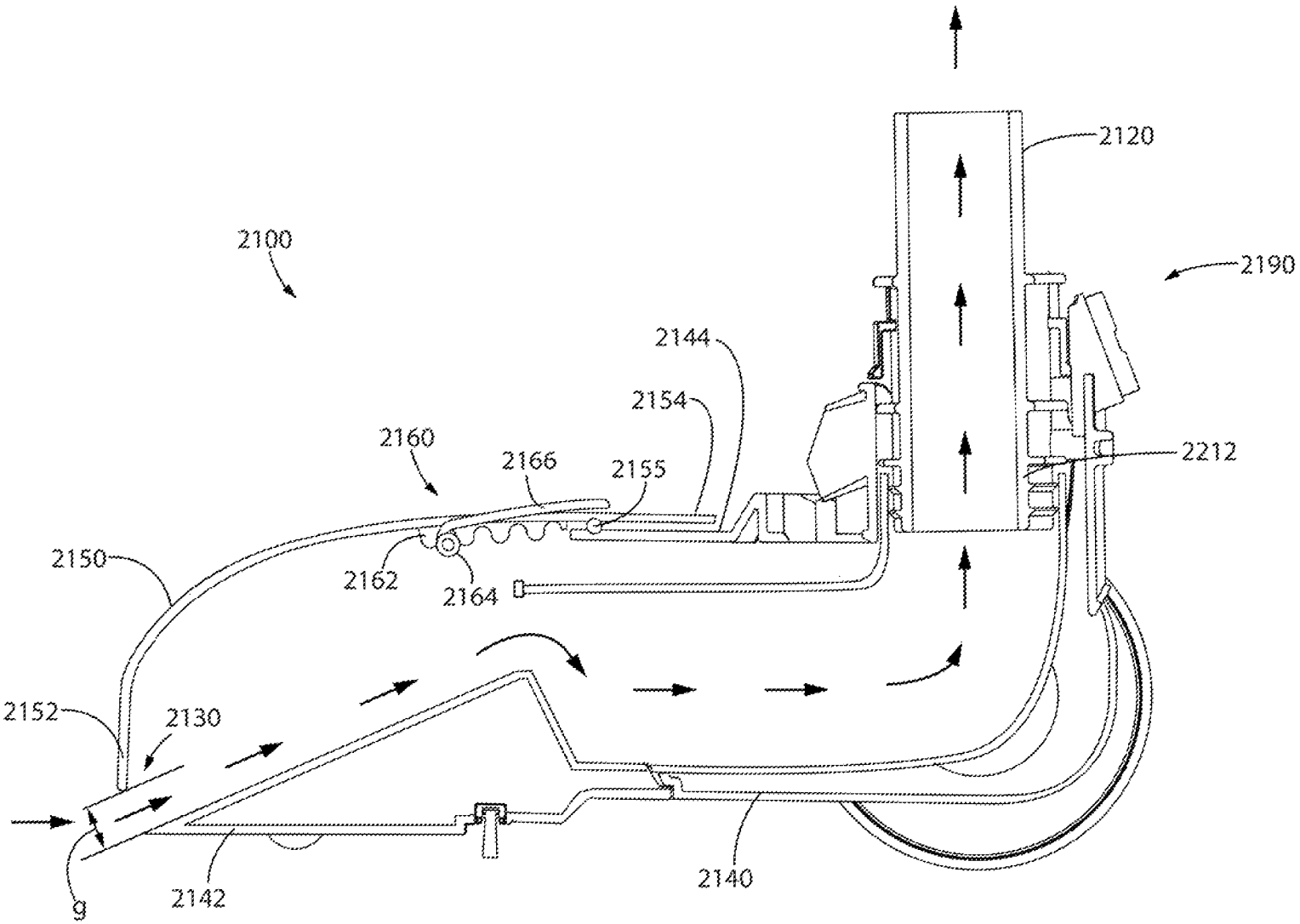
FIG. 55 is a schematic cross-section view of a surface cleaning head with a reconfigurable dirty air inlet in accordance with one embodiment, with the surface cleaning head in a first configuration.
Figure 56:
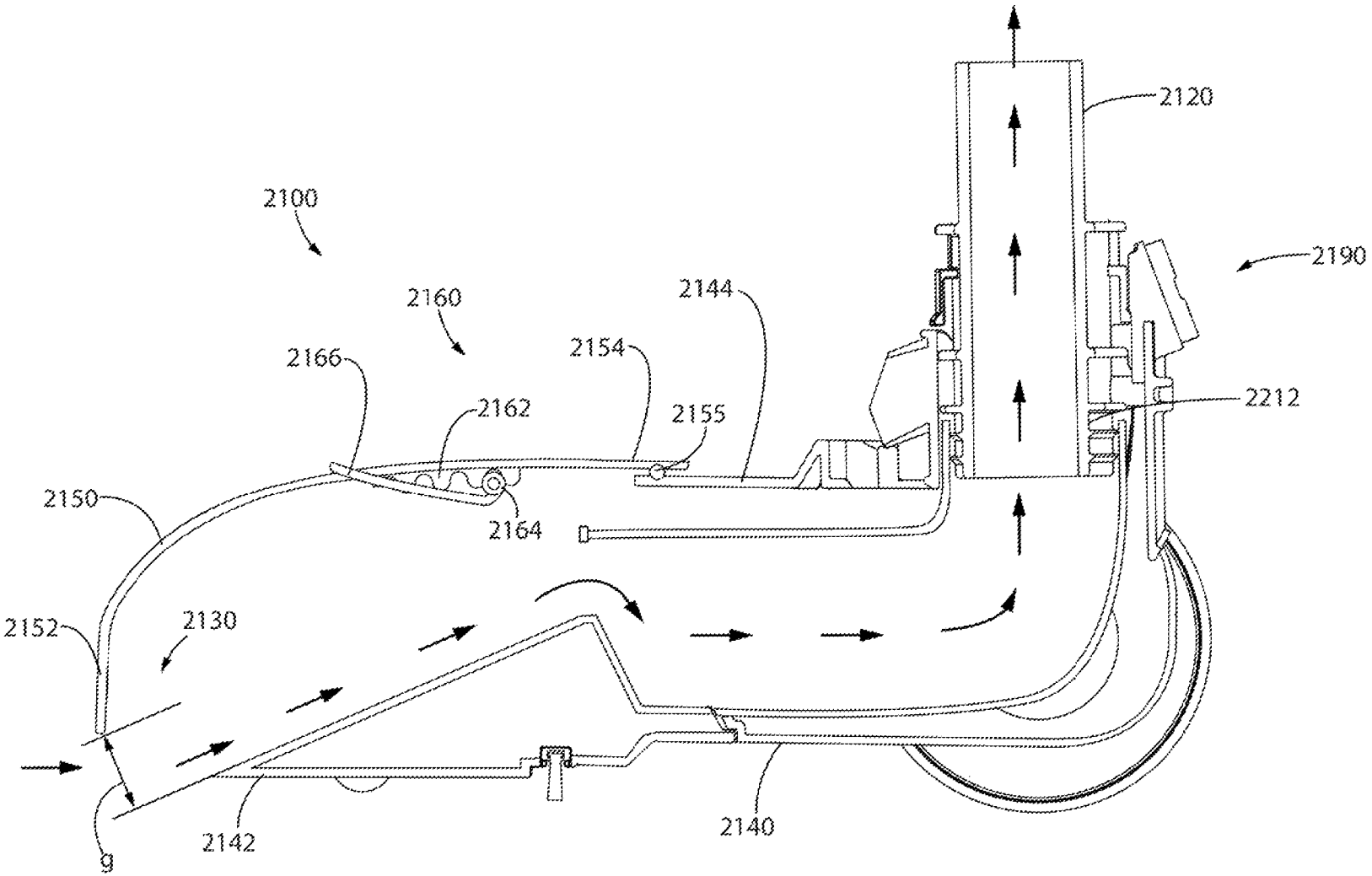
FIG. 56 is a schematic cross-section view of the surface cleaning head of FIG. 55, with the surface cleaning head in a second configuration.

FIGS. 55 and 56 schematically illustrate an example embodiment of a surface cleaning head 2100. In this illustrated embodiment, the surface cleaning head includes a main body 2140 and a repositionable cover plate 2150. Main body 2140 and repositionable cover plate 2150 cooperatively define an upstream portion of the air flow path extending from dirty air inlet 2130 to an upstream end 2212 of an upflow conduit or duct 2210.

In the illustrated example, main body 2140 and repositionable cover plate 2150 also cooperatively define a dirty air inlet 2130 of surface cleaning head 2100. Specifically, a lower edge 2152 of cover plate 2150 and a forward edge 2142 of main body 2140 cooperatively define a dirty air inlet 2130. Inlet 2130 is shown schematically as having a length g and may extend across most or substantially all of the width of surface cleaning head 2100. Accordingly, the cross-sectional flow area of dirty air inlet 2130 may be approximated by multiplying the distance g by the width of the dirty air inlet 2130.

Cover plate 2150 may be repositioned relative to main body 2140, thereby altering the cross-sectional flow area of dirty air inlet 2130. For example, in FIG. 56, cover plate 2150 has been moved forwardly relative to main body main body 2140, thereby increasing the length g, and therefore the cross-sectional flow area of dirty air inlet 2130 may be increased (as the width of the dirty air inlet 2130 may remain substantially constant).

Cover plate 2150 may be repositioned in any suitable manner. For example, in the illustrated embodiment, rack and pinion mechanism 2160 is used, with a pinion 2164 being pivotable using a lever arm 2166, and a rack 2162 secured to an underside of cover plate 2150. It will be appreciated that other mechanisms may be used in one or more alternative embodiments.

Preferably, one or more sealing members are provided to inhibit or prevent airflow losses between dirty air inlet 2130 and the upstream end 2212 of duct 2210. In the embodiment illustrated in FIGS. 55 and 56, an elastomeric gasket 2155 is provided between an upper flange 2144 of main body 2140 and a rear end 2154 of cover plate 2150 that overlies the flange 2144. Preferably, the gasket 2155 extends along most, and preferably substantially all of the width of the overlapping flange 2144 and end 2154. It will be appreciated that additional and/or alternative sealing members may be used in one or more alternative embodiments.

Optionally, surface cleaning head 2100 may be reconfigurable to selectively permit airflow through one of a plurality of dirty air inlets. By changing between dirty air inlets with different cross-sectional flow areas, the expected velocity of air flowing into the surface cleaning head may be adjusted without adjusting the power level at which a suction motor of the surface cleaning apparatus is operated.

Figure 57:
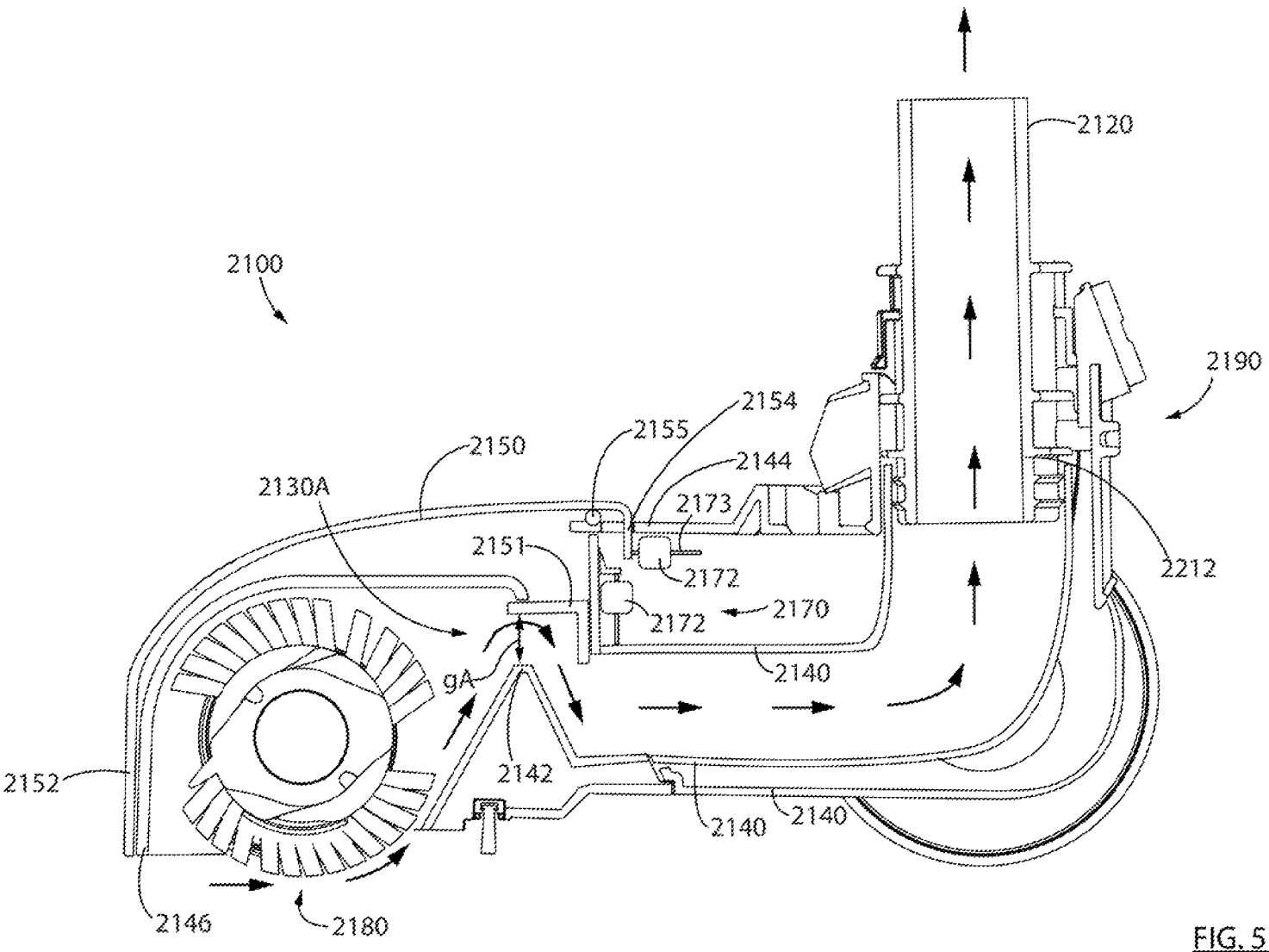
FIG. 57 is a schematic cross-section view of a surface cleaning head with a reconfigurable dirty air inlet in accordance with another embodiment, with the surface cleaning head in a first configuration; and, FIG. 58 is a schematic cross-section view of the surface cleaning head of FIG. 57, with the surface cleaning head in a second configuration.
Figure 58:
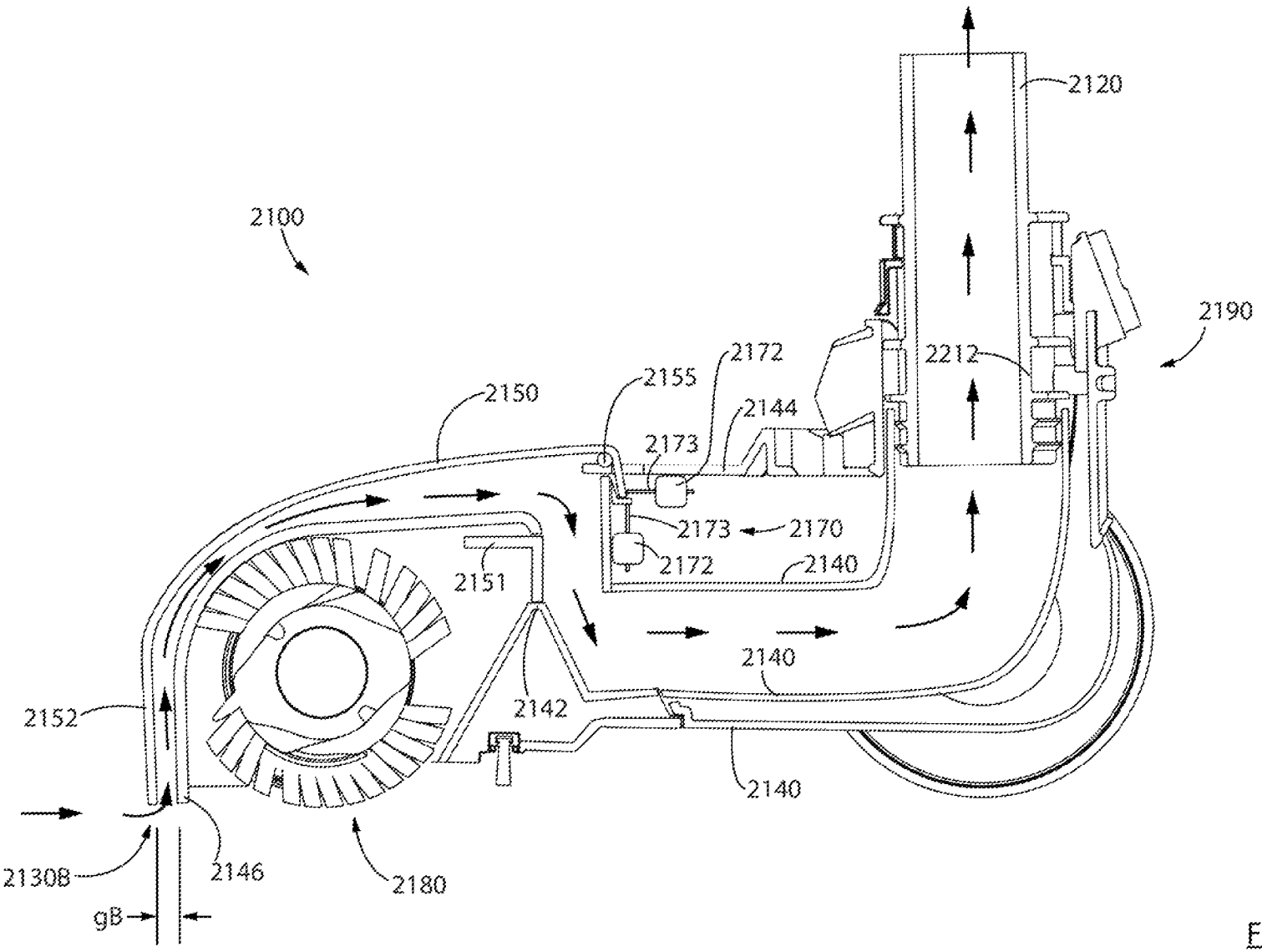

FIGS. 57 and 58 schematically illustrate another example embodiment of a surface cleaning head 2100. In this illustrated embodiment, the repositionable cover plate 2150 includes an internal blocking member or valve 2151 that maintains a fixed position with cover plate 2150. For example, the lateral ends (not shown) of blocking member 2151 may be secured to sides of the cover plate 2150 (not shown). Alternatively, cover plate 2150 and blocking member 2151 may be integrally formed.

In the configuration illustrated in FIG. 57, main body 2140 and internal blocking member 2151 cooperatively define a dirty air inlet 2130A of surface cleaning head 2100. Specifically, an upper portion of blocking member 2151 and an upwardly facing surface 2142 of main body 2140 cooperatively define a dirty air inlet 2130A. Inlet 2130A is shown schematically as having a length $g_A$ and may extend across most or substantially all of the width of surface cleaning head 2100. Accordingly, the cross-sectional flow area of dirty air inlet 2130A may be approximated by multiplying the length $g_A$ by the width of the dirty air inlet 2130A.

In the illustrated example, surface cleaning head 2100 includes a brush roll 2180 positioned between a lower end of the surface cleaning head and the dirty air inlet 2130A. Accordingly, dirty air inlet 2130A may have a cross-sectional flow area selected to promote improved airflow efficiency when collecting relatively fine dust and debris agitated from the floor surface by the brush roll.

Main body 2140 and internal blocking member 2151 also cooperatively define at least a portion of an air flow path extending from dirty air inlet 2130A to an upstream end 2212 of an upflow conduit or duct 2210.

Cover plate 2150 and internal blocking member 2151 may be concurrently repositioned relative to main body 2140, thereby closing off dirty air inlet 2130A and opening an alternative dirty air inlet 2130B. For example, in FIG. 58, cover plate 2150 and internal blocking member 2151 have been moved forwardly relative to main body main body 2140. In this configuration, blocking member 2151 has been brought into abutment with upwardly facing surface 2142 and occluded substantially all of the former gap that had a length $g_A$, and therefore dirty air inlet 2130A may be effectively closed.

Also, in the configuration illustrated in FIG. 58, after repositioning cover plate 2150, a gap having a length $g_B$ is provided between a lower edge 2152 of cover plate 2150 and a forward portion 2146 of main body 2140. Thus, a dirty air inlet 2130B may be effectively opened.

In the illustrated example, dirty air inlet 2130B may have a cross-sectional flow area selected to promote increased air velocity (and thereby promote improved 'lifting power') to assist in lifting heavier debris, and/or liquids from the floor surface S.

In the example embodiment illustrated in FIGS. 57 and 58, an electrically actuated mechanism 2170 is used. Mechanism 2170 includes two linear actuators 2170 that are operable to selectively extend or retract rods 2173, which in the illustrated example are configured to engage an edge 2154 of cover plate 2150. It will be appreciated that other mechanisms may be used in one or more alternative embodiments.

Preferably, one or more sealing members are provided to inhibit or prevent airflow losses between dirty air inlets 2130A, 2130B and the upstream end 2212 of duct 2210. In the embodiment illustrated in FIGS. 57 and 58, an elastomeric gasket 2155 is provided between an upper flange 2144 of main body 2140 and an underside of cover plate 2150 that overlies the flange 2144. It will be appreciated that additional and/or alternative sealing members may be used in one or more alternative embodiments.

It will be appreciated that some of the embodiments disclosed herein may not use any of the features of the reconfigurable dirty air inlet disclosed herein and that, in those embodiments, an air inlet of any kind known in the art may be used.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A reconfigurable surface cleaning apparatus comprising:

(a) a floor cleaning unit comprising a surface cleaning head, an upper section and a floor cleaning unit air flow path extending from a surface cleaning head dirty air inlet to a floor cleaning unit air outlet, the upper section being moveably mounted to the surface cleaning head between an upright storage position and an inclined floor cleaning position, the upper section comprising a longitudinally extending rigid wand, the floor cleaning unit air flow path including the rigid wand, the rigid wand having an air outlet end comprising a longitudinally extending sidewall and an outlet end that extends at a non-zero acute angle to the sidewall; and, (b) a hand vacuum cleaner having a front end and a rear end, the hand vacuum cleaner comprising a hand vacuum cleaner air flow path extending from a hand vacuum cleaner dirty air inlet provided at the front end to a hand vacuum cleaner air outlet positioned rearward of the dirty air inlet, the hand vacuum cleaner air flow path including an air treatment member having a central axis extending between a front end of the air treatment member and a rear end of the air treatment member, a suction motor, an inlet conduit extending from the hand vacuum cleaner dirty air inlet to a downstream end of the inlet conduit which is positioned at an air inlet of the air treatment member and a downstream portion extending from the air treatment member to the hand vacuum cleaner air outlet, wherein the air inlet of the air treatment member directs the air in a direction generally transverse to the inlet conduit axis into the air treatment member and wherein the hand vacuum cleaner is removably mountable to the rigid wand, wherein the inlet conduit has an outlet end having an end wall that terminates flow in a direction of the inlet conduit axis, and wherein the inlet conduit has a cross sectional area in a plane transverse to a direction of flow through the inlet conduit that is constant along a length of the inlet conduit, wherein the reconfigurable surface cleaning apparatus is operable in a floor cleaning mode in which the rigid wand extends through the inlet conduit and the outlet end of the rigid conduit contacts the end wall of the inlet conduit, and wherein the reconfigurable surface cleaning apparatus is operable in an above floor cleaning mode in which the hand vacuum cleaner is disconnected from air flow with the rigid wand, and wherein a velocity of air traveling through the rigid wand in the floor cleaning mode is greater than a velocity of air through the inlet conduit in the above floor cleaning mode when a first power level is provided to the suction motor in both the floor cleaning mode and in the above floor cleaning mode, and wherein a cross-sectional area of the air inlet of the air treatment member in a plane transverse to a direction of air flow through the air inlet of the air treatment member is equal to a cross-sectional area of the rigid wand in a plane transverse to a direction of air flow through the rigid wand.

2. The reconfigurable surface cleaning apparatus of claim 1 wherein the hand vacuum cleaner further comprises a handle and, in the floor cleaning mode, the handle is drivingly connected to the surface cleaning head whereby the handle is useable to steer the surface cleaning head.

3. The reconfigurable surface cleaning apparatus of claim 1 wherein the suction motor is operated at the same power level in the floor cleaning mode and in the above floor cleaning mode.

4. The reconfigurable surface cleaning apparatus of claim 1 wherein the suction motor is operated at a first power level in the floor cleaning mode and at a second, higher power level in the above floor cleaning mode.

5. The reconfigurable surface cleaning apparatus of claim 1 wherein a cross-sectional area of the inlet conduit in a plane transverse to a direction of air flow through the inlet conduit is at least 25% greater than the cross-sectional area of the rigid wand.

6. The reconfigurable surface cleaning apparatus of claim 1 wherein the downstream portion has a cross sectional area in a plane transverse to a direction of flow through the downstream portion that is at least as large as a cross-sectional area of the inlet conduit in a plane transverse to a direction of air flow through the inlet conduit.

7. The reconfigurable surface cleaning apparatus of claim 1 wherein the air treatment member comprises a cyclone and the air inlet of the air treatment member comprises a tangential air inlet of the cyclone.

* * * * *